US007972451B2

(12) United States Patent
Ueda et al.

(10) Patent No.: US 7,972,451 B2
(45) Date of Patent: Jul. 5, 2011

(54) PEARLITIC STEEL RAIL EXCELLENT IN WEAR RESISTANCE AND DUCTILITY AND METHOD FOR PRODUCING SAME

(75) Inventors: Masaharu Ueda, Kitakyushu (JP); Koichiro Matsushita, Kitakyushu (JP); Kazuo Fujita, Kitakyushu (JP); Katsuya Iwano, Kitakyushu (JP); Koichi Uchino, Kitakyushu (JP); Takashi Morohoshi, Kitakyushu (JP); Akira Kobayashi, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 54 days.

(21) Appl. No.: 11/780,166

(22) Filed: Jul. 19, 2007

(65) Prior Publication Data

US 2008/0011393 A1 Jan. 17, 2008

Related U.S. Application Data

(62) Division of application No. 10/482,753, filed as application No. PCT/JP03/04364 on Apr. 4, 2003, now abandoned.

(30) Foreign Application Priority Data

| | | |
|---|---|---|
| Apr. 5, 2002 | (JP) | 2002-104457 |
| Jul. 10, 2002 | (JP) | 2002-201205 |
| Jul. 10, 2002 | (JP) | 2002-201206 |
| Nov. 12, 2002 | (JP) | 2002-328260 |
| Nov. 12, 2002 | (JP) | 2002-328261 |
| Jan. 20, 2003 | (JP) | 2003-011701 |
| Jan. 24, 2003 | (JP) | 2003-015647 |

(51) Int. Cl.

| | |
|---|---|
| ***C22C 38/02*** | (2006.01) |
| ***C22C 38/04*** | (2006.01) |
| ***C21D 9/04*** | (2006.01) |

(52) U.S. Cl. ..... 148/320; 148/333; 148/584; 148/581; 148/654

(58) Field of Classification Search ..... 148/581, 148/584, 654, 320, 333
See application file for complete search history.

(56) References Cited

U.S. PATENT DOCUMENTS

2001/0025674 A1 10/2001 Prskawetz et al.

FOREIGN PATENT DOCUMENTS

| | | | |
|---|---|---|---|
| CA | 2154779 | | 6/1995 |
| EP | 685566 | * | 6/1995 |

(Continued)

*Primary Examiner* — Deborah Yee

(74) *Attorney, Agent, or Firm* — Baker Botts LLP

(57) ABSTRACT

The present invention is: a pearlitic steel rail excellent in wear resistance and ductility, characterized in that, in a steel rail having pearlite structure containing, in mass, 0.65 to 1.40% C, the number of the pearlite blocks having grain sizes in the range from 1 to 15 μm is 200 or more per 0.2 $mm^2$ of an observation field at least in a part of the region down to a depth of 10 mm from the surface of the corners and top of the head portion; and a method for producing a pearlitic steel rail excellent in wear resistance and ductility, characterized by, in the hot rolling of said steel rail, applying finish rolling so that the temperature of the rail surface may be in the range from 850° C. to 1,000° C. and the sectional area reduction ratio at the final pass may be 6% or more, and then applying accelerated cooling to the head portion of said rail at a cooling rate in the range from 1 to 30° C./sec. from the austenite temperature range to at least 550° C.

15 Claims, 6 Drawing Sheets

FOREIGN PATENT DOCUMENTS

| | | | | |
|---|---|---|---|---|
| EP | 0685566 | A1 | | 12/1995 |
| EP | 07547751 | A1 | | 1/1997 |
| JP | 08-049019 | A | | 2/1996 |
| JP | 09-137227 | A | | 5/1997 |
| JP | 09-137228 | | | 5/1997 |
| JP | 09-137228 | A | | 5/1997 |
| JP | 09-316598 | A | | 12/1997 |
| JP | 11-092867 | A | | 4/1999 |
| JP | 2001-234238 | | * | 8/2001 |
| JP | 2001-234238 | A | | 8/2001 |
| JP | 2002-226914 | A | | 8/2002 |
| JP | 2002-226915 | A | | 8/2002 |

* cited by examiner

PEARLITIC STEEL RAIL EXCELLENT IN WEAR RESISTANCE AND DUCTILITY AND METHOD FOR PRODUCING SAME

This application is a Divisional of application Ser. No. 10/482,753 filed Dec. 29, 2003 now abandoned which is a 371 of PCT/JP03/04364 filed Apr. 4, 2003, incorporated by reference herein.

TECHNICAL FIELD

The present invention relates to: a pearlitic steel rail that is aimed at improving wear resistance at the head portion of a steel rail for a heavy-load railway, enhancing resistance to breakage of the rail by improving ductility through controlling the number of fine pearlite block grains at the head portion of the rail, and preventing the toughness of the web and base portions of the rail from deteriorating by reducing the formation of pro-eutectoid cementite structures at these portions; and a method for efficiently producing a high-quality pearlitic steel rail by optimizing the heating conditions of a bloom (slab) for said rail, thus preventing cracking and breakage during hot rolling, and suppressing decarburization in the outer surface layer of the bloom (slab).

BACKGROUND ART

Overseas, in heavy-load railways, attempts have been made to increase the speed and loading weight of a train to improve the efficiency of railway transportation. Such an improvement in the railway transportation efficiency means that the environment for the use of rails is becoming increasingly severe, and this requires further improvements in the material quality of rails. Specifically, wear at the gauge corner and the head side portions of a rail laid on a curved track increases drastically and the fact has come to be viewed as a problem from the viewpoint of the service life of a rail. In this background, the developments of rails aimed mainly at enhancing wear resistance have been promoted as described below.

1) A method of producing a high-strength rail having a tensile strength of 130 kgf/mm$^2$ (1,274 MPa) or more, characterized by subjecting the head portion of the rail to accelerated cooling at a cooling rate of 1 to 4° C./sec. from the austenite temperature range to a temperature in the range from 850° C. to 500° C. after the end of rolling or the application of reheating (Japanese Unexamined Patent Publication No. S57-198216).

2) A rail excellent in wear resistance wherein a hyper-eutectoid steel (containing over 0.85 to 1.20% C) is used and the density of cementite in lamella in pearlite structures is increased (Japanese Unexamined Patent Publication No. H8-144016).

In the case 1) above, it is intended that high strength is secured by using a eutectoid carbon-containing steel (containing 0.7 to 0.8% C) and thus forming fine pearlite structures. However, there is a problem in that wear resistance is insufficient and rail breakage is likely to occur when the rail is used for a heavy load railway since ductility is low. In the case 2) above, it is intended that wear resistance is improved by using a hyper-eutectoid carbon steel (containing over 0.85 to 1.20% C), thus forming fine pearlite structures, and then increasing the density of cementite in lamellae in pearlite structures. However, ductility is prone to deteriorate and, therefore, resistance to breakage of a rail is low as the carbon content thereof is higher than that of a presently used eutectoid carbon-containing steel. Further, there is another problem in that segregation bands, where carbon and alloying elements are concentrated, are likely to form at the center portion of a casting at the stage of the cast of molten steel, pro-eutectoid cementite forms in a great amount along the segregation bands especially at the web portion, which is indicated by the reference numeral 5 in FIG. 1, of a rail after rolling, and the pro-eutectoid cementite serves as the origin of fatigue cracks or brittle cracks. Furthermore, when a heating temperature is inadequate in a reheating process for hot-rolling a bloom (slab) to be rolled, the bloom (slab) is in a molten state partially, cracks develop and, as a consequence, the bloom (slab) breaks during hot rolling or cracks remain in the rail after finish hot rolling, and therefore the product yield deteriorates. What is more, another problem is that, in some retention times at a reheating process, decarburization is accelerated in the outer surface layer of a bloom (slab), hardness lowers, caused by the decrease of a carbon content in pearlite structures in the outer surface layer of a rail after finish hot rolling and, therefore, wear resistance at the head portion of the rail deteriorates.

In view of the above situation, the developments of rails have been promoted for solving the aforementioned problems as shown below.

3) A rail wherein a eutectoid steel (containing 0.60 to 0.85% C) is used, the average size of block grains in pearlite structures is made fine through rolling, and thus ductility and toughness are enhanced (Japanese Unexamined Patent Publication No. H8-109440).

4) A rail excellent in wear resistance wherein a hyper-eutectoid steel (containing over 0.85 to 1.20% C) is used, the density of cementite in lamella in pearlite structures is increased, and, at the same time, hardness is controlled (Japanese Unexamined Patent Publication No. H8-246100).

5) A rail excellent in wear resistance wherein a hyper-eutectoid steel (containing over 0.85 to 1.20% C) is used, the density of cementite in lamella in pearlite structures is increased, and, at the same time, hardness is controlled by applying a heat treatment to the head and/or web portion(s) (Japanese Unexamined Patent Publication No. H9-137228).

6) A rail wherein a hyper-eutectoid steel (containing over 0.85 to 1.20% C) is used, the average size of block grains in pearlite structures is made fine through rolling and, thus, ductility and toughness are enhanced (Japanese Unexamined Patent Publication No. H8-109439).

In the rails proposed in the cases 3) and 4) above, the wear resistance, ductility and toughness of pearlite structures are enhanced by making the average size of block grains in the pearlite structures fine, and the wear resistance of the pearlite structures is further enhanced by increasing a carbon content in a steel, increasing the density of cementite in lamellae in the pearlite structures and also increasing hardness. However, despite the proposed technologies, the ductility and toughness of rails have been insufficient in cold regions where the temperature falls below the freezing point. What is more, even when such average size of block grains in pearlite structures as described above is made still finer in an attempt to enhance the ductility and toughness of rails, it has been difficult to thoroughly suppress rail breakage in cold regions. Further, in the rails proposed in the cases 4) and 5) above, there is a problem in that, in some rolling lengths and rolling end temperatures of rails, the uniformity of the material quality of the rails in the longitudinal direction and the ductility of the head portions thereof cannot be secured. On top of that, although it is possible to secure the hardness of pearlite structures at head portions and suppress the formation of pro-eutectoid cementite structures at web portions by applying accelerated cooling to the head and web portions of rails, it has still been difficult to suppress the formation of pro-eutectoid cementite structures, which serve as the starting points of fatigue cracks and brittle cracks, at the base and base toe portions of the rails, even when the heat treatment methods disclosed above are employed. At a base toe portion in particular, as the sectional area is smaller than those at head and web portions, the temperature of a base toe portion at the end of rolling tends to be lower than those of the other portions and, as a result, pro-eutectoid cementite structures form before heat treatment. Furthermore, at a web portion too, there are still other problems in that: pro-eutectoid cementite structures are likely to form because the segregation bands of various alloying elements remain; and, additionally, the temperature of the web portion is low at the end of hot rolling. Therefore, an additional problem has been that it is impossible to completely prevent the fatigue cracks and brittle cracks originating at base toe and web portions.

What is more, in the rail disclosed in the case 6) above, though a technology of making the average size of block grains in pearlite structures fine in a hyper-eutectoid steel in an attempt to improve the ductility and toughness of a rail is disclosed, it has been difficult to thoroughly suppress the occurrence of rail breakage in cold regions.

DISCLOSURE OF THE INVENTION

In the aforementioned situation, a pearlitic steel rail excellent in wear resistance and ductility and a production method thereof are looked for, to make it possible, in a rail of pearlite structure having a high carbon content, to realize: a superior wear resistance at the head portion of the rail; a high resistance to rail breakage by enhancing ductility; the prevention of the formation of pro-eutectoid cementite structures by optimizing cooling conditions; and, in addition to those, the uniformity in material characteristics in the longitudinal direction of the rail and the suppression of decarburization at the outer surface of the rail.

The present invention provides a pearlitic steel rail excellent in wear resistance and ductility and a production method thereof, wherein, in a rail used for a heavy load railway, the wear resistance and ductility required of the railhead portion are enhanced, the resistance to rail breakage is improved in particular, and the fracture resistance of the web, base and base toe portions of the rail is improved by preventing pro-eutectoid cementite structures from forming.

Further, the present invention provides a high-efficiency and high-quality pearlitic steel rail, wherein: cracking and breakage during hot rolling are prevented by optimizing the maximum heating temperature and the retention time at a reheating process in the event of hot-rolling a high-carbon steel bloom (slab) for rail rolling; and, in addition, the deterioration of wear resistance and fatigue strength is suppressed by controlling decarburization in the outer surface layer of the rail.

Still further, the present invention provides a method for producing a pearlitic steel rail excellent in wear resistance and ductility, wherein, in a rail having a high carbon content, the occurrence of cracks caused by fatigue, brittleness and lack of toughness is prevented and, at the same time, the wear resistance of the head portion, the uniformity in material quality in the longitudinal direction of the rail and the ductility of the head portion of the rail are secured by applying accelerated cooling to the head, web and base portions of the rail immediately after the end of hot rolling or within a certain time period thereafter, further optimizing the selection of an accelerated cooling rate at the head portion, a rail length at rolling, and a temperature at the end of rolling, and, by so doing, suppressing the formation of pro-eutectoid cementite structures.

The gist of the present invention, that attains the above object, is as follows:

(1) A pearlitic steel rail excellent in wear resistance and ductility, characterized in that, in a steel rail having pearlite structures containing, in mass, 0.65 to 1.40% C, the number of the pearlite blocks having grain sizes in the range from 1 to 15 μm is 200 or more per 0.2 $mm^2$ of observation field at least in a part of the region down to a depth of 10 mm from the surface of the corners and top of the head portion.

(2) A pearlitic steel rail excellent in wear resistance and ductility, characterized in that, in a steel rail having pearlite structures containing, in mass, 0.65 to 1.40% C, 0.05 to 2.00% Si, and 0.05 to 2.00% Mn, the number of the pearlite blocks having grain sizes in the range from 1 to 15 μm is 200 or more per 0.2 $mm^2$ of observation field at least in a part of the region down to a depth of 10 mm from the surface of the corners and top of the head portion.

(3) A pearlitic steel rail excellent in wear resistance and ductility, characterized in that, in a steel rail having pearlite structures containing, in mass, 0.65 to 1.40% C, 0.05 to 2.00% Si, 0.05 to 2.00% Mn, and 0.05 to 2.00% Cr, the number of the pearlite blocks having grain sizes in the range from 1 to 15 μm is 200 or more per 0.2 $mm^2$ of observation field at least in a part of the region down to a depth of 10 mm from the surface of the corners and top of the head portion.

(4) A pearlitic steel rail excellent in wear resistance and ductility according to any one of the items (1) to (3), characterized in that the C content of the steel rail is over 0.85 to 1.40%.

(5) A pearlitic steel rail excellent in wear resistance and ductility according to any one of the items (1) to (4), characterized in that the length of the rail after hot rolling is 100 to 200 m.

(6) A pearlitic steel rail excellent in wear resistance and ductility according to any one of the items (1) to (5), characterized in that the hardness in the region down to a depth of at least 20 mm from the surface of the corners and top of the head portion is in the range from 300 to 500 Hv.

(7) A pearlitic steel rail excellent in wear resistance and ductility according to any one of the items (1) to (6), characterized by further containing, in mass, 0.01 to 0.50% Mo.

(8) A pearlitic steel rail excellent in wear resistance and ductility according to any one of the items (1) to (7), characterized by further containing, in mass, one or more of 0.005 to 0.50% V, 0.002 to 0.050% Nb, 0.0001 to 0.0050% B, 0.10 to 2.00% Co, 0.05 to 1.00% Cu, 0.05 to 1.00% Ni, and 0.0040 to 0.0200% N.

(9) A pearlitic steel rail excellent in wear resistance and ductility according to any one of the items (1) to (8), characterized by further containing, in mass, one or more of 0.0050 to 0.0500% Ti, 0.0005 to 0.0200% Mg, 0.0005 to 0.0150% Ca, 0.0080 to 1.00% Al, and 0.0001 to 0.2000% Zr.

(10) A pearlitic steel rail excellent in wear resistance and ductility according to any one of the items (4) to (9), characterized by reducing the amount of pro-eutectoid cementite structures forming in the web portion of the rail so that the number of the pro-eutectoid cementite network intersecting two line segments each 300 μm in length crossing each other at right angles (the number of intersecting pro-eutectoid cementite network, NC) at the center of the centerline in the web portion of the rail may satisfy the expression NC≦CE in relation to the value of CE defined by the following equation (1):

$$CE=60([\text{mass \% C}])+10([\text{mass \% Si}])+10([\text{mass \% Mn}])+500([\text{mass \% P}])+50([\text{mass \% S}])+30([\text{mass \% Cr}])+50 \quad (1).$$

(11) A method for producing a pearlitic steel rail excellent in wear resistance and ductility, characterized by, in the hot rolling of a steel rail containing 0.65 to 1.40 mass % C: applying finish rolling so that the temperature of the rail surface may be in the range from 850° C. to 1,000° C. and the sectional area reduction ratio at the final pass may be 6% or more; then applying accelerated cooling to the head portion of said rail at a cooling rate in the range from 1 to 30° C./sec. from the austenite temperature range to a temperature not higher than 550° C.; and controlling the number of the pearlite blocks having grain sizes in the range from 1 to 15 μm so as to be 200 or more per 0.2 $mm^2$ of observation field at least in a part of the region down to a depth of 10 mm from the surface of the corners and top of the head portion.

(12) A method for producing a pearlitic steel rail excellent in wear resistance and ductility, characterized by, in the hot rolling of a steel rail containing, in mass, 0.65 to 1.40% C, 0.05 to 2.00% Si, and 0.05 to 2.00% Mn: applying finish rolling so that the temperature of the rail surface may be in the range from 850° C. to 1,000° C. and the sectional area reduction ratio at the final pass may be 6% or more; then applying accelerated cooling to the head portion of said rail at a cooling rate in the range from 1 to 30° C./sec. from the austenite temperature range to a temperature not higher than 550° C.; and controlling the number of the pearlite blocks having grain sizes in the range from 1 to 15 μm so as to be 200 or more per 0.2 $mm^2$ of observation field at least in a part of the region down to a depth of 10 mm from the surface of the corners and top of the head portion.

(13) A method for producing a pearlitic steel rail excellent in wear resistance and ductility, characterized by, in the hot rolling of a steel rail containing, in mass, 0.65 to 1.40% C, 0.05 to 2.00% Si, 0.05 to 2.00% Mn, and 0.05 to 2.00% Cr: applying finish rolling so that the temperature of the rail surface may be in the range from 850° C. to 1,000° C. and the sectional area reduction ratio at the final pass may be 6% or more; then applying accelerated cooling to the head portion of said rail at a cooling rate in the range from 1 to 30° C./sec. from the austenite temperature range to a temperature not higher than 550° C.; and controlling the number of the pearlite blocks having grain sizes in the range from 1 to 15 μm so as to be 200 or more per 0.2 $mm^2$ of observation field at least in a part of the region down to a depth of 10 mm from the surface of the corners and top of the head portion.

(14) A method for producing a pearlitic steel rail excellent in wear resistance and ductility according to any one of the items (11) to (13), characterized in that, at the finish rolling in the hot rolling of said steel rail, continuous finish rolling is applied so that two or more rolling passes may be applied at a sectional area reduction ratio of 1 to 30% per pass and the time period between the passes may be 10 sec. or less.

(15) A method for producing a pearlitic steel rail excellent in wear resistance and ductility according to any one of the items (11) to (13), characterized by applying accelerated cooling to the head portion of said rail at a cooling rate in the range from 1 to 30° C./sec. from the austenite temperature range to a temperature not higher than 550° C. within 200 sec. after the end of the finish rolling in the hot rolling of said steel rail.

(16) A method for producing a pearlitic steel rail excellent in wear resistance and ductility according to any one of the items (11) to (13), characterized by applying accelerated cooling within 200 sec. after the end of the finish rolling in the hot rolling of said steel rail: to the head portion of said rail at a cooling rate in the range from 1 to 30° C./sec. from the austenite temperature range to a temperature not higher than 550° C.; and to the web and base portions of said rail at a cooling rate in the range from 1 to 10° C./sec. from the austenite temperature range to a temperature not higher than 650° C.

(17) A method for producing a pearlitic steel rail excellent in wear resistance and ductility according to any one of the items (11) to (16), characterized by, in a reheating process for a bloom or slab containing aforementioned steel composition, reheating said bloom or slab so that: the maximum heating temperature (Tmax, ° C.) of said bloom or slab may satisfy the expression Tmax≦CT in relation to the value of CT defined by the following equation (2) composed of the carbon content of said bloom or slab; and the retention time (Mmax, min.) of said bloom or slab after said bloom or slab is heated to a temperature of 1,100° C. or above may satisfy the expression Mmax≦CM in relation to the value of CM defined by the following equation (3) composed of the carbon content of said bloom or slab:

$$CT=1{,}500-140([\text{mass \% C}])-80([\text{mass \% C}])^2 \quad (2),$$

$$CM=600-120([\text{mass \% C}])-60([\text{mass \% C}])^2 \quad (3).$$

(18) A method for producing a pearlitic steel rail excellent in wear resistance and ductility according to any one of the items (11) to (16), characterized by applying accelerated cooling, after hot-rolling a bloom or slab containing aforementioned steel composition into the shape of a rail: within 60 sec. after the hot rolling, to the base toe portions of said steel rail at a cooling rate in the range from 5 to 20° C./sec. from the austenite temperature range to a temperature not higher than 650° C.; and to the head, web and base portions of said steel rail at a cooling rate in the range from 1 to 10° C./sec. from the austenite temperature range to a temperature not higher than 650° C.

(19) A method for producing a pearlitic steel rail excellent in wear resistance and ductility according to any one of the items (11) to (16), characterized by applying accelerated cooling, after hot-rolling a bloom or slab containing aforementioned steel composition into the shape of a rail: within 100 sec. after the hot rolling, to the web portion of said steel rail at a cooling rate in the range from 2 to 20° C./sec. from the austenite temperature range to a temperature not higher than 650° C.; and to the head and base portions of said steel rail at a cooling rate in the range from 1 to 10° C./sec. from the austenite temperature range to a temperature not higher than 650° C.

(20) A method for producing a pearlitic steel rail excellent in wear resistance and ductility according to any one of the items (11) to (16), characterized by applying accelerated cooling, after hot-rolling a bloom or slab containing aforementioned steel composition into the shape of a rail: within 60 sec. after the hot rolling, to the base toe portions of said steel rail at a cooling rate in the range from 5 to 20° C./sec. from the austenite temperature range to a temperature not higher than 650° C.; within 100 sec. after the hot rolling, to the web portion of said steel rail at a cooling rate in the range from 2 to 20° C./sec. from the austenite temperature range to a temperature not higher than 650° C.; and to the head and base portions of said steel rail at a cooling rate in the range from 1 to 10° C./sec. from the austenite temperature range to a temperature not higher than 650° C.

(21) A method for producing a pearlitic steel rail excellent in wear resistance and ductility according to any one of the items (11) to (16), characterized by, after hot-rolling a bloom or slab containing aforementioned steel composition into the shape of a rail: within 60 sec. after the hot rolling, raising the temperature at the base toe portions of said steel rail to a temperature 50° C. to 100° C. higher than the temperature before the temperature rising; and also applying accelerated cooling to the head, web and base portions of said steel rail at a cooling rate in the range from 1 to 10° C./sec. from the austenite temperature range to a temperature not higher than 650° C.

(22) A method for producing a pearlitic steel rail excellent in wear resistance and ductility according to any one of the items (11) to (16), characterized by, after hot-rolling a bloom or slab containing aforementioned steel composition into the shape of a rail: within 100 sec. after the hot rolling, raising the temperature at the web portion of said steel rail to a temperature 20° C. to 100° C. higher than the temperature before the temperature rising; and also applying accelerated cooling to the head, web and base portions of said steel rail at a cooling rate in the range from 1 to 10° C./sec. from the austenite temperature range to a temperature not higher than 650° C.

(23) A method for producing a pearlitic steel rail excellent in wear resistance and ductility according to any one of the items (11) to (16), characterized by, after hot-rolling a bloom or slab containing aforementioned steel composition into the shape of a rail: within 60 sec. after the hot rolling, raising the temperature at the base toe portions of said steel rail to a temperature 20° C. to 100° C. higher than the temperature before the temperature rising; within 100 sec. after the hot rolling, raising the temperature at the web portion of said steel rail to a temperature 20° C. to 100° C. higher than the temperature before the temperature rising; and also applying accelerated cooling to the head, web and base portions of said steel rail at a cooling rate in the range from 1 to 10° C./sec. from the austenite temperature range to a temperature not higher than 650° C.

(24) A method for producing a pearlitic steel rail excellent in wear resistance and ductility according to any one of the items (11) to (16), characterized by, in the event of accelerated cooling the head portion of said steel rail from the austenite temperature range, applying the accelerated cooling so that the cooling rate (ICR, ° C./sec.) in the temperature range from 750° C. to 650° C. at a head inner portion 30 mm in depth from the head top surface of said steel rail may satisfy the expression ICR≧CCR in relation to the value of CCR defined by the following equation (4) composed of the chemical compositions of said steel rail:

$$CCR=0.6+10\times([\%\ C]-0.9)-5\times([\%\ C]-0.9)\times[\%\ Si]-0.17[\%\ Mn]-0.13[\%\ Cr] \quad (4).$$

(25) A method for producing a pearlitic steel rail excellent in wear resistance and ductility according to any one of the items (11) to (16), characterized by, in the event of accelerated cooling the head portion of said steel rail from the austenite temperature range, applying the accelerated cooling so that the value of TCR defined by the following equation (5) composed of the respective cooling rates in the temperature range from 750° C. to 500° C. at the surfaces of the head top portion (TH, ° C./sec.), the head side portions (TS, ° C./sec.) and the lower chin portions (TJ, ° C./sec.) of said steel rail may satisfy the expression 4CCR≧TCR≧2CCR in relation to the value of CCR defined by the following equation (4) composed of the chemical compositions of said steel rail:

$$CCR=0.6+10\times([\%\ C]-0.9)-5\times([\%\ C]-0.9)\times[\%\ Si]-0.17[\%\ Mn]-0.13[\%\ Cr] \quad (4),$$

$$TCR=0.05TH(°\ C./sec.)+0.10TS(°\ C./sec.)+0.50TJ(°\ C./sec.) \quad (5).$$

(26) A method for producing a pearlitic steel rail excellent in wear resistance and ductility according to any one of the items (11) to (25), characterized in that the C content of the steel rail is 0.85 to 1.40%.

(27) A method for producing a pearlitic steel rail excellent in wear resistance and ductility according to any one of the items (11) to (26), characterized in that the length of the rail after hot rolling is 100 to 200 m.

(28) A method for producing a pearlitic steel rail excellent in wear resistance and ductility according to any one of the items (11) to (27), characterized in that the hardness in the region down to a depth of at least 20 mm from the surface of the corners and top of the head portion of a pearlitic steel rail according to any one of the items (1) to (10) is in the range from 300 to 500 Hv.

(29) A method for producing a pearlitic steel rail excellent in wear resistance and ductility according to any one of the items (11) to (28), characterized in that the steel rail further contains, in mass, 0.01 to 0.50% Mo.

(30) A method for producing a pearlitic steel rail excellent in wear resistance and ductility according to any one of the items (11) to (29), characterized in that the steel rail further contains, in mass, one or more of 0.005 to 0.50% V, 0.002 to 0.050% Nb, 0.0001 to 0.0050% B, 0.10 to 2.00% Co, 0.05 to 1.00% Cu, 0.05 to 1.00% Ni, and 0.0040 to 0.0200% N.

(31) A method for producing a pearlitic steel rail excellent in wear resistance and ductility according to any one of the items (11) to (30), characterized in that the steel rail further contains, in mass, one or more of 0.0050 to 0.0500% Ti, 0.0005 to 0.0200% Mg, 0.0005 to 0.0150% Ca, 0.0080 to 1.00% Al, and 0.0001 to 0.2000% Zr.

(32) A method for producing a pearlitic steel rail excellent in wear resistance and ductility according to any one of the items (11) to (31), characterized by reducing the amount of pro-eutectoid cementite structures forming in the web portion of the rail so that the number of the pro-eutectoid cementite network intersecting two line segments each 300 μm in length crossing each other at right angles (the number of intersecting pro-eutectoid cementite network, NC) at the center of the centerline in the web portion of the rail may satisfy the expression NC ≦CE in relation to the value of CE defined by the following equation (1):

$$CE=60([\text{mass}\ \%\ C])+10([\text{mass}\ \%\ Si])+10([\text{mass}\ \%\ Mn])+500([\text{mass}\ \%\ P])+50([\text{mass}\ \%\ S])+30([\text{mass}\ \%\ Cr])+50 \quad (1).$$

BEST MODE FOR CARRYING OUT THE INVENTION

Figure 1:
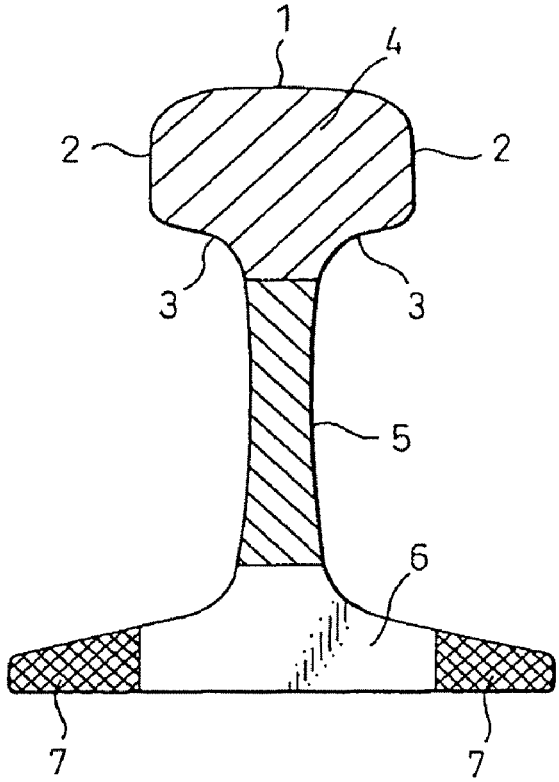
FIG. 1 is an illustration showing the denominations of different portions of a rail.

The present invention is hereafter explained in detail.

The present inventors studied, in the first place, the relationship between the occurrence of rail breakage and the mechanical properties of pearlite structures. As a result, it has been confirmed that the occurrence of the rail breakage originating from the railhead portion correlates well with ductility evaluated in a tensile test rather than toughness evaluated in an impact test, in which a loading speed is comparatively high, because the loading speed imposed on the railhead portion by contact with a wheel is comparatively low.

Then the present inventors re-examined the relationship between ductility and the block size of pearlite structures in a steel rail of pearlite structures having a high carbon content. As a result, it has been confirmed that, though the ductility of pearlite structures tends to improve as the average size of block grains in the pearlite structures decreases, the ductility does not improve sufficiently with the mere decrease in the average size of the block grains in a region where the average size of the block grains is very fine.

In view of this, the present inventors studied dominating factor of the ductility of pearlite structures in a region where the average size of the block grains in pearlite structures was very fine. As a result, it has been discovered that the ductility of pearlite structures correlates not with the average block grain size but with the number of the fine pearlite block grains having certain grain sizes and that the ductility of pearlite structures significantly improves by controlling the number of the fine pearlite block grains having certain grain sizes to a certain value or more in a given area of a visual field.

On the basis of the above findings, the present inventors have discovered that, in a steel rail of pearlite structures having a high carbon content, both the wear resistance and the ductility at the railhead portion are improved simultaneously by controlling the number of the fine pearlite block grains having certain grain sizes in the railhead portion.

That is, an object of the present invention is, in a high-carbon containing rail for heavy load railways, to enhance the wear resistance at the head portion thereof, and, at the same time, to prevent the occurrence of fracture such as breakage of the rail by improving ductility through the control of the number of the fine pearlite block grains having certain grain sizes.

Next, the reasons for regulating the conditions in the present invention are hereafter explained in detail.

(1) Regulations for the Size and the Number of Pearlite Block Grains

Firstly, the reasons are explained for regulating the size of pearlite block grains, the size being used for regulating the number of the pearlite block grains, in the range from 1 to 15 μm.

A pearlite block having a grain size larger than 15 μm does not significantly contribute to improving the ductility of fine pearlite structures. On the other hand, though a pearlite block having a grain size smaller than 1 μm contributes to improving the ductility of fine pearlite structures, the contribution thereof is insignificant. For those reasons, the size of pearlite block grains, the size being used for regulating the number of the pearlite block grains, is regulated in the range from 1 to 15 μm.

Secondly, the reasons are explained for regulating the number of the pearlite block grains having grain sizes in the range from 1 to 15 μm to 200 or more per 0.2 $mm^2$ of observation field.

When the number of the pearlite block grains having grain sizes in the range from 1 to 15 μm is less than 200 per 0.2 $mm^2$ of observation field, it becomes impossible to improve the ductility of fine pearlite structures. No upper limit is particularly set forth with regard to the number of the pearlite block grains having grain sizes in the range from 1 to 15 μm, but, from restrictions on the rolling temperature during hot rolling and the cooling conditions during heat treatment in rail production, 1,000 grains per 0.2 $mm^2$ of observation field is the upper limit, substantially.

Thirdly, the reasons are explained for specifying that the region, in which the number of the pearlite block grains having grain sizes in the range from 1 to 15 μm is determined to be 200 or more per 0.2 $mm^2$ of observation field, is at least a part of the region down to a depth of 10 mm from the surface of the corners and top of a head portion.

The rail breakage that originates from a railhead portion begins, basically, from the surface of the head portion. For this reason, in order to prevent rail breakage, it is necessary to enhance the ductility of the surface layer of a railhead portion, namely, to increase the number of the pearlite block grains having grain sizes in the range from 1 to 15 μm. As a result of experimentally examining the correlation between the ductility of the surface layer of a railhead portion and the pearlite blocks in the surface layer thereof, it has been clarified that the ductility of the surface layer of a railhead portion correlates with the pearlite block size in the region down to a depth of 10 mm from the surface of the head top portion. In addition, as a result of further examining the correlation between the ductility of the surface layer of a railhead portion and the pearlite blocks in the surface layer thereof, it has been confirmed that the ductility of the surface layer of the railhead portion is improved and, consequently, the rail breakage is inhibited as long as a region where the number of the pearlite block grains having grain sizes in the range from 1 to 15 μm is 200 or more exists at least in a part of the aforementioned region. The above regulations are determined on the basis of the results from the aforementioned examinations.

Here, the method of measuring the size of pearlite block grains is described. Methods of measuring pearlite block grains include (i) the modified curling etch method, (ii) the etch pit method, and (iii) the electron back-scatter diffraction pattern (EBSP) method wherein an SEM is used. In the above examinations, since the size of the pearlite block grains was fine, it was difficult to confirm the size by the modified curling etch method (i) or the etch pit method (ii), and, therefore, the EBSP method (iii) was employed.

The conditions of the measurement are described hereafter. The measurement of the size of pearlite block grains followed the conditions and procedures described in the items (ii) to (vii) below, and the number of the pearlite block grains having grain sizes in the range from 1 to 15 μm per 0.2 $mm^2$ of observation field was counted. The measurement was done at least in two observation fields at each of observation positions, the number of the grains in each of the observation fields was counted according to the following procedures, and the average of the numbers of the grains in two or more observation fields was used as the value representing an observation position.

Pearlite block measurement conditions (i) SEM: a high-resolution scanning electron microscope (ii) Pre-treatment for measurement: polishing of a machined surface with diamond abrasive of 1 μm and then electrolytic polishing (iii) Observation field: 400 μm×500 μm (observation area, 0.2 $mm^2$)

(iv) SEM beam diameter: 30 nm (v) Measurement step (interval): 0.1 to 0.9 μm (vi) Identification of a grain boundary: when the difference in crystal orientations at two adjacent measurement points is 150 or more, then the grain boundary between the measurement points is identified as a pearlite block grain boundary (large angle grain boundary).

(vii) Grain size measurement: after measuring the area of each of pearlite block grains, the radius of each crystal grain is calculated assuming that the pearlite block grain is round, then the diameter is calculated from it, and the value thus obtained is used as the size of the pearlite block grain.

(2) Chemical Composition of a Steel Rail

The reasons are explained in detail for regulating the chemical composition of a steel rail in the ranges specified in the claims.

C is an element effective for accelerating pearlitic transformation and securing wear resistance. If the amount of C is 0.65% or less, then a sufficient hardness of pearlite structures in a railhead portion cannot be secured, in addition pro-eutectoid ferrite structures form, therefore wear resistance deteriorates, and, as a result, the service life of the rail is shortened. If the amount of C exceeds 1.40%, on the other hand, then pro-eutectoid cementite structures form in pearlite structures at the surface layer and the inside of a railhead and/or the density of cementite phases in the pearlite structures increases, and thus the ductility of the pearlite structures deteriorates. In addition, the number of intersecting pro-eutectoid cementite network (NC) in the web portion of a rail increases and the toughness of the web portion deteriorates. For those reasons, the amount of C is limited in the range from 0.65 to 1.40%. Note that, for enhancing wear resistance still more, it is desirable to set the amount of C to over 0.85% by which the density of cementite phases in pearlite structures can increase still more and thus wear resistance can further be enhanced.

Si is a component indispensable as a deoxidizing agent. Also, Si is an element that increases the hardness (strength) of a railhead portion by the solid solution hardening effect of Si in a ferrite phase in pearlite structures and, at the same time, improves the hardness and toughness of the rail by inhibiting the formation of pro-eutectoid cementite structures. However, if the content of Si is less than 0.05%, then these effects are not expected sufficiently, and no tangible improvement in hardness and toughness is obtained. If the content of Si exceeds 2.00%, on the other hand, then surface defects occur in a great deal during hot rolling and/or weldability deteriorates caused by the formation of oxides. Besides, in that case, pearlite structures themselves become brittle, thus not only the ductility of a rail deteriorates but also surface damage such as spalling occurs and, therefore, the service life of the rail shortens. For those reasons, the amount of Si is limited in the range from 0.05 to 2.00%.

Mn is an element that enhances hardenability, secures the hardness of pearlite structures by decreasing the pearlite lamella spacing, and thus improves wear resistance. However, if the content of Mn is less than 0.05%, then the effects are insignificant and it becomes difficult to secure the wear resistance required of a rail. If the content of Mn is more than 2.00%, on the other hand, then hardenability is increased remarkably, therefore martensite structures detrimental to wear resistance and toughness tend to form, and segregation is accelerated. What is more, in a high-carbon steel (C>0.85%) in particular, pro-eutectoid cementite structures form in the web and other portions, the number of intersecting pro-eutectoid cementite network (NC) increases in the web portion, and thus the toughness of a rail deteriorates. For those reasons, the amount of Mn is limited in the range from 0.05 to 2.00%.

Note that, for inhibiting the formation of pro-eutectoid cementite structures in the web portion of a rail, it is necessary to regulate the addition amounts of P and S. For that purpose, it is desirable to control their addition amounts within the respective ranges specified below for the following reasons.

P is an element that strengthens ferrite and enhances the hardness of pearlite structures. However, since P is an element that easily causes segregation, if the content of P exceeds 0.030%, it also accelerates the segregation of other elements and, as a result, the formation of pro-eutectoid cementite structures in a web portion is significantly accelerated. Consequently, the number of intersecting pro-eutectoid cementite network (NC) in the web portion of a rail increases and the toughness of the web portion deteriorates. For those reasons, the amount of P is limited to 0.030% or less.

S is an element that contributes to the acceleration of pearlitic transformation by generating MnS and forming Mn-depleted zone around the MnS and is effective for enhancing the toughness of pearlite structures by making the size of pearlite blocks fine as a result of the above contribution. However, if the content of S exceeds 0.025%, the segregation of Mn is accelerated and, as a result, the formation of pro-eutectoid cementite structures in a web portion is violently accelerated. Consequently, the number of intersecting pro-eutectoid cementite network (NC) in the web portion of a rail increases and the toughness of the web portion deteriorates. For those reasons, the amount of S is limited to 0.025% or less.

Further, the elements of Cr, Mo, V, Nb, B, Co, Cu, Ni, Ti, Mg, Ca, Al and Zr may be added, as required, to a steel rail having the chemical composition specified above for the purposes of: enhancing wear resistance by strengthening pearlite structures; preventing the deterioration of toughness by inhibiting the formation of pro-eutectoid cementite structures; preventing the softening and embrittlement of a weld heat-affected zone; improving the ductility and toughness of pearlite structures; strengthening pearlite structures; preventing the formation of pro-eutectoid cementite structures; and controlling the hardness distribution in the cross sections of the head portion and the inside of a rail.

Among those elements, Cr and Mo secure the hardness of pearlite structures by raising the equilibrium transformation temperature of pearlite and, in particular, by decreasing the pearlite lamella spacing. V and Nb inhibit the growth of austenite grains by forming carbides and nitrides during hot rolling and subsequent cooling and, in addition, improve the ductility and hardness of pearlite structures by precipitation hardening. Further, they stably form carbides and nitrides during reheating and thus prevent the heat-affected zones of weld joints from softening. B reduces the dependency of a pearlitic transformation temperature on a cooling rate and uniformalizes the hardness distribution in a railhead portion. Co and Cu dissolve in ferrite in pearlite structures and thus increase the hardness of the pearlite structures. Ni prevents embrittlement caused by the addition of Cu during hot rolling, increases the hardness of a pearlitic steel at the same time, and, in addition, prevents the heat-affected zones of weld joints from softening.

Ti makes the structure of a heat-affected zone fine and prevents the embrittlement of a weld joint. Mg and Ca make austenite grains fine during the rolling of a rail, accelerate pearlitic transformation at the same time, and improve the ductility of pearlite structures. Al strengthens pearlite structures and suppresses the formation of pro-eutectoid cementite structure by shifting a eutectoid transformation temperature toward a higher temperature and, at the same time, a eutectoid carbon concentration toward a higher carbon, and thus enhances the wear resistance of a rail and prevents the toughness thereof from deteriorating. Zr forms $ZrO_2$ inclusions, which serve as solidification nuclei in a high-carbon steel rail, and thus increases an equi-axed crystal grain ratio in a solidification structure. As a result, it suppresses the formation of segregation bands at the center portion of a casting and the formation of pro-eutectoid cementite structures detrimental to the toughness of a rail. The main object of N addition is to enhance toughness by accelerating pearlitic transformation originating from austenite grain boundaries and making pearlite structures fine.

The reasons for regulating each of the aforementioned chemical compositions are hereunder explained in detail.

Cr is an element that contributes to the hardening (strengthening) of pearlite structures by raising the equilibrium transformation temperature of pearlite and consequently making the pearlite structures fine, and, at the same time, enhances the hardness (strength) of the pearlite structures by strengthening cementite phases. If the content of Cr is less than 0.05%, however, the effects are insignificant and the effect of enhancing the hardness of a steel rail does not show. If Cr is excessively added in excess of 2.00%, on the other hand, then hardenability increases, martensite structures form in a great amount, and the toughness of a rail deteriorates. In addition, segregation is accelerated, the amount of pro-eutectoid cementite structures forming in a web portion increases, consequently the number of intersecting pro-eutectoid cementite network (NC) increases, and therefore the toughness of the web portion of a rail deteriorates. For those reasons, the amount of Cr is limited in the range from 0.05 to 2.00%.

Mo, like Cr, is an element that contributes to the hardening (strengthening) of pearlite structures by raising the equilibrium transformation temperature of pearlite and consequently narrowing the space between adjacent pearlite lamellae and enhances the hardness (strength) of pearlite structures as a result. If the content of Mo is less than 0.01%, however, the effects are insignificant and the effect of enhancing the hardness of a steel rail does not show at all. If Mo is excessively added in excess of 0.50%, on the other hand, then the transformation rate of pearlite structures is lowered significantly, and martensite structures detrimental to toughness are likely to form. For those reasons, the addition amount of Mo is limited in the range from 0.01 to 0.50%.

V is an element effective for: making austenite grains fine by the pinning effect of v carbides and v nitrides when heat treatment for heating a steel material to a high temperature is applied; further enhancing the hardness (strength) of pearlite structures by the precipitation hardening of V carbides and V nitrides that form during cooling after hot rolling; and, at the same time, improving ductility. V is also an element effective for preventing the heat-affected zone of a weld joint from softening by forming v carbides and v nitrides in a comparatively high temperature range at a heat-affected zone reheated to a temperature in the range of not higher than the $Ac_1$ transformation temperature. If the content of V is less than 0.005%, however, the effects are not expected sufficiently and the enhancement of the hardness of pearlite structures and the improvement of the ductility thereof are not realized. If V is added in excess of 0.500%, on the other hand, then coarse V carbides and v nitrides form, and the toughness and the resistance to internal fatigue damage of a rail deteriorate. For those reasons, the amount of V is limited in the range from 0.005 to 0.500%.

Nb, like V, is an element effective for: making austenite grains fine by the pinning effect of Nb carbides and Nb nitrides when heat treatment for heating a steel material to a high temperature is applied; further enhancing the hardness (strength) of pearlite structures by the precipitation hardening of Nb carbides and Nb nitrides that form during cooling after hot rolling; and, at the same time, improving ductility. Nb is also an element effective for preventing the heat-affected zone of a welded joint from softening by forming Nb carbides and Nb nitrides stably in the temperature range from a low temperature to a high temperature at a heat-affected zone reheated to a temperature in the range of not higher than the $Ac_1$ transformation temperature. If the content of Nb is less than 0.002%, however, the effects are not expected and the enhancement of the hardness of pearlite structures and the improvement of the ductility thereof are not realized. If Nb is added in excess of 0.050%, on the other hand, then coarse Nb carbides and Nb nitrides form, and the toughness and the resistance to internal fatigue damage of a rail deteriorate. For those reasons, the amount of Nb is limited in the range from 0.002 to 0.050%.

B is an element that suppresses the formation of pro-eutectoid cementite by forming carbo-borides of iron, uniformalizes the hardness distribution in a head portion at the same time by lowering the dependency of a pearlitic transformation temperature on a cooling rate, prevents the deterioration of the toughness of a rail, and extends the service life of the rail as a result. If the content of B is less than 0.0001%, however, the effects are insufficient and no improvement in the hardness distribution in a railhead portion is realized. If B is added in excess of 0.0050%, on the other hand, then coarse carboborides of iron form, and ductility, toughness and resistance to internal fatigue damage are significantly deteriorated. For those reasons, the amount of B is limited in the range from 0.0001 to 0.0050%.

Co is an element that dissolves in ferrite in pearlite structures and enhances the hardness (strength) of the pearlite structures by solid solution strengthening. Co is also an element that improves ductility by increasing the transformation energy of pearlite and making pearlite structures fine. If the content of Co is less than 0.10%, however, the effects are not expected. If Co is added in excess of 2.00%, on the other hand, then the ductility of ferrite phases deteriorates significantly, spalling damage occurs at a wheel rolling surface, and resistance to the surface damage of a rail deteriorates. For those reasons, the amount of Co is limited in the range from 0.10 to 2.00%.

Cu is an element that dissolves in ferrite in pearlite structures and enhances the hardness (strength) of the pearlite structures by solid solution strengthening. If the content of Cu is less than 0.05%, however, the effects are not expected. If Cu is added in excess of 1.00%, on the other hand, then hardenability is enhanced remarkably and, as a result, martensite structures detrimental to toughness are likely to form. In addition, in that case, the ductility of ferrite phases is significantly lowered and therefore the ductility of a rail deteriorates. For those reasons, the amount of Cu is limited in the range from 0.05 to 1.00%.

Ni is an element that prevents embrittlement caused by the addition of Cu during hot rolling and, at the same time, hardens (strengthens) a pearlitic steel through solid solution strengthening by dissolving in ferrite. In addition, Ni is an element that, at a weld heat-affected zone, precipitates as the fine grains of the intermetallic compounds of $Ni_3Ti$ in combination with Ti and inhibits the softening of the weld heat-affected zone by precipitation strengthening. If the content of Ni is less than 0.01%, however, the effects are very small. If Ni is added in excess of 1.00%, on the other hand, the ductility of ferrite phases is lowered significantly, spalling damage occurs at a wheel rolling surface, and resistance to the surface damage of a rail deteriorates. For those reasons, the amount of Ni is limited in the range from 0.01 to 1.00%.

Ti is an element effective for preventing the embrittlement of the heat-affected zone of a weld joint by taking advantage of the fact that carbides and nitrides of Ti having precipitated during the reheating of the weld joint do not dissolve again and thus making fine the structure of the heat-affected zone heated to a temperature in the austenite temperature range. If the content of Ti is less than 0.0050%, however, the effects are insignificant. If Ti is added in excess of 0.0500%, on the other hand, then coarse carbides and nitrides of Ti form and the ductility, toughness and resistance to internal fatigue damage of a rail deteriorate significantly. For those reasons, the amount of Ti is limited in the range from 0.0050 to 0.0500%.

Mg is an element effective for improving the ductility of pearlite structures by forming fine oxides in combination with O, S, Al and so on, suppressing the growth of crystal grains during reheating for the rolling of a rail, and thus making austenite grains fine. In addition, MgO and MgS make MnS disperse in fine grains, thus form Mn-depleted zone around the MnS, and contribute to the progress of pearlitic transformation. Therefore, Mg is an element effective for improving the ductility of pearlite structures by making a pearlite block size fine. If the content of Mg is less than 0.0005%, however, the effects are insignificant. If Mg is added in excess of 0.0200%, on the other hand, then coarse oxides of Mg form and the toughness and resistance to internal fatigue damage of a rail deteriorate. For those reasons, the amount of Mg is limited in the range from 0.0005 to 0.0200%.

Ca has a strong bonding power with S and forms sulfides in the form of CaS. Further, CaS makes MnS disperse in fine grains and thus forms Mn-depleted zone around the MnS. Therefore, Ca contributes to the progress of pearlitic transformation and, as a result, is an element effective for improving the ductility of pearlite structures by making a pearlite block size fine. If the content of Ca is less than 0.0005%, however, the effects are insignificant. If Ca is added in excess of 0.0150%, on the other hand, then coarse oxides of Ca form and the toughness and resistance to internal fatigue damage of a rail deteriorate. For those reasons, the amount of Ca is limited in the range from 0.0005 to 0.0150%.

Al is an element that shifts a eutectoid transformation temperature toward a higher temperature and, at the same time, a eutectoid carbon concentration toward a higher carbon. Thus, Al is an element that strengthens pearlite structures and prevents the deterioration of toughness, by inhibiting the formation of pro-eutectoid cementite structures. If the content of Al is less than 0.0080%, however, the effects are insignificant. If Al is added in excess of 1.00%, on the other hand, it becomes difficult to make Al dissolve in a steel, thus coarse alumina inclusion serving as the origins of fatigue damage form, and consequently the toughness and resistance to internal fatigue damage of a rail deteriorate. In addition, in that case, oxides form during welding and weldability is remarkably deteriorated. For those reasons, the amount of Al is limited in the range from 0.0080 to 1.00%.

Zr is an element that functions as the solidification nuclei in a high-carbon steel rail in which γ-Fe is the primary crystal of solidification, because $ZrO_2$ inclusions have good lattice coherent with γ-Fe, thus increases an equi-axed crystal ratio in a solidification structure, by so doing, inhibits the formation of segregation bands at the center portion of a casting, and suppresses the formation of pro-eutectoid cementite structures detrimental to the toughness of a rail. If the amount of Zr is less than 0.0001%, however, then the number of $ZrO_2$ inclusions is so small that their function as the solidification nuclei does not bear a tangible effect, and, as a consequence, the effect of suppressing the formation of pro-eutectoid cementite structures is reduced. If the amount of Zr exceeds 0.2000%, on the other hand, then coarse Zr inclusions form in a great amount, thus the toughness of a rail deteriorates, internal fatigue damage originating from coarse Zr system inclusions is likely to occur, and, as a result, the service life of the rail shortens. For those reasons, the amount of Zr is limited in the range from 0.0001 to 0.2000%.

N accelerates the pearlitic transformation originating from austenite grain boundaries by segregating at the austenite grain boundaries, and thus makes the pearlite block size fine. Therefore, N is an element effective for enhancing the toughness and ductility of pearlite structures. If the content of N is less than 0.0040%, however, the effects are insignificant. If N is added in excess of 0.0200%, on the other hand, it becomes difficult to make N dissolve in a steel and gas holes functioning as the origins of fatigue damage form in the inside of a rail. For those reasons, the amount of N is limited in the range from 0.0040 to 0.0200%.

A steel rail that has such chemical composition as described above is melted and refined in a commonly used melting furnace such as a converter or an electric arc furnace, then resulting molten steel is processed through ingot casting and breakdown rolling or continuous casting, and thereafter the resulting casting is produced into rails through hot rolling. Subsequently, accelerated cooling is applied to the head portion of a hot-rolled rail maintaining the high temperature heat at the hot rolling or being reheated to a high temperature for the purpose of heat treatment, and, by so doing, pearlite structures having a high hardness can be stably formed in the railhead portion.

As a method for controlling the number of the pearlite blocks having grain sizes in the range from 1 to 15 μm so as to be 200 or more per 0.2 $mm^2$ of observation field at least in a part of the region down to a depth of 10 mm from the surface of the corners and top of a railhead portion in the above production processes, a method desirable satisfies the conditions of: setting the temperature during hot rolling as low as possible; applying accelerated cooling as quickly as possible after the rolling; by so doing, suppressing the growth of austenite grains immediately after rolling; and raising an area reduction ratio at the final rolling so that the accelerated cooling may be applied while high strain energy is accumulated in the austenite grains. Desirable hot rolling and heat treatment conditions are as follows: a final rolling temperature is 980° C. or lower; an area reduction ratio at the final rolling is 6% or more; and an accelerated cooling rate is 1° C./sec. or more in average of range from the austenite temperature range to 550° C.

Further, in the case where a rail is reheated for the purpose of heat treatment, as it is impossible to make use of the effect of strain energy, it is desirable to set a reheating temperature as low as possible and an accelerated cooling rate as high as possible. Desirable conditions of heat treatment for reheating are as follows: a reheating temperature is 1,000° C. or lower; and an accelerated cooling rate is 5° C./sec. or more in average of range from the austenite temperature range to 550° C.

(3) Hardness of a Railhead Portion and the Range of the Hardness

Here, the reasons are explained for regulating the hardness in the region down to a depth of 20 mm from the surface of the corners and top of a railhead portion so as to be in the range from 300 to 500 Hv.

In a steel having chemical composition according to the present invention, if hardness is below 300 Hv, then it becomes difficult to secure a good wear resistance and the service life of a rail shortens. If hardness exceeds 500 Hv, on the other hand, resistance to surface damage is significantly deteriorated as a result of: the accumulation of fatigue damage at a wheel rolling surface caused by an extravagant improve in wear resistance; and/or the occurrence of rolling fatigue damage such as dark spot damage caused by the development of a crystallographic texture. For those reasons, the hardness of pearlite structures is limited in the range from 300 to 500 in Hv.

Next, the reasons are explained for regulating the portion, where the hardness is regulated in the range from 300 to 500 Hv, so as to be in the region down to a depth of 20 mm from the surface of the corners and top of a head portion.

If the depth of the portion where the hardness is regulated in the range from 300 to 500 Hv is less than 20 mm, then, in consideration of the service life of a rail, the depth of the portion where the wear resistance required of a rail must be secured is insufficient and it becomes difficult to secure a sufficiently long service life of the rail. If the portion where the hardness is regulated in the range from 300 to 500 Hv extends down to a depth of 30 mm or more from the surface of the corners and top of a head portion, the rail service life is further extended, which is more desirable.

In relation to the above, FIG. 1 shows the denominations of different portions of a rail, wherein: the reference numeral 1 indicates the head top portion, the reference numeral 2 the head side portions (corners) at the right and left sides of the rail, the reference numeral 3 the lower chin portions at the right and left sides of the rail, and the reference numeral 4 the head inner portion, which is located in the vicinity of the position at a depth of 30 mm from the surface of the head top portion in the center of the width of the rail.

Figure 3:
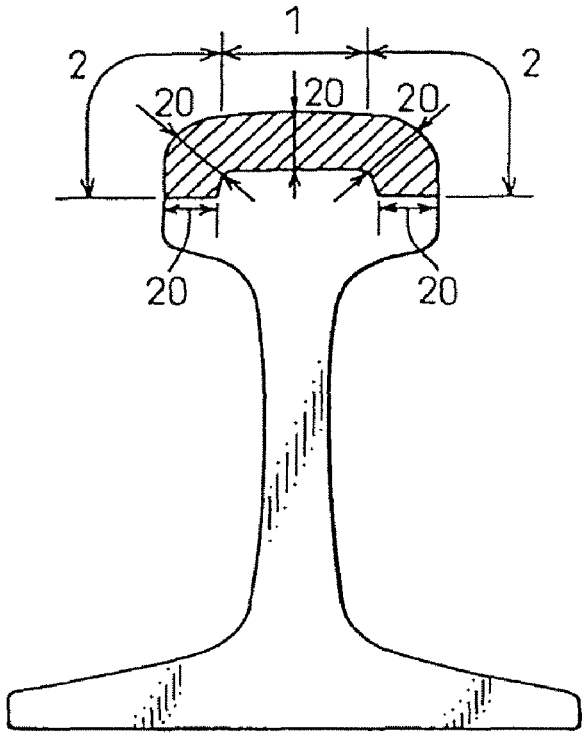
FIG. 3 is an illustration showing, in a section, the denominations of different positions on the surface of the head portion of a pearlitic steel rail excellent in wear resistance and ductility according to the present invention and the region where wear resistance is required.

FIG. 3 shows the denominations of different positions of the surface of a head portion and the region where the pearlite structures having the hardness of 300 to 500 Hv are required in a cross section of the head portion of a pearlitic steel rail excellent in wear resistance and ductility according to the present invention. In the railhead portion, the reference numeral 1 indicates the head top portion and the reference numeral 2 the head corner portions, one of the two head corner portions 2 being the gauge corner (G.C.) portion that mainly contacts with wheels. The wear resistance of a rail can be secured as long as the pearlite structures having chemical composition according to the present invention and having the hardness of 300 to 500 Hv are formed at least in the region shaded with oblique lines in the figure.

Therefore, it is desirable that pearlite structures having hardness controlled within the above range are located in the vicinity of the surface of a railhead portion that mainly contacts with wheels, and the other portions may consist of any metallographic structures other than a pearlite structure.

Next, the present inventors quantified the amount of pro-eutectoid cementite structures forming in the web portion of a rail. As a result of measuring the number of the pro-eutectoid cementite network intersecting two line segments of a prescribed length crossing each other at right angles (hereinafter referred to as the number of intersecting pro-eutectoid cementite network, NC) in an observation field under a prescribed magnification, a good correlation has been found between the number of intersecting pro-eutectoid cementite network and the state of cementite structure formation, and it has been clarified that the state of pro-eutectoid cementite structure formation can be quantified on the basis of the correlation.

Subsequently, the present inventors investigated the relationship between the toughness of a web portion and the state of pro-eutectoid cementite structure formation using steel rails of pearlite structures having a high carbon content. As a result, it has been clarified that, in a steel rail of pearlite structures having a high carbon content: (i) the toughness of the web portion of the rail is in negative correlation with the number of intersecting pro-eutectoid cementite network (NC); (ii) if the number of intersecting pro-eutectoid cementite network (NC) is not more than a certain value, then the toughness of the web portion does not deteriorate; and (iii) the threshold value of the number of intersecting pro-eutectoid cementite network (NC) beyond which the toughness deteriorates correlates with the chemical compositions of the steel rail.

On the basis of the above findings, the present inventors tried to clarify the relationship between the threshold value of the number of intersecting pro-eutectoid cementite network (NC) beyond which the toughness of the web portion of a rail deteriorated, and the chemical compositions of the steel rail, by using multiple correlation analysis. As a result, it has been found that the threshold value of the number of intersecting pro-eutectoid cementite network (NC) beyond which the toughness of a web portion decreases can be defined by the value (CE) calculated from the following equation (1) that evaluates the contributions of chemical compositions (in mass %) in a steel rail.

Further, the present inventors studied a means for improving the toughness of the web portion of a rail. As a result, it has been found that the amount of pro-eutectoid cementite structures forming in the web portion of a rail is reduced to a level lower than that of a presently used steel rail and the toughness of the web portion of the rail is prevented from deteriorating by controlling the number of intersecting pro-eutectoid cementite network (NC) in the web portion of the rail so as to be not more than the value of CE calculated from the chemical composition of the rail:

$$CE=60[\text{mass \% C}]-10[\text{mass \% Si}]+10[\text{mass \% Mn}]+500[\text{mass \% P}]+50[\text{mass \% S}]+30[\text{mass \% Cr}]-54 \quad (1),$$

NC (number of intersecting pro-eutectoid cementite network in a web portion)≦CE (value of the equation (1)).

Note that, in the present invention, in order to reduce the number of intersecting pro-eutectoid cementite network (NC) at the center of the centerline in the web portion of a rail, it is effective: with regard to continuous casting, (i) to optimize the soft reduction by a means such as the control of a casting speed and (ii) to make a solidification structure fine by lowering the temperature of casting; and, with regard to the heat treatment of a rail, (iii) to apply accelerated cooling to the web portion of a rail in addition to the head portion thereof. In order to reduce the number of intersecting pro-eutectoid cementite network (NC) still further, it is effective: to combine the above measures in continuous casting and heat treatment; to add Al, which has an effect of suppressing the formation of pro-eutectoid cementite structures; and/or to add Zr, which makes a solidification structure fine.

(4) Method for Exposing Pro-Eutectoid Cementite Structures in the Web Portion of a Rail The method for exposing pro-eutectoid cementite structures is explained hereunder. Firstly, a cross-sectional surface of the web portion of a rail is polished with diamond abrasive, subsequently, the polished surface is immersed in a solution of picric acid and caustic soda, and thus pro-eutectoid cementite structures are exposed. Some adjustments may be required of the exposing conditions in accordance with the condition of a polished surface, but, basically, desirable exposing conditions are: an immersion solution temperature is 80° C.; and an immersion time is approximately 120 min.

(5) Method for Measuring the Number of Intersecting Pro-Eutectoid Cementite Network (NC)

Figure 2:
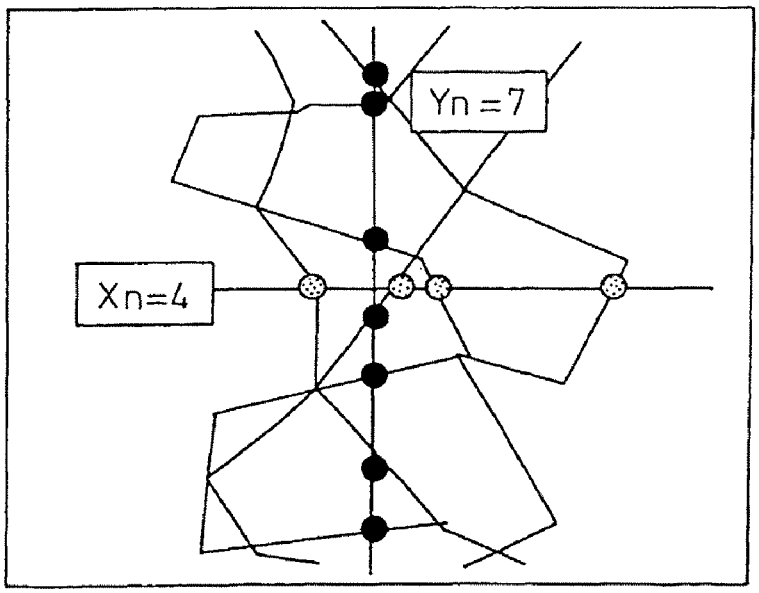
FIG. 2 is a schematic representation of the method of evaluating the formation of pro-eutectoid cementite network.

Next, the method for measuring the number of intersecting pro-eutectoid cementite network (NC) is explained. Pro-eutectoid cementite is likely to form at the boundaries of prior austenite crystal grains. The portion where pro-eutectoid cementite structures are exposed at the center of the centerline on a sectional surface of the web portion of a rail is observed with an optical microscope. Then, the number of intersections (expressed in the round marks in FIG. 2) of pro-eutectoid cementite network with two line segments each 300 μm in length crossing each other at right angles is counted under a magnification of 200. FIG. 2 schematically shows the measurement method. The number of the intersecting pro-eutectoid cementite network is defined as the total of the intersections on the two line segments X and Y each 300 μm in length crossing each other at right angles, namely, [Xn=4]+[Yn=7]. Note that, in consideration of uneven distribution of pro-eutectoid cementite structures caused by the variation of the intensity of segregation, it is desirable to carry out the counting, at least, at 5 or more observation fields and use the average of the counts as the representative figure of the specimen.

(6) Equation for Calculating the Value of CE

Here, the reason is explained for defining the equation for calculating the value of CE as described earlier. The equation for calculating the value of CE has been obtained, using steel rails of pearlite structures having a high carbon content, by taking the procedures of: investigating the relationship between the toughness of a web portion and the state of pro-eutectoid cementite structure formation; and then clarifying the relationship between the threshold value of the number of intersecting pro-eutectoid cementite network (NC) beyond which the toughness of the web portion deteriorates and the chemical composition (in mass %) of the steel rail by using multiple correlation analysis. The resulting correlation equation (1) is shown below:

$$CE=60[\text{mass \% C}]-10[\text{mass \% Si}]+10[\text{mass \% Mn}]+500[\text{mass \% P}]+50[\text{mass \% S}]+30[\text{mass \% Cr}]-54 \quad (1).$$

The coefficient affixed to the content of each of the constituent chemical composition represents the contribution of the relevant component to the formation of cementite structures in the web portion of a rail, and the sign + means that the relevant component has a positive correlation with the formation of cementite structures, and the sign − a negative correlation. The absolute value of each of the coefficients represents the magnitude of the contribution. A value of CE is defined as an integer of the value calculated from the equation above, round up numbers of five and above and drop anything under five. Note that, in some combinations of the chemical composition specified in the above equation, the value of CE may be 0 or negative. Such a case that the value of CE is 0 or negative is regarded as outside of the scope of the present invention, even if the contents of the chemical composition conform to the relevant ranges specified earlier.

In addition, the present inventors examined the causes for generating cracks in a bloom (slab) having a high carbon content in the processes of reheating and hot rolling the casting into rails. As a result, it has been clarified that: some parts of a casting are melted at segregated portions in solidification structures in the vicinity of the outer surface of the casting where the heating temperature of the casting is the highest; the melted parts burst by the subsequent rolling; and thus cracks are generated. It has also been clarified that, the higher the maximum heating temperature of a casting is or the higher the carbon content of a casting is, the more the cracks tend to be generated.

On the basis of the above findings, the present inventors experimentally studied the relationship between the maximum heating temperature of a casting at which melted parts that caused cracks were generated and the carbon content in the casting. As a result, it has been found that the maximum heating temperature of a casting at which the melted parts are generated can be regulated by a quadratic expression which is shown as the following equation (2) composed of the carbon content (in mass %) of the casting, and that the melted parts of a casting in a reheated state and accompanying cracks or breaks during hot rolling can be prevented by controlling the maximum heating temperature (Tmax, ° C.) of the casting to not more than the value of CT calculated from the quadratic equation:

$$CT=1500-140([\text{mass \% C}])-80([\text{mass \% C}])^2 \quad (2).$$

Next, the present inventors analyzed the factors that accelerated the decarburization in the outer surface layer of the bloom (slab) having a high carbon content in a reheating process for hot rolling the bloom (slab) into rails. As a result, it has been clarified that the decarburization in the outer surface layer of the bloom (slab) is significantly influenced by a temperature and a retention time in the reheating of the casting and moreover the carbon content in the bloom (slab).

On the basis of the above findings, the present inventors studied the relationship among a temperature and a retention time in the reheating of the bloom (slab), a carbon content in the bloom (slab), and the amount of decarburization in the outer surface layer of the bloom (slab). As a result, it has been found that, the longer the retention time at a temperature not lower than a certain temperature is and the higher the carbon content in the bloom (slab) is, the more the decarburization in the outer surface layer of the bloom (slab) is accelerated.

In addition, the present inventors experimentally studied the relationship between the carbon content in the bloom (slab) and a retention time in the reheating of the bloom (slab) that does not cause the deterioration of the properties of a rail after final rolling. As a result, it has been found that, when a reheating temperature is 1,100° C. or higher, the retention time of the bloom (slab) can be regulated by a quadratic expression which is shown as the following equation (3) composed of the carbon content (in mass %) of the bloom (slab), and that the decrease of the carbon content and the deterioration of hardness in pearlite structures in the outer surface layer of the bloom (slab) can be suppressed and also the deterioration of the wear resistance and the fatigue strength of a rail after final rolling can be suppressed by controlling the reheating time of the bloom (slab) (Mmax, min.) to not more than the value of CM calculated from the quadratic equation:

$$CM=600-120([\text{mass \% C}])-60([\text{mass \% C}])^2 \quad (3).$$

As stated above, the present inventors have found that, by optimizing the maximum heating temperature of the bloom (slab) having a high carbon content and the retention time thereof at a heating temperature not lower than a certain temperature in a reheating process for hot rolling the bloom (slab) into rails: the partial melting of the bloom (slab) is prevented and thus cracks and breaks are prevented during hot rolling; further the decarburization in the outer surface layer of a rail is inhibited and thus the deterioration of wear resistance and fatigue strength is suppressed; and, as a consequence, a high quality rail can be produced efficiently.

In other words, the present invention makes it possible to efficiently produce a high quality rail by preventing the partial melting of the bloom (slab) having a high carbon content and suppressing the decarburization in the outer surface layer of the bloom (slab) in a reheating process for hot rolling the bloom (slab) into rails. The conditions specified in the present invention are explained hereunder.

(7) Reasons for Limiting the Maximum Heating Temperature (Tmax, ° C.) of a Bloom (Slab) in a Reheating Process for Hot Rolling Here, the reasons are explained in detail for limiting the maximum heating temperature (Tmax, ° C.) of a bloom (slab) to not more than the value of CT calculated from the carbon content of a steel rail in a reheating process for hot rolling the bloom (slab) into rails.

The present inventors experimentally investigated the factors that caused partial melting to occur in a bloom (slab) having a high carbon content in a reheating process for hot rolling the bloom (slab) into rails and thus cracks to be generated in the bloom (slab) during hot rolling. As a result, it has been confirmed that, the higher the maximum heating temperature of a bloom (slab) is and the higher the carbon content thereof is, partial melting is apt to occur in the bloom (slab) during reheating and cracks are apt to be generated during hot rolling.

On the basis of the findings, the present inventors tried to find the relationship between the carbon content of a bloom (slab) and the maximum heating temperature thereof beyond which partial melting occurred in the bloom (slab) by using multiple correlation analysis. The resulting correlation equation (2) is shown below:

$$CT=1500-140([\text{mass \% C}])-80([\text{mass \% C}])^2 \quad (2).$$

As stated above, the equation (2) is an experimental regression equation, and partial melting in a bloom (slab) during reheating and accompanying cracks and breaks during rolling can be prevented by controlling the maximum heating temperature (Tmax, ° C.) of the bloom (slab) to not more than the value of CT calculated from the quadratic equation composed of the carbon content of the bloom (slab).

(8) Reasons for Limiting the Retention Time (Mmax, min.) of a Bloom (Slab) in a Reheating Process for Hot Rolling Here, the reasons are explained in detail for limiting the retention time (Mmax, min.) of a bloom (slab) heated to a temperature of 1,100° C. or higher in a reheating process for hot rolling the bloom (slab) into rails to not more than the value of CM calculated from the carbon content of a steel rail.

The present inventors experimentally investigated the factors that increased the amount of decarburization in the outer surface layer of a bloom (slab) having a high carbon content in a reheating process for hot rolling the bloom (slab) into rails. As a result, it has been clarified that, the longer the retention time at a temperature not lower than a certain temperature is and the higher the carbon content in a bloom (slab) is, the more the decarburization is accelerated during reheating.

On the basis of the findings, the present inventors tried to find out the relationship, in the reheating temperature range of 1,100° C. or higher where the decarburization of a casting was significant, between the carbon content of a bloom (slab) and the retention time of the bloom (slab) beyond which the properties of a rail after final rolling deteriorated by using multiple correlation analysis. The resulting correlation equation (3) is shown below:

$$CM=600-120([\text{mass \% C}])-60([\text{mass \% C}])^2 \quad (3).$$

As stated above, the equation (3) is an experimental regression equation, and the decrease in the carbon content and the hardness of pearlite structures in the outer surface layer of a bloom (slab) is inhibited and thus the deterioration of the wear resistance and the fatigue strength of a rail after final rolling is suppressed by controlling the retention time (Mmax, min.) of the bloom (slab) in the reheating temperature range of 1,100° C. or higher to not more than the value of CM calculated from the quadratic equation.

Note that no lower limit is particularly specified for a retention time (Mmax, min.) in the reheating of a bloom (slab), but it is desirable to control a retention time to 250 min. or longer from the viewpoint of heating a casting sufficiently and uniformly and securing formability at the time of the rolling of a rail.

With regard to the control of the temperature and the time of reheating as specified above in a reheating process for hot rolling a bloom (slab) into rails, it is desirable to directly measure a temperature at the outer surface of a bloom (slab) and to control the temperature thus obtained and the time. However, when the measurement is difficult industrially, by controlling the average temperature of the atmosphere in a reheating furnace and the resident time in the furnace in a prescribed temperature range of the furnace atmosphere too, similar effects can be obtained and a high-quality rail can be produced efficiently.

Next, the present inventors studied a heat treatment method capable of, in a steel rail having a high carbon content, enhancing the hardness of pearlite structures in the railhead portion and suppressing the formation of pro-eutectoid cementite structures in the web and base portions thereof. As a result, it has been confirmed that, with regard to a rail after hot rolling, it is possible to enhance the hardness of the railhead portion and suppress the formation of pro-eutectoid cementite structures in the web and base portions thereof by applying accelerated cooling to the head portion and also another accelerated cooling to the web and base portions either from the austenite temperature range within a prescribed time after rolling or after the rail is heated again to a certain temperature.

As the first step of the above studies, the present inventors studied a method for hardening pearlite structures in a railhead portion in commercial rail production. As a result, it has been found that: the hardness of pearlite structures in a railhead portion correlates with the time period from the end of hot rolling to the beginning of the subsequent accelerated cooling and the rate of the accelerated cooling; and it is possible to form pearlite structures in a railhead portion and harden the portion by controlling the time period after the end of hot rolling and the rate of subsequent accelerated cooling within respective prescribed ranges and further by controlling the temperature at the end of the accelerated cooling to not lower than a prescribed temperature.

As the second step, the present inventors studied a method that makes it possible to suppress the formation of pro-eutectoid cementite structures in the web and base portions of a rail in commercial rail production. As a result, it has been found that: the formation of pro-eutectoid cementite structures correlates with the time period from the end of hot rolling to the beginning of the subsequent accelerated cooling and the conditions of the accelerated cooling; and it is possible to suppress the formation of pro-eutectoid cementite structures by controlling the time period after the end of hot rolling within a prescribed range and further by either (i) controlling the accelerated cooling rate within a prescribed range and the accelerated cooling end temperature to not lower than a prescribed temperature, or (ii) applying heating up to a temperature within a prescribed temperature range and thereafter controlling the accelerated cooling rate within a prescribed range.

In addition to the above production methods, the present inventors studied a rail production method for securing the uniformity of the material quality of a rail in the longitudinal direction in the above production methods. As a result, it has been clarified that, when the length of a rail at hot rolling exceeds a certain length: the temperature difference between the two ends of the rail and the middle portion thereof and moreover between the ends of the rail after the rolling is excessive; and, by the above-mentioned rail production method, it is difficult to control the temperature and the cooling rate over the whole length of the rail and thus the material quality of the rail in the longitudinal direction becomes uneven. Then, the present inventors studied an optimum rolling length of a rail for securing the uniformity of the material quality of the rail through the test rolling of real rails. As a result, it has been found that a certain adequate range exists in the rolling length of a rail in consideration of economical efficiency.

In addition, the present inventors studied a rail production method for securing the ductility of a railhead portion. As a result, it has been found that: the ductility of a railhead portion correlates with the temperature and the area reduction ratio of hot rolling, the time period between rolling passes and the time period from the end of final rolling to the beginning of heat treatment; and it is possible to secure both the ductility of a railhead portion and the formability of a rail at the same time by controlling the temperature of the railhead portion at final rolling, the area reduction ratio, the time period between rolling passes and the time period to the beginning of heat treatment within respective prescribed ranges.

As stated above, in the present invention, it has been found that, with regard to a steel rail having a high carbon content: it is possible to harden the railhead portion and thus secure the wear resistance of the railhead portion and to suppress the formation of pro-eutectoid cementite structures at the web and base portions of the rail, the structures being detrimental to the fatigue cracking and brittle fracture, by applying accelerated cooling to the head, web and base portions of the rail within a prescribed time period after the end of hot rolling and, in addition, by applying another accelerated cooling to the web and base toe portions of the rail after the rail is heated; and further it is possible to secure the wear resistance of the railhead portion, the uniformity of the material quality of the rail in the longitudinal direction, the ductility of the railhead portion, and the fatigue strength and fracture toughness of the web and base portions of the rail by optimizing the length of the rail at rolling, the temperature of the railhead portion at final rolling, the area reduction ratio, the time period between rolling passes, and the time period from the end of rolling to the beginning of heat treatment.

In other words, the present invention makes it possible to, in a steel rail having a high carbon content: make the size of pearlite blocks fine; secure the ductility of the railhead portion; prevent the deterioration of the wear resistance of the railhead portion and the fatigue strength and fracture toughness of the web and base portions of the rail; and secure the uniformity of the material quality of the rail in the longitudinal direction.

(9) Reasons for Limiting the Conditions of Accelerated Cooling

Here, the reasons are explained in detail for limiting the time period from the end of hot rolling to the beginning of accelerated cooling, and the rate and the temperature range of accelerated cooling.

In the first place, explanations are given regarding the time period from the end of hot rolling to the beginning of accelerated cooling.

When the time period from the end of hot rolling to the beginning of accelerated cooling exceeds 200 sec., with the chemical composition according to the present invention, austenite grains coarsen after rolling, as a consequence pearlite blocks coarsen, and ductility is not improved sufficiently, and, with some chemical composition according to the present invention, pro-eutectoid cementite structures form and the fatigue strength and toughness of a rail deteriorate. For those reasons, the time period from the end of hot rolling to the beginning of accelerated cooling is limited to not longer than 200 sec. Note that, even if the time period exceeds 200 sec., the material quality of a rail is not significantly deteriorated except for ductility. Therefore, as far as the time period is not longer than 250 sec., a rail quality acceptable for actual use can be secured.

Meanwhile, in a section of a rail immediately after the end of hot rolling, an uneven temperature distribution exists caused by heat removal by rolling rolls during rolling and so on, and, as a result, material quality in the rail section becomes uneven after accelerated cooling. In order to suppress temperature unevenness in a rail section and uniformalize material quality in the rail section, it is desirable to begin accelerated cooling after the lapse of not less than 5 sec. from the end of the rolling.

Next, explanations are given regarding the range of an accelerated cooling rate.

First, the conditions of accelerated cooling at a railhead portion are explained. When the accelerated cooling rate of a railhead portion is below 1° C./sec., with the chemical composition according to the present invention, the railhead portion cannot be hardened and it becomes difficult to secure the wear resistance of the railhead portion. In addition, pro-eutectoid cementite structures form and the ductility of the rail deteriorates. What is more, the pearlitic transformation temperature rises, pearlite blocks coarsen, and the ductility of the rail deteriorates. When an accelerated cooling rate exceeds 30° C./sec., on the other hand, with the chemical composition according to the present invention, martensite structures form and the toughness of a railhead portion deteriorates significantly. For those reasons, the accelerated cooling rate of a railhead portion is limited in the range from 1 to 30° C./sec.

Note that the accelerated cooling rate mentioned above is not a cooling rate during cooling but an average cooling rate from the beginning to the end of accelerated cooling. Therefore, as far as an average cooling rate from the beginning to the end of accelerated cooling is within the range specified above, it is possible to make a pearlite block size fine and simultaneously harden a railhead portion.

Next, explanations are given regarding the temperature range of accelerated cooling. When accelerated cooling at a railhead portion is finished at a temperature above 550° C., an excessive thermal recuperation takes place from the inside of a rail after the end of the accelerated cooling. As a result, the pearlitic transformation temperature is pushed up by the temperature rise and it becomes impossible to harden pearlite structures and secure a good wear resistance. In addition, pearlite blocks coarsen and the ductility of the rail deteriorates. For those reasons, the present invention stipulates that accelerated cooling should be applied until the temperature reaches a temperature not higher than 550° C.

No lower limit is particularly specified for the temperature at which accelerated cooling at a railhead portion is finished but, for securing a good hardness at a railhead portion and preventing the formation of martensite structures which are likely to form at segregated portions and the like in a head inner portion, 400° C. is the lower limit temperature, substantially.

Second, explanations are given regarding the conditions of accelerated cooling at the head, web and base portions of a rail, for preventing the formation of pro-eutectoid cementite structures.

In the first place, the range of an accelerated cooling rate is explained. When an accelerated cooling rate is below 1° C./sec., with the chemical composition according to the present invention, it becomes difficult to prevent the formation of pro-eutectoid cementite structures. When an accelerated cooling rate exceeds 10° C./sec., on the other hand, with the chemical composition according to the present invention, martensite structures form at segregated portions in the web and base portions of a rail and the toughness of the rail significantly deteriorates. For those reasons, an accelerated cooling rate is limited in the range from 1 to 10° C./sec.

Note that the accelerated cooling rate mentioned above is not a cooling rate during cooling but an average cooling rate from the beginning to the end of accelerated cooling. Therefore, as far as an average cooling rate from the beginning to the end of accelerated cooling is within the range specified above, it is possible to suppress the formation of pro-eutectoid cementite structures.

Next, explanations are given regarding the temperature range of accelerated cooling. When accelerated cooling is finished at a temperature above 650° C., an excessive thermal recuperation takes place from the inside of a rail after the end of the accelerated cooling. As a result, pearlite structures are prevented from forming by the temperature rise and, instead, pro-eutectoid cementite structures form. For these reasons, the present invention stipulates that accelerated cooling should be applied until the temperature reaches a temperature not higher than 650° C.

No lower limit is practically specified for the temperature at which accelerated cooling is finished but, for suppressing the formation of pro-eutectoid cementite structures and preventing the formation of martensite structures at the segregated portions in a web portion, 500° C. is the lower limit temperature, substantially.

(10) Reasons for Limiting the Heat Treatment Conditions of the Web and Base Portions of a Rail For the purpose of thoroughly preventing the formation of pro-eutectoid cementite structures in the web and base toe portions of a rail, a restrictive heat treatment is applied in addition to the cooling explained above. Here, the conditions of the heat treatment of the web and base toe portions of a rail are explained.

First, the conditions of the heat treatment of the web portion of a rail are explained. Explanations begin with the time period from the end of hot rolling to the beginning of accelerated cooling at the web portion of a rail. When the time period from the end of hot rolling to the beginning of accelerated cooling at the web portion of a rail exceeds 100 sec., with the chemical composition according to the present invention, pro-eutectoid cementite structures form in the web portion of the rail before the accelerated cooling and the fatigue strength and toughness of the rail deteriorate. For those reasons, the time period till the beginning of accelerated cooling is limited to not longer than 100 sec.

No lower limit is particularly specified for the time period from the end of hot rolling to the beginning of accelerated cooling at the web portion of a rail but, to make uniform the size of austenite grains in the web portion of a rail and mitigating the temperature unevenness occurring during rolling, it is desirable to begin accelerated cooling after the lapse of not less than 5 sec. from the end of hot rolling.

Next, explanations are given regarding the range of the cooling rate of accelerated cooling at the web portion of a rail. When a cooling rate is below 2° C./sec., with the chemical composition according to the present invention, it becomes difficult to prevent the formation of pro-eutectoid cementite structures in the web portion of a rail. When a cooling rate exceeds 20° C./sec., on the other hand, with the chemical composition according to the present invention, martensite structures form at the segregation bands in the web portion of a rail and the toughness of the web portion of the rail significantly deteriorates. For those reasons, an accelerated cooling rate at the web portion of a rail is limited in the range from 2 to 20° C./sec.

Note that the accelerated cooling rate at the web portion of a rail mentioned above is not a cooling rate during cooling but an average cooling rate from the beginning to the end of accelerated cooling. Therefore, as long as an average cooling rate from the beginning to the end of accelerated cooling is within the range specified above, it is possible to suppress the formation of pro-eutectoid cementite structures.

Next, explanations are given regarding the temperature range of accelerated cooling at the web portion of a rail. When accelerated cooling is finished at a temperature above 650° C., an excessive thermal recuperation takes place from the inside of a rail after the end of the accelerated cooling. As a result, pro-eutectoid cementite structures form due to the temperature rise before pearlite structures form in a sufficient amount. For those reasons, the present invention stipulates that accelerated cooling should be applied until the temperature reaches a temperature not higher than 650° C.

No lower limit is particularly specified for the temperature at which accelerated cooling is finished but, for suppressing the formation of pro-eutectoid cementite structures and preventing the formation of martensite structures which form, more at segregated portions, in a web portion, 500° C. is the lower limit temperature substantially.

Next, the reasons are explained in detail for limiting the time period from the end of hot rolling to the beginning of heating at the web portion of a rail and the temperature range of the heating in their respective ranges.

First, explanations are given regarding the time period from the end of hot rolling to the beginning of heating at the web portion of a rail. When the time period from the end of hot rolling to the beginning of heating at the web portion of a rail exceeds 100 sec., with the chemical composition according to the present invention, pro-eutectoid cementite structures form in the web portion of the rail before the heating, and, even though the web portion is heated, the pro-eutectoid cementite structures remain the subsequent heat treatment and the fatigue strength and toughness of the rail deteriorate.

For those reasons, the time period till the beginning of heating is limited to not longer than 100 sec.

No lower limit is particularly specified for the time period from the end of hot rolling to the beginning of heating at the web portion of a rail but, for mitigating the temperature unevenness occurring during rolling and carrying out the heating accurately, it is desirable to begin the heating after the lapse of not less than 5 sec. from the end of hot rolling.

Next, explanations are given regarding the temperature range of heating at the web portion of a rail. When the temperature rise of heating is less than 20° C., pro-eutectoid cementite structures form in the web portion of a rail before the subsequent accelerated cooling and the fatigue strength and toughness of the web portion of the rail deteriorate. When the temperature rise of heating exceeds 100° C., on the other hand, pearlite structures coarsen after heat treatment and the toughness of the web portion of a rail deteriorates. For those reasons, the temperature rise of heating at the web portion of a rail is limited in the range from 20° C. to 100° C.

Next, the reasons are explained for specifying the conditions of the heat treatment of the base toe portions of a rail. First, explanations are given regarding the time period from the end of hot rolling to the beginning of accelerated cooling at the base toe portions of a rail. When the time period from the end of hot rolling to the beginning of accelerated cooling at the base toe portions of a rail exceeds 60 sec., with the chemical composition according to the present invention, pro-eutectoid cementite structures form in the base toe portions of the rail before the accelerated cooling and the fatigue strength and toughness of the rail deteriorate. For those reasons, the time period till the beginning of accelerated cooling is limited to not longer than 60 sec.

No lower limit is particularly limited for the time period from the end of hot rolling to the beginning of accelerated cooling at the base toe portions of a rail but, to make uniform the size of austenite grains in the base toe portions of a rail and mitigating the temperature unevenness occurring during rolling, it is desirable to begin accelerated cooling after the lapse of not shorter than 5 sec. from the end of hot rolling.

Next, explanations are given regarding the range of the cooling rate of accelerated cooling at the base toe portions of a rail. When a cooling rate is below 5° C./sec., with the chemical composition according to the present invention, it becomes difficult to suppress the formation of pro-eutectoid cementite structures in the base toe portions of a rail. When a cooling rate exceeds 20° C./sec., on the other hand, with the chemical composition according to the present invention, martensite structures form in the base toe portions of a rail and the toughness of the base toe portions of the rail significantly deteriorates. For those reasons, an accelerated cooling rate at the base toe portions of a rail is limited in the range from 5 to 20° C./sec.

Note that the accelerated cooling rate at the base toe portions of a rail mentioned above is not a cooling rate during cooling but an average cooling rate from the beginning to the end of accelerated cooling. Therefore, as far as the average cooling rate from the beginning to the end of accelerated cooling is within the range specified above, it is possible to suppress the formation of pro-eutectoid cementite structures.

Next, explanations are given regarding the temperature range of accelerated cooling at the base toe portions of a rail. When accelerated cooling is finished at a temperature above 650° C., an excessive thermal recuperation takes place from the inside of a rail after the end of accelerated cooling. As a result, pro-eutectoid cementite structures form due to the temperature rise before pearlite structures form in a sufficient amount. For those reasons, the present invention stipulates that accelerated cooling should be applied until the temperature reaches a temperature not higher than 650° C.

Next, the reasons are explained in detail for limiting the time period from the end of hot rolling to the beginning of heating at the base toe portions of a rail and the temperature range of the heating in their respective ranges.

First, explanations are given regarding the time period from the end of hot rolling to the beginning of heating at the base toe portions of a rail. When the time period from the end of hot rolling to the beginning of heating at the base toe portions of a rail exceeds 60 sec., with the chemical composition according to the present invention, pro-eutectoid cementite structures form in the base toe portions of the rail before the heating, and, even though the base toe portions are heated thereafter, the pro-eutectoid cementite structures remain the subsequent heat treatment and the fatigue strength and toughness of the rail deteriorate. For those reasons, the time period till the beginning of heating is limited to not longer than 60 sec.

No lower limit is particularly limited for the time period from the end of hot rolling to the beginning of heating at the base toe portions of a rail but, for mitigating the temperature unevenness occurring during rolling and carrying out the heating accurately, it is desirable to begin the heating after the lapse of not less than 5 sec. from the end of hot rolling.

Next, explanations are given regarding the temperature range of heating at the base toe portions of a rail. When the temperature rise of heating is less than 50° C., pro-eutectoid cementite structures form in the base toe portions of a rail before the subsequent accelerated cooling and the fatigue strength and toughness of the base toe portions of the rail deteriorate. When the temperature rise of heating exceeds 100° C., on the other hand, pearlite structures coarsen after the heat treatment and the toughness of the base toe portions of a rail deteriorates. For those reasons, the temperature rise of heating at the base toe portions of a rail is limited in the range from 50° C. to 100° C.

With regard to the conditions of a railhead portion in the event of applying the above heat treatment, it is desirable to set the time period from the end of hot rolling to the heat treatment at not longer than 200 sec. and the area reduction ratio at the final pass of the finish hot rolling at 6% or more, or it is more desirable to apply continuous finish rolling of two or more passes with a time period of not longer than 10 sec. between passes at an area reduction ratio of 1 to 30% per pass.

(11) Reasons for Limiting the Length of a Rail after Hot Rolling

Here, the reasons are explained in detail for limiting the length of a rail after hot rolling.

When the length of a rail after hot rolling exceeds 200 m, the temperature difference between the ends and the middle portion and moreover between the two ends of the rail after the rolling becomes so large that it becomes difficult to properly control the temperature and the cooling rate over the whole rail length even though the above rail production method is employed, and the material quality of the rail in the longitudinal direction becomes uneven. When the length of a rail after hot rolling is less than 100 m, on the other hand, rolling efficiency lowers and the production cost of the rail increases. For these reasons, the length of a rail after hot rolling is limited in the range from 100 to 200 m.

Note that, in order to obtain a product rail length in the range from 100 to 200 m, it is desirable to secure a rolling length of the product rail length plus crop allowances.

(12) Reasons for Limiting Rolling Conditions at Hot Rolling

Here, the reasons are explained in detail for limiting rolling conditions at hot rolling.

When a temperature at the end of hot rolling exceeds 1,000° C., with the chemical composition according to the present invention, pearlite structures in a railhead portion are not made fine and ductility is not improved sufficiently. When a temperature at the end of hot rolling is below 850° C., on the other hand, it becomes difficult to control the shape of a rail and, as a result, to produce a rail satisfying a required product shape. In addition, pro-eutectoid cementite structures form immediately after the rolling owing to the low temperature and the fatigue strength and toughness of a rail deteriorate. For those reasons, a temperature at the end of hot rolling is limited in the range from 850° C. to 1,000° C.

When an area reduction ratio at the final pass of hot rolling is below 6%, it becomes impossible to make a austenite grain size fine after the rolling of a rail and, as a consequence, a pearlite block size increases and it is impossible to secure a high ductility at the railhead portion. For those reasons, an area reduction ratio at the final rolling pass is defined as 6% or more.

In addition to the above control of a rolling temperature and an area reduction ratio, for the purpose of improving ductility at a railhead portion, 2 or more consecutive rolling passes are applied at final rolling and, moreover, an area reduction ratio per pass and a time period between the passes at final rolling are controlled.

Next, the reasons are explained in detail for limiting an area reduction ratio per pass and a time period between the passes at final rolling.

When an area reduction ratio per pass at final rolling is less than 1%, austenite grains are not made fine at all, a pearlite block size is not reduced as a consequence, and thus ductility at a railhead portion is not improved. For those reasons, an area reduction ratio per pass at final rolling is limited to 1% or more. When an area reduction ratio per pass at final rolling exceeds 30%, on the other hand, it becomes impossible to control the shape of a rail and thus it becomes difficult to produce a rail satisfying a required product shape. For those reasons, an area reduction ratio per pass at final rolling is limited in the range from 1 to 30%.

When a time period between passes at final rolling exceeds 10 sec., austenite grains grow after the rolling, a pearlite block size is not reduced as a consequence, and thus ductility at a railhead portion is not improved. For those reasons, a time period between passes at final rolling is limited to not longer than 10 sec. No lower limit is particularly specified for a time period between passes but, for suppressing grain growth, making austenite grains fine through continuous recrystallization, and making a pearlite block size small as a result, it is desirable to make the time period as short as possible.

Here, the portions of a rail are explained. FIG. 1 shows the denominations of different portions of a rail. As shown in FIG. 1: the head portion is the portion that mainly contacts with wheels (reference numeral 1); the web portion is the portion that is located lower and has a sectional thickness thinner than the head portion (reference numeral 5); the base portion is the portion that is located lower than the web portion (reference numeral 6); and the base toe portions are the portions that are located at both the ends of the base portion 6 (reference numeral 7). In the present invention, the base toe portions are defined as the regions 10 to 40 mm apart from both the tips of a base portion. Therefore, the base toe portions 7 constitute parts of a base portion 6. Temperatures and cooling conditions in the heat treatment of a rail are defined by the relevant representative values that are measured in the regions 0 to 3 mm in depth from the surfaces of, as shown in FIG. 1, respectively: the center of the rail width at a head portion 1; the center of the rail width at a base portion 6; the center of the rail height at a web portion 5; and points 5 mm apart from the tips of base toe portions 7.

Note that it is desirable to make the cooling rates at the above four measurement points as equal as possible in order to make uniform the hardness and the structures in a rail section.

A temperature at the rolling of a rail is represented by the temperature measured immediately after rolling at the point in the center of the rail width on the surface of the head portion 1 shown in FIG. 1.

The present inventors also examined, in a steel rail of pearlite structures having a high carbon content, the relationship between the cooling rate capable of preventing pro-eutectoid cementite structures from forming at the head inner portion (critical cooling rate of pro-eutectoid cementite structure formation) and the chemical composition of the steel rail.

As a result of heat treatment tests using high-carbon steel specimens simulating the shape of a railhead portion, it has been clarified that: there is a relationship between the chemical composition (C, Si, Mn and Cr) of a steel rail and the critical cooling rate of pro-eutectoid cementite structure formation; and C, which is an element that accelerates the formation of cementite, has a positive correlation and Si, Mn and Cr, which are elements that increase hardenability, have negative correlations.

On the basis of the above finding, the present inventors tried to determine, in steel rails containing over 0.85 mass % C, wherein the formation of pro-eutectoid cementite structures is conspicuous, the relationship between the chemical composition (C, Si, Mn and Cr) of the steel rails and the critical cooling rates of pro-eutectoid cementite structure formation, by using multiple correlation analysis. As a result, it has been found that: the value corresponding to the critical cooling rate of pro-eutectoid cementite structure formation at the head inner portion of a steel rail is obtained by calculating the value of CCR defined by the equation (4) representing the contribution of chemical composition (mass %) in the steel rail; and further it is possible to prevent pro-eutectoid cementite structures from forming at the railhead inner portion by controlling the cooling rate at the railhead inner portion (ICR, ° C./sec.) to not less than the value of CCR in the heat treatment of a steel rail:

$$CCR=0.6+10\times([\%\ C]-0.9)-5\times([\%\ C]-0.9)\times[\%\ Si]-0.17[\%\ Mn]-0.13[\%\ Cr] \quad (4).$$

Next, the present inventors studied a method for controlling a cooling rate at a head inner portion (ICR, ° C./sec.) in the heat treatment of a steel rail.

In view of the fact that the entire surface of a railhead portion is cooled in the event of cooling the railhead portion in a heat treatment, the present inventors carried out heat treatment tests using high-carbon steel specimens simulating the shape of a railhead portion and tried to find out the relationship between cooling rates at different positions on the surface of a railhead portion and a cooling rate at a railhead inner portion. As a result, it has been confirmed that: a cooling rate at a railhead inner portion correlates with a cooling rate at the surface of a railhead top portion (TH, ° C./sec.), the average of cooling rates at the surfaces of the right and left sides of a railhead portion (TS, ° C./sec.) and the average of cooling rates at the surfaces of the lower chin portions (TJ, ° C./sec.) that are located at the boundaries between the head and web portions on the right and left sides; and the cooling rate at the railhead inner portion can be evaluated by using the value of TCR defined by the equation (5) representing the contribution to the cooling rate at the railhead inner portion:

$$TCR=0.05TH(^\circ\ C./sec.)+0.10TS(^\circ\ C./sec.)+0.50TJ(^\circ\ C./sec.) \quad (5).$$

Note that each of the cooling rates at head side portions and lower chin portions (TS and TJ, ° C./sec.) is the average value of the cooling rates at the respective positions on the right and left sides of a rail.

Further, the present inventors experimentally investigated the relationship of the value of TCR with the formation of pro-eutectoid cementite structures in a railhead inner portion and structures in the surface layer of a railhead portion. As a result, it has been clarified that: the formation of pro-eutectoid cementite structures in a railhead inner portion correlates with the value of TCR; and, when the value of TCR is twice or more the value of CCR calculated from the chemical composition of a steel rail, pro-eutectoid cementite structures do not form in the railhead inner portion.

It has further been clarified that, in relation to the microstructures in the surface layer of a railhead portion, when the value of TCR is four times or more the value of CCR calculated from the chemical composition of a steel rail, the cooling is excessive, bainite and martensite structures detrimental to wear resistance form in the surface layer of the railhead portion, and the service life of the steel rail shortens.

That is, the present inventors have found out that, in the heat treatment of a railhead portion, it is possible to secure an appropriate cooling rate at the railhead inner portion (ICR, ° C./sec.), prevent the formation of pro-eutectoid cementite structures there, and additionally stabilize pearlite structures in the surface layer of the railhead portion by controlling the value of TCR so as to satisfy the expression 4CCR≧TCR≧2CCR.

To sum up, the present inventors have found that, in a steel rail having a high carbon content: it is possible to prevent the formation of pro-eutectoid cementite structures in the head inner portion of the steel rail by controlling the cooling rate at the head inner portion (ICR) so as to be not less than the value of CCR calculated from the chemical composition of the steel rail; and moreover it is necessary to control the value of TCR calculated from the cooling rates at the different positions on the surface of the head portion within the range regulated by the value of CCR for securing an appropriate cooling rate at the head inner portion (ICR) and stabilizing pearlite structures in the surface layer of the head portion.

Accordingly, the present invention makes it possible to, in the heat treatment of a high-carbon steel rail used in a heavy load railway: stabilize pearlite structures in the surface layer of the head portion; at the same time, prevent the formation of pro-eutectoid cementite structures, which are likely to form at the head inner portion and serve as the origin of fatigue damage; and, as a consequence, secure a good wear resistance and improve resistance to internal fatigue damage.

(13) Reasons for Regulating the Heat Treatment Method for Preventing the Formation of Pro-Eutectoid Cementite Structures in a Railhead Inner Portion 1) Reasons for Defining the Equation for Calculating the Value of CCR The reasons are explained for defining the equation for calculating the value of CCR as described above.

The equation for calculating the value of CCR has been derived from the procedures of: firstly measuring the critical cooling rate of pro-eutectoid cementite structure formation through the tests simulating the heat treatment of a railhead portion; and then clarifying the relationship between the critical cooling rate of pro-eutectoid cementite structure formation and the chemical composition (C, Si, Mn and Cr) of a steel rail by using multiple correlation analysis. The resulting correlation equation (4) is shown below. As stated above, the equation (4) is an experimental regression equation, and it is possible to prevent the formation of pro-eutectoid cementite structures by cooling a railhead inner portion at a cooling rate not lower than the value calculated from the equation (4):

$$CCR=0.6+10\times([\%\ C]-0.9)-5\times([\%\ C]-0.9)\times[\%\ Si]-0.17[\%\ Mn]-0.13[\%\ Cr] \quad (4).$$

2) Reasons for Limiting a Position and a Temperature Range Wherein a Cooling Rate at a Railhead Inner Portion is Regulated The reasons are explained for determining a position where a cooling rate at a railhead inner portion is regulated to be a position 30 mm in depth from a head top surface.

A cooling rate at a railhead portion tends to decrease from the surface toward the inside thereof. Therefore, in order to prevent pro-eutectoid cementite structures from forming at the regions of the railhead portion where the cooling rate is lower, it is necessary to secure an adequate cooling rate at the railhead inner portion. As a result of experimentally measuring the cooling rates at different positions in a railhead inner portion, it has been confirmed that: the cooling rate at the position 30 mm in depth from a head top surface is the lowest; and, when an adequate cooling rate is secured at this position, pro-eutectoid cementite structures are prevented from forming at the railhead inner portion. From the results, the position where a cooling rate at a railhead inner portion is regulated is determined to be a position 30 mm in depth from a head top surface.

Next, the reasons are explained for defining a temperature range in which a cooling rate at a railhead inner portion is regulated.

It has been experimentally confirmed that, in a steel rail having the chemical composition as specified above, the temperature at which pro-eutectoid cementite structures form is in the range from 750° C. to 650° C. Therefore, in order to prevent the formation of pro-eutectoid cementite structures, it is necessary to control a cooling rate at a railhead inner portion to at least a certain value or more in the above temperature range. For those reasons, a temperature range in which a cooling rate at the position 30 mm in depth from the head top surface of a steel rail is regulated is determined to be from 750° C. to 650° C.

3) Reasons for Defining the Equation for Calculating the Value of TCR and Limiting the Range of the Value The reasons are explained for defining the equation for calculating the value of TCR.

The equation for calculating the value of TCR has been derived from the procedures of: firstly measuring a cooling rate at a railhead top portion (TH, ° C./sec.), a cooling rate at railhead side portions (TS, ° C./sec.), a cooling rate at lower chin portions (TJ, ° C./sec.), and moreover a cooling rate at a railhead inner portion (ICR, ° C./sec.) through the tests simulating the heat treatment of a railhead portion; and then formulating the cooling rates at the respective railhead surface portions according to their contributions to the cooling rate at the railhead inner portion (ICR, ° C./sec.). The resulting equation (5) is shown below. As stated above, the equation (5) is an empirical equation and, as far as a value calculated from the equation (5) is not less than a certain value, it is possible to secure an adequate cooling rate at a railhead inner portion and prevent the formation of pro-eutectoid cementite structures:

$$TCR=0.05TH(^\circ\ C./sec.)+0.10TS(^\circ\ C./sec.)+0.50TJ(^\circ\ C./sec.) \quad (5).$$

Note that each of the cooling rates at head side portions and lower chin portions (TS and TJ, ° C./sec.) is the average value of the cooling rates at the respective positions on the right and left sides of a rail.

Next, the reasons are explained for regulating the value of TCR so as to satisfy the expression 4CCR≧TCR≧2CCR.

When the value of TCR is smaller than 2CCR, a cooling rate at a railhead inner portion (ICR, ° C./sec.) decreases, pro-eutectoid cementite structures form in the railhead inner portion, and internal fatigue damage is likely to occur. In addition, in that case, the hardness at the surface of a railhead portion deteriorates and a good wear resistance of a rail cannot be secured. When the value of TCR exceeds 4CCR, on the other hand, cooling rates at the surface layer of a railhead portion increase drastically, bainite and martensite structures detrimental to wear resistance form in the surface layer of the railhead portion, and the service life of the steel rail shortens. For those reasons, the value of TCR is restricted in the range specified by the expression 4CCR≧TCR≧2CCR.

4) Reasons for Limiting Positions and a Temperature Range wherein Cooling Rates at the Surface of a Railhead Portion are Regulated In the first place, the reasons are explained for determining positions where cooling rates at the surface of a railhead portion are regulated to be three kinds of portions; a head top portion, head side portions and lower chin portions.

A cooling rate at a railhead inner portion is significantly influenced by cooling conditions at the surface of a railhead portion. The present inventors experimentally examined the relationship between a cooling rate at a railhead inner portion and cooling rates at the surface of a railhead portion. As a result, it has been confirmed that: a cooling rate at a railhead inner portion is in good correlation with cooling rates at three kinds of surfaces, through which heat at a railhead portion is removed, of the top, the sides (right and left) and the lower chins (right and left) of the railhead portion; and a cooling rate at a rail head inner portion is adequately controlled by adjusting cooling rates at the surfaces. From the results, the positions where cooling rates at the surface of a railhead portion are regulated are determined to be the top, the sides and the lower chins of the railhead portion.

Next, the reasons are explained for defining a temperature range in which cooling rates at the three kinds of surfaces of a railhead portion are regulated.

It has been experimentally confirmed that, in a steel rail having the chemical composition as specified above, the temperature at which pro-eutectoid cementite structures form is in the range from 750° C. to 650° C. Therefore, in order to prevent the formation of pro-eutectoid cementite structures, it is necessary to control a cooling rate at a railhead inner portion to at least a certain value or more in the above temperature range. However, as the amount of heat removed at a railhead inner portion is smaller than that removed at the surface of a railhead portion at the time of the end of accelerated cooling, the temperature at the railhead inner portion is higher than that at the surface of the railhead portion. Accordingly, in order to secure an adequate cooling rate at a railhead inner portion in the temperature range down to 650° C., beyond which pro-eutectoid cementite structures form, it is necessary to regulate a temperature at the end of accelerated cooling to below 650° C. at the surface of the railhead portion. As a result of verifying experimentally the temperature at the end of accelerated cooling at the surface of a railhead portion, it has been confirmed that, when a cooling is continued until a surface temperature reaches 500° C., a temperature at the end of cooling at a railhead inner portion falls to below 650° C. From those results, a temperature range in which cooling rates at the three kinds of surfaces of a railhead portion (the top, the sides and the lower chins of a railhead portion) are regulated is determined to be from 750° C. to 500° C.

Figure 10:
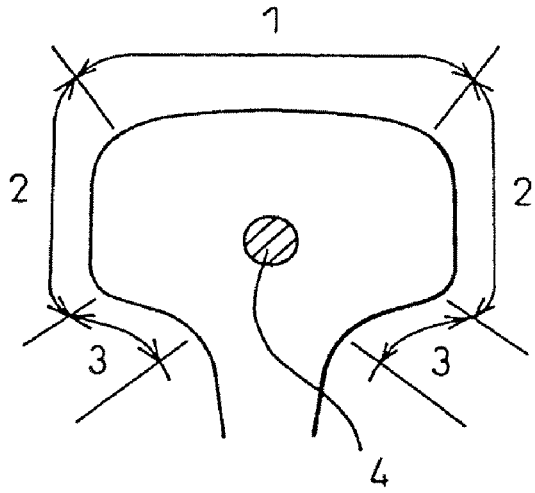
FIG. 10 is an illustration showing different portions at a railhead portion in detail.

Here, the portions of a rail are explained. FIG. 10 shows the denominations of different positions at a railhead portion. The head top portion means the whole upper part of a railhead portion (reference numeral 1), the head side portions mean the whole left and right side parts of a railhead portion (reference numeral 2), the lower chin portions mean the whole parts on the left and right sides at the boundaries between a head portion and a web portion (reference numeral 3), and the head inner portion means the part in the vicinity of the position 30 mm in depth from the surface of the railhead top portion in the center of the rail width (reference numeral 4).

Accelerated cooling rates and temperature ranges of accelerated cooling in the heat treatment of a rail are defined by the relevant representative values that are measured on the surfaces of, or in the regions up to 5 mm in depth from the surfaces of, as shown in FIG. 10, respectively: the center of the rail width at a head top portion 1; the center of the railhead height at head side portions 2; and the center of the lower chin portions 3.

As a consequence, by controlling temperatures and cooling rates at the above portions, it is possible to stabilize pearlite structures in the surface layer of a head portion and control a cooling rate at a head inner portion 4, thus secure a good wear resistance at the surface of the head portion, prevent the formation of pro-eutectoid cementite structures at the head inner portion, and, in addition, enhance resistance to internal fatigue damage. With regard to accelerated cooling during the heat treatment of a railhead portion, it is possible to arbitrarily choose, as required, the application or otherwise of cooling and accelerated cooling rates in the case of the application at the five positions, namely a head top portion, head side portions (right and left) and lower chin portions (right and left), so that the value of TCR may satisfy the expression 4CCR≧TCR≧2CCR.

Note that it is desirable to make cooling rates on both the right and left sides of head side portions and lower chin portions equal in order to make hardness and metallographic structures uniform on both the sides of a railhead portion.

As explained above, in order to prevent the formation of pro-eutectoid cementite structures at a head inner portion and stabilize pearlite structures in the surface layer of a head portion in a steel rail of pearlite structures having a high carbon content, it is necessary to control a cooling rate at the head inner portion (ICR) so as to be not lower than the value of CCR that is determined by the chemical composition of the steel rail and corresponds to the critical cooling rate under which cementite structures form, and, at the same time, to control cooling rates at the aforementioned different positions on the surfaces of the railhead portion so that the value of TCR may fall within the specified range.

It is desirable that the metallographic structure of a steel rail produced through a heat treatment method according to the present invention is composed of pearlite structures almost over the entire body. In some choices of chemical composition and accelerated cooling conditions, pro-eutectoid ferrite structures, pro-eutectoid cementite structures and bainite structures may form in very small amounts in pearlite structures. However, as long as the amounts of these structures are very small, their presence in pearlite structures does not have a significant influence on the fatigue strength and the toughness of a rail. For this reason, the structure of the head portion of a steel rail produced through a heat treatment method according to the present invention may include pearlite structures in which small amounts of pro-eutectoid ferrite structures, pro-eutectoid cementite structures and bainite structures are mixed.

EXAMPLES

Example 1

Figure 4:
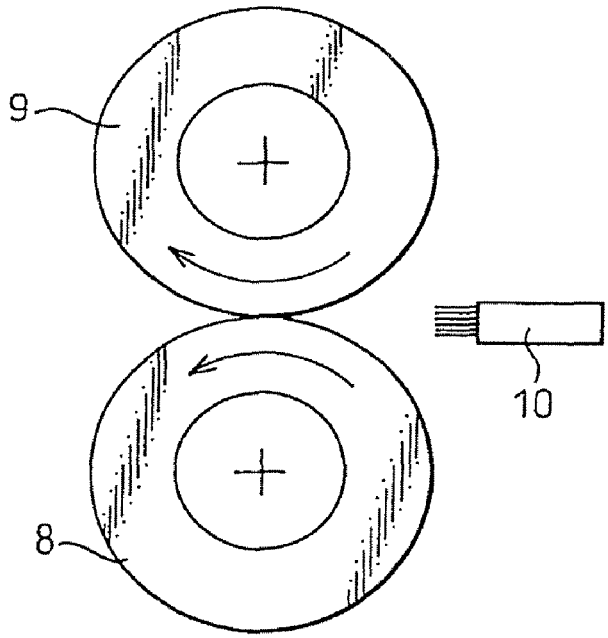
FIG. 4 is an illustration showing an outline of a Nishihara wear tester.

Table 1 shows, regarding each of the steel rails according to the present invention, chemical composition, hot rolling and heat treatment conditions, the microstructure of a head portion at a depth of 5 mm from the surface thereof, the number and the measurement position of pearlite blocks having grain sizes in the range from 1 to 15 μm, and the hardness of a head portion at a depth of 5 mm from the surface thereof. Table 1 also shows the amount of wear of the material at a head portion after 700,000 repetition cycles of Nishihara wear test are imposed under the condition of forced cooling as shown in FIG. 4, and the result of tensile test at a head portion. In FIG. 4, reference numeral 8 indicates a rail test piece, 9 a counterpart wheel piece, and 10 a cooling nozzle.

Table 2 shows, regarding each of the comparative steel rails, chemical composition, hot rolling and heat treatment conditions, the microstructure of a head portion at a depth of 5 mm from the surface thereof, the number and the measurement position of pearlite blocks having grain sizes in the range from 1 to 15 μl, and the hardness of a head portion at a depth of 5 mm from the surface thereof. Table 2 also shows the amount of wear of the material at a head portion after 700,000 repetition cycles of Nishihara wear test are imposed under the condition of forced cooling as shown in FIG. 4, and the result of tensile test at a head portion.

Note that any of the steel rails listed in Tables 1 and 2 was produced under the conditions of a time period of 180 sec. from hot rolling to heat treatment and an area reduction ratio of 6% at the final pass of finish hot rolling.

The rails listed in the tables are as follows:

Steel Rails According to the Present Invention (12 rails), Symbols 1 to 12

The pearlitic steel rails excellent in wear resistance and ductility having chemical composition in the aforementioned ranges, characterized in that the number of the pearlite blocks having grain sizes in the range from 1 to 15 μm is 200 or more per 0.2 $mm^2$ of observation field at least in a part of the region down to a depth of 10 mm from the surface of the corners and top of a head portion.

Comparative Steel Rails (10 Rails), Symbols 13 to 22

Symbols 13 to 16 (4 rails): the comparative steel rails, wherein the amounts of C, Si, Mn in alloying are outside the respective ranges according to the claims of the present invention.

Symbols 17 to 22 (6 rails): the comparative steel rails having the chemical composition in the aforementioned ranges, wherein the number of the pearlite blocks having grain sizes in the range from 1 to 15 μm is less than 200 per 0.2 $mm^2$ of observation field at least in a part of the region down to a depth of 10 mm from the surface of the corners and top of a head portion.

Figure 5:
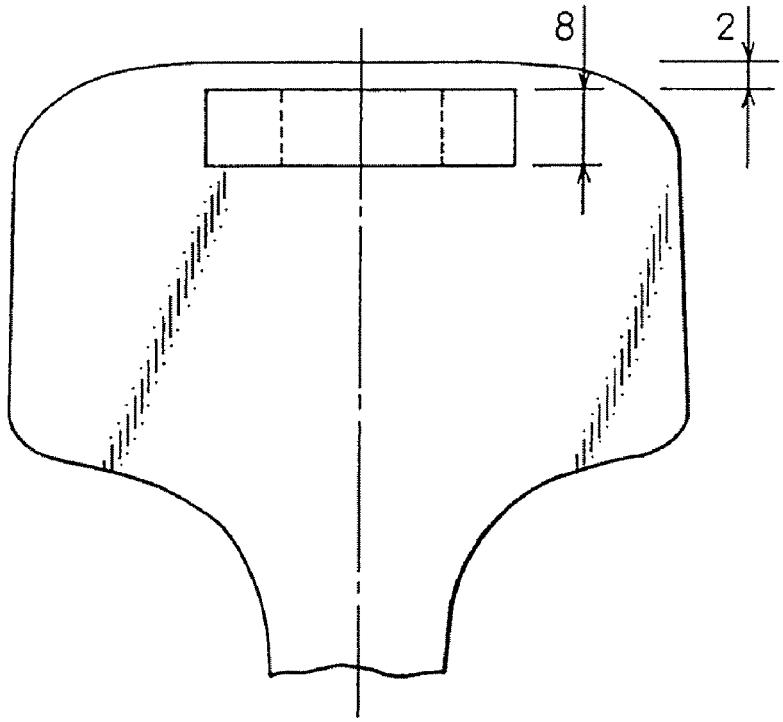
FIG. 5 is an illustration showing the position from which a test piece for the wear test referred to in Tables 1 and 2 is cut out.
Figure 6:
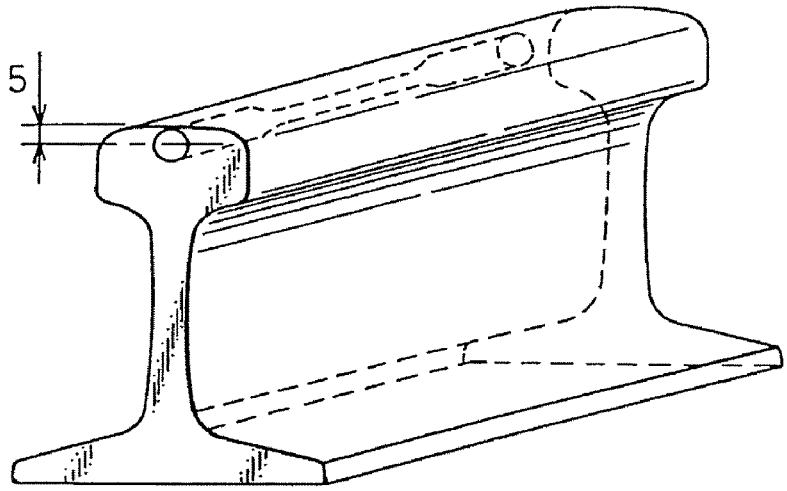
FIG. 6 is an illustration showing the position from which a test piece for the tensile test referred to in Tables 1 and 2 is cut out.

Here, explanations are given regarding the drawings attached hereto. FIG. 3 is an illustration showing, in a section, the denominations of the different positions on the surface of the head portion of a pearlitic steel rail excellent in wear resistance and ductility according to the present invention and the region where wear resistance is required. FIG. 4 is an illustration showing an outline of a Nishihara wear tester. In FIG. 4, reference numeral 8 indicates a rail test piece, 9 a counterpart wheel piece, and 10 a cooling nozzle. FIG. 5 is an illustration showing the position from which a test piece for the wear test referred to in Tables. 1 and 2 is cut out. FIG. 6 is an illustration showing the position from which a test piece for the tensile test referred to in Tables. 1 and 2 is cut out.

Figure 7:
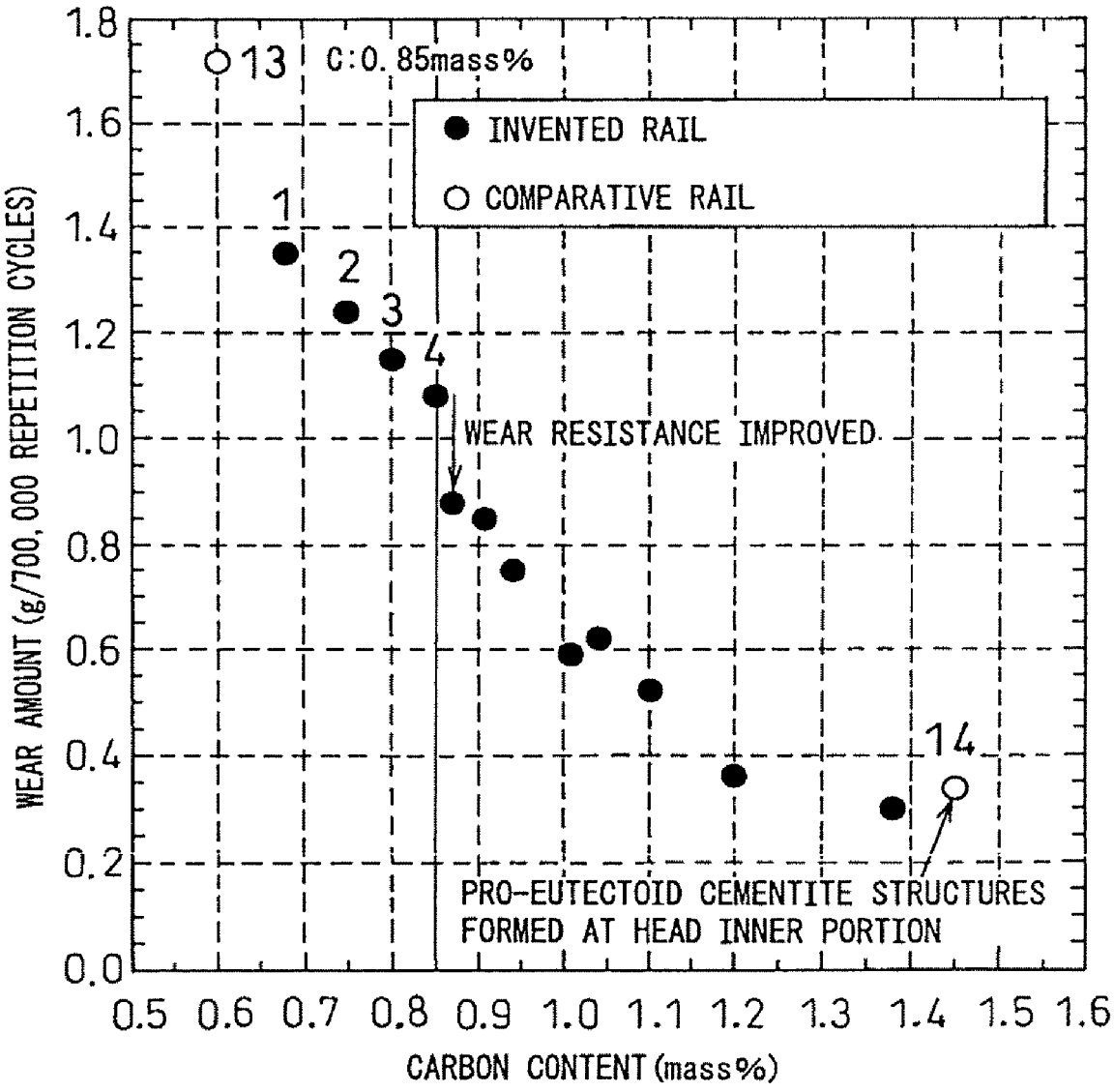
FIG. 7 is a graph showing the relationship between the carbon contents and the amounts of wear loss in the wear test results of the steel rails according to the present invention shown in Table 1 (reference numerals 1 to 12) and the comparative steel rails shown in Table 2 (reference numerals 13 to 22).
Figure 8:
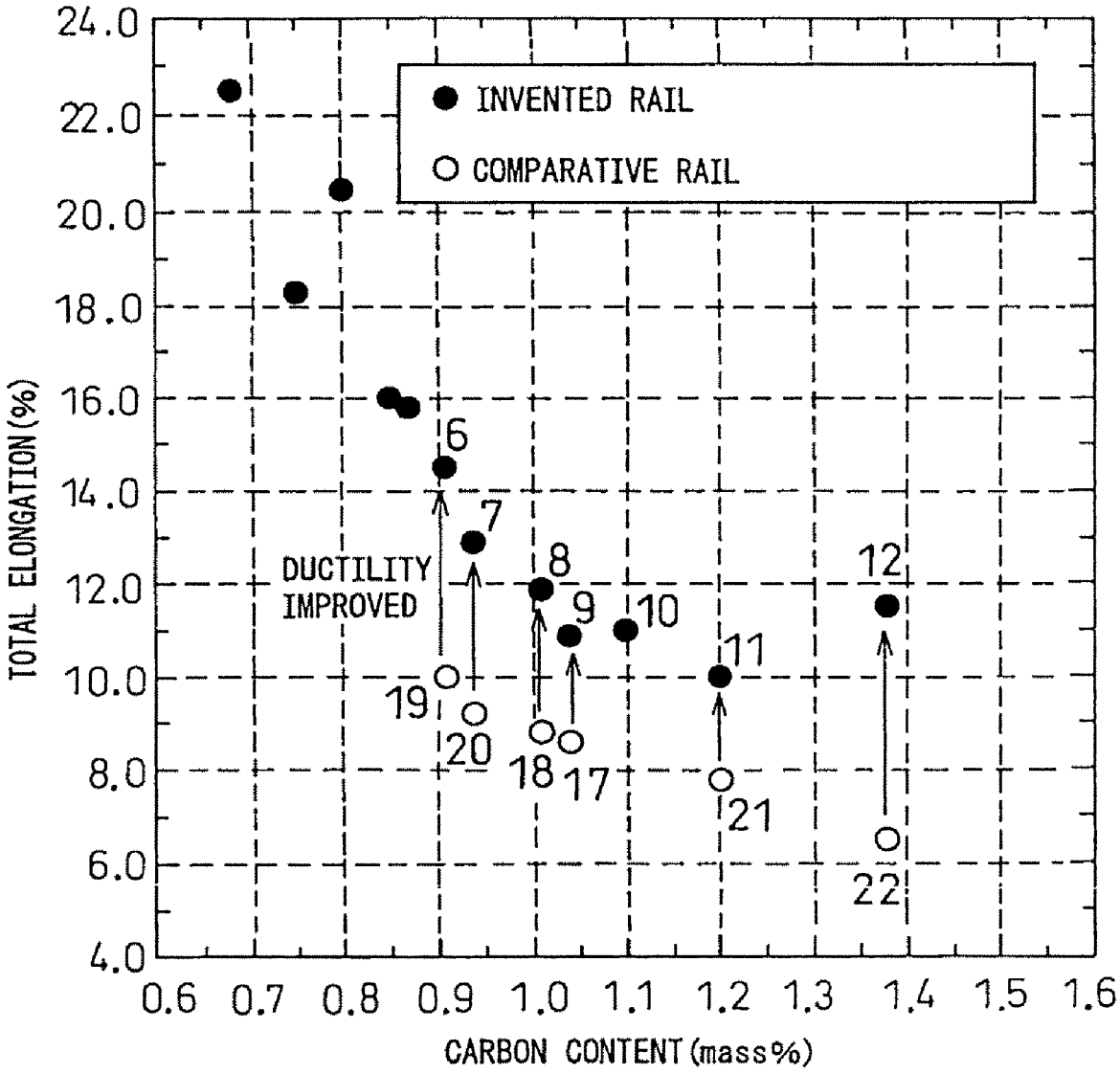
FIG. 8 is a graph showing the relationship between the carbon contents and the total elongation values in the tensile test results of the steel rails according to the present invention shown in Table 1 (reference numerals 1 to 12) and the comparative steel rails shown in Table 2 (reference numerals 17 to 22).

Further, FIG. 7 is a graph showing the relationship between the carbon contents and the amounts of wear loss in the wear test results of the steel rails according to the present invention shown in Table 1 and the comparative steel rails shown in Table 2, and FIG. 8 is a graph showing the relationship between the carbon contents and the total elongation values in the tensile test results of the steel rails according to the present invention shown in Table 1 and the comparative steel rails shown in Table 2.

The tests were carried out under the following conditions:

Wear Test of a Head Portion

- Test equipment: Nishihara wear tester (see FIG. 4)
- Test piece shape: Disc shape (30 mm in outer diameter, 8 mm in thickness)
- Test piece machining position: 2 mm in depth from the surface of a railhead top portion (see FIG. 5)
- Test load: 686 N (contact surface pressure 640 MPa)
- Slip ratio: 20%
- Counterpart wheel piece: Pearlitic steel (Hv 380)
- Atmosphere: Air
- Cooling: Forced cooling by compressed air (flow rate: 100 Nl/min.)
- Repetition cycle: 700,000 cycles Tensile Test of a Head Portion

- Test equipment: Compact universal tensile tester
- Test piece shape: JIS No. 4 test piece equivalent; parallel portion length, 25 mm; parallel portion diameter, 6 mm; gauge length for measurement of elongation, 21 mm
- Test piece machining position: 5 mm in depth from the surface of a railhead top portion (see FIG. 6)
- Strain speed: 10 mm/min.
- Test temperature: Room temperature (20° C.)

As seen in Tables 1 and 2, in the cases of the steel rails according to the present invention in contrast to the cases of the comparative steel rails, pro-eutectoid cementite structures, pro-eutectoid ferrite structures, martensite structures and so on detrimental to the wear resistance and ductility of a rail did not form and the wear resistance and ductility were good as a result of controlling the addition amounts of C, Si and Mn within the respective prescribed ranges.

In addition, as seen in FIG. 7, in the cases of the steel rails according to the present invention in contrast to the cases of the comparative steel rails, the wear resistance improved as a result of controlling the carbon contents within the prescribed range. In particular, in the cases of the steel rails having carbon contents over 0.85% (Symbols 5 to 12) according to the present invention in contrast to the cases of the steel rails having carbon contents of 0.85% or less (Symbols 1 to 4) according to the present invention, the wear resistance improved further.

In addition, as seen in FIG. 8, in the cases of the steel rails according to the present invention in contrast to the cases of the comparative steel rails, the ductility of the head portions improved as a result of controlling the numbers of the pearlite blocks having grain sizes in the range from 1 to 15 μm. Thus, it was possible to prevent fractures such as breakage of a rail in cold regions.

TABLE 1

| Classification of rail | Symbol | Steel | Chemical composition (mass %) C | Si | Mn | Cr/Mo/V/Nb/B/Co/Cu/Ni/Ti/Mg/Ca/Al/Zr | Hot rolling and heat treatment conditions |
|---|---|---|---|---|---|---|---|
| Invented rail | 1 | 1 | 0.68 | 0.25 | 0.80 | Ni: 0.15 | Area reduction ratio of final rolling: 13%<br>Rolling end temperature: 940° C.<br>Accelerated cooling rate: 5° C./sec |
| | 2 | 2 | 0.75 | 0.15 | 1.31 | Cu: 0.15 | Area reduction ratio of final rolling: 10%<br>Rolling end temperature: 950° C.<br>Accelerated cooling rate: 4° C./sec |
| | 3 | 3 | 0.80 | 0.30 | 0.98 | | Reheating temperature: 870° C.<br>Accelerated cooling rate: 7° C./sec |
| | 4 | 4 | 0.85 | 0.45 | 1.00 | Mo: 0.02<br>Co: 0.21 | Area reduction ratio of final rolling: 9%<br>Rolling end temperature: 940° C.<br>Accelerated cooling rate: 4° C./sec |
| | 5 | 5 | 0.87 | 0.52 | 1.15 | Mg: 0.0021<br>Ca: 0.0012 | Area reduction ratio of final rolling: 12%<br>Rolling end temperature: 930° C.<br>Accelerated cooling rate: 5° C./sec |
| | 6 | 6 | 0.91 | 0.25 | 0.60 | V: 0.04 | Area reduction ratio of final rolling: 9%<br>Rolling end temperature: 980° C.<br>Accelerated cooling rate: 5° C./sec |
| | 7 | 7 | 0.94 | 0.75 | 0.80 | Cr: 0.45 | Area reduction ratio of final rolling: 8%<br>Rolling end temperature: 960° C.<br>Accelerated cooling rate: 3° C./sec |
| | 8 | 8 | 1.01 | 0.81 | 1.05 | B: 0.0012 | Area reduction ratio of final rolling: 11%<br>Rolling end temperature: 960° C.<br>Accelerated cooling rate: 6° C./sec |
| | 9 | 9 | 1.04 | 0.41 | 0.75 | Cr: 0.21 | Area reduction ratio of final rolling: 10%<br>Rolling end temperature: 950° C.<br>Accelerated cooling rate: 5° C./sec |
| | 10 | 10 | 1.10 | 0.45 | 1.65 | Zr: 0.0015<br>Nb: 0.018 | Area reduction ratio of final rolling: 15%<br>Rolling end temperature: 935° C.<br>Accelerated cooling rate: 6° C./sec |
| | 11 | 11 | 1.20 | 1.21 | 0.65 | Ti: 0.0130<br>Al: 0.0400 | Area reduction ratio of final rolling: 10%<br>Rolling end temperature: 920° C.<br>Accelerated cooling rate: 8° C./sec |
| | 12 | 12 | 1.38 | 1.89 | 0.20 | Al: 0.18 | Reheating temperature: 900° C.<br>Accelerated cooling rate: 10° C./sec |

| Classification of rail | Symbol | Microstructure of head portion (5 mm in depth from head surface) | Number of pearlite blocks 1 to 15 μm in grain size (per 0.2 mm$^2$) Measurement position | Hardness of head portion (5 mm in depth from head surface) (Hv 10 kgf) | Amount of wear of head portion (g) | Tensile test result of head portion Total elongation (%) |
|---|---|---|---|---|---|---|
| Invented rail | 1 | Pearlite | 405<br>5 mm in depth from head surface | 335 | 1.35 | 22.5 |
| | 2 | Pearlite | 231<br>4 mm in depth from head surface | 358 | 1.24 | 18.3 |
| | 3 | Pearlite | 765<br>8 mm in depth from head surface | 395 | 1.15 | 20.5 |
| | 4 | Pearlite | 321<br>6 mm in depth from head surface | 405 | 1.08 | 16.0 |
| | 5 | Pearlite | 380<br>3 mm in depth from head surface | 415 | 0.88 | 15.8 |
| | 6 | Pearlite | 212<br>1 mm in depth from head surface | 385 | 0.85 | 14.5 |
| | 7 | Pearlite | 248<br>3 mm in depth from head surface | 389 | 0.75 | 12.9 |
| | 8 | Pearlite | 285<br>2 mm in depth from head surface | 448 | 0.59 | 11.9 |
| | 9 | Pearlite | 265<br>3 mm in depth from head surface | 422 | 0.62 | 10.9 |

TABLE 1-continued

| | | | | | |
|---|---|---|---|---|---|
| 10 | Pearlite | 348<br>6 mm in depth<br>from head surface | 452 | 0.52 | 11.0 |
| 11 | Pearlite | 325<br>7 mm in depth<br>from head surface | 478 | 0.36 | 10.0 |
| 12 | Pearlite | 574<br>9 mm in depth<br>from head surface | 415 | 0.30 | 11.5 |

Note:

Balance of chemical composition is Fe and unavoidable impurities.

TABLE 2

| Classification of rail | Symbol | Steel | Chemical composition (mass %) C | Si | Mn | Cr/Mo/V/Nb/B/Co/Cu/Ni/Ti/Mg/Ca/Al/Zr | Hot rolling and heat treatment conditions | Microstructure of head portion (5 mm in depth from head surface) |
|---|---|---|---|---|---|---|---|---|
| Comparative rail | 13 | 13 | 0.60 | 0.25 | 0.80 | Ni: 0.12 | Area reduction ratio of final rolling: 13%<br>Rolling end temperature: 940° C.<br>Accelerated cooling rate: 3° C./sec | Pearlite + pro-eutectoid ferrite |
| | 14 | 14 | 1.45 | 1.75 | 0.20 | Al: 0.18 | Area reduction ratio of final rolling: 9%<br>Rolling end temperature: 970° C.<br>Accelerated cooling rate: 5° C./sec | Pearlite + pro-eutectoid cementite |
| | 15 | 15 | 0.87 | 2.15 | 1.16 | Mg: 0.0015<br>Ca: 0.0012 | Area reduction ratio of final rolling: 12%<br>Rolling end temperature: 930° C.<br>Accelerated cooling rate: 5° C./sec | Pearlite |
| | 16 | 16 | 0.75 | 0.16 | 2.25 | Cu: 0.16 | Area reduction ratio of final rolling: 10%<br>Rolling end temperature: 950° C.<br>Accelerated cooling rate: 4° C./sec | Pearlite |
| | 17 | 17 | 1.04 | 0.41 | 0.76 | Cr: 0.21 | Area reduction ratio of final rolling: 5%<br>Rolling end temperature: 960° C.<br>Accelerated cooling rate: 5° C./sec | Pearlite |
| | 18 | 18 | 1.01 | 0.81 | 1.02 | B: 0.0015 | Area reduction ratio of final rolling: 10%<br>Rolling end temperature: 1000° C.<br>Accelerated cooling rate: 5° C./sec | Pearlite |
| | 19 | 19 | 0.91 | 0.26 | 0.61 | V: 0.03 | Area reduction ratio of final rolling: 5%<br>Rolling end temperature: 990° C.<br>Accelerated cooling rate: 5° C./sec | pearlite |
| | 20 | 20 | 0.94 | 0.71 | 0.75 | Cr: 0.44 | Area reduction ratio of final rolling: 5%<br>Rolling end temperature: 1020° C.<br>Accelerated cooling rate: 3° C./sec | Pearlite |
| | 21 | 21 | 1.20 | 1.15 | 0.60 | Ti: 0.0125<br>Al: 0.0300 | Area reduction ratio of final rolling: 5%<br>Rolling end temperature: 920° C.<br>Accelerated cooling rate: 8° C./sec | Pearlite |
| | 22 | 22 | 1.38 | 1.75 | 0.25 | Al: 0.15 | Reheating temperature: 1050° C.<br>Accelerated cooling rate: 6° C./sec | Pearlite |

TABLE 2-continued

| Classification of rail | Symbol | Number of pearlite blocks 1 to 15 μm in grain size (per 0.2 mm$^2$) Measurement position | Hardness of head portion (5 mm in depth from head surface) (Hv 10 kgf) | Amount of wear of head portion (g) | Tensile test result of head portion Total elongation (%) |
|---|---|---|---|---|---|
| Comparative rail | 13 | 380<br>5 mm in depth from head surface | 315 | Low carbon content, large wear<br>1.72 | 22.0 |
| | 14 | 205<br>3 mm in depth from head surface | 375 | 0.34 | Pro-eutectoid cementite formed → low ductility<br>8.9 |
| | 15 | 370<br>3 mm in depth from head surface | 435 | 0.90 | Excessive Si, structure embrittled, low ductility<br>12.0 |
| | 16 | 240<br>4 mm in depth from head surface | 528 | Martensite formed, large wear<br>2.45 | Martensite formed, low ductility<br>5.2 |
| | 17 | 155<br>3 mm in depth from head surface | 432 | 0.60 | Fine pearlite blocks decreased → low ductility<br>8.6 |
| | 18 | 102<br>2 mm in depth from head surface | 452 | 0.57 | Fine pearlite blocks decreased → low ductility<br>8.8 |
| | 19 | 95<br>1 mm in depth from head surface | 394 | 0.82 | Fine pearlite blocks decreased → low ductility<br>10.0 |
| | 20 | 56<br>3 mm in depth from head surface | 405 | 0.71 | Fine pearlite blocks decreased → low ductility<br>9.2 |
| | 21 | 175<br>7 mm in depth from head surface | 480 | 0.34 | Fine pearlite blocks decreased → low ductility<br>7.8 |
| | 22 | 56<br>9 mm in depth from head surface | 425 | 0.34 | Fine pearlite blocks decreased → low ductility<br>6.5 |

Note:
Balance of chemical composition is Fe and unavoidable impurities.

Example 2

Table 3 shows, regarding each of the steel rails according to the present invention, chemical composition, hot rolling and heat treatment conditions, the microstructure of a head portion at a depth of 5 mm from the surface thereof, the number and the measurement position of pearlite blocks having grain sizes in the range from 1 to 15 μm, and the hardness of a head portion at a depth of 5 mm from the surface thereof. Table 3 also shows the amount of wear of the material at a head portion after 700,000 repetition cycles of Nishihara wear test are imposed under the condition of forced cooling as shown in FIG. 4, and the result of tensile test at a head portion.

Table 4 shows, regarding each of the comparative steel rails, chemical composition, hot rolling and heat treatment conditions, the microstructure of a head portion at a depth of 5 mm from the surface thereof, the number and the measurement position of pearlite blocks having grain sizes in the range from 1 to 15 μm, and the hardness of a head portion at a depth of 5 mm from the surface thereof. Table 4 also shows the amount of wear of the material at a head portion after 700,000 repetition cycles of Nishihara wear test are imposed under the condition of forced cooling as shown in FIG. 4, and the result of tensile test at a head portion.

Note that any of the steel rails listed in Tables 3 and 4 was produced under the condition of an area reduction ratio of 6% at the final pass of finish hot rolling.

The rails listed in the tables are as follows:

Steel Rails According to the Present Invention (16 Rails), Symbols 23 to 38

The pearlitic steel rails excellent in wear resistance and ductility having chemical composition in the aforementioned ranges, characterized in that the number of the pearlite blocks having grain sizes in the range from 1 to 15 μm is 200 or more per 0.2 mm$^2$ of observation field at least in a part of the region down to a depth of 10 mm from the surface of the corners and top of a head portion.

Comparative Steel Rails (16 Rails), Symbols 39 to 54

Symbols 39 to 42 (4 rails): the comparative steel rails, wherein the amounts of C, Si, Mn in alloying were outside the respective ranges according to the claims of the present invention.

Symbol 43 (1 rail): the comparative steel rail having the rail length outside the range according to the claims of the present invention.

Symbols 44 and 47 (2 rails): the comparative steel rails, wherein a time period from the end of rolling to the beginning of accelerated cooling is outside the range according to the claims of the present invention.

Symbols 45, 46 and 48 (3 rails): the comparative steel rails, wherein an accelerated cooling rate at a head portion is outside the range according to the claims of the present invention.

Symbols 49 to 54 (6 rails): the comparative steel rails having the chemical composition in the aforementioned ranges, wherein the number of the pearlite blocks having grain sizes in the range from 1 to 15 μm is less than 200 per 0.2 $mm^2$ of observation field at least in a part of the region down to a depth of 10 mm from the surface of the corners and top of a head portion.

The tests were carried out under the same conditions as in Example 1.

As seen in Tables 3 and 4, in the cases of the steel rails according to the present invention in contrast to the cases of the comparative steel rails, pro-eutectoid cementite structures, pro-eutectoid ferrite structures, martensite structures and so on detrimental to the wear resistance and ductility of a rail did not form and the wear resistance and ductility were good as a result of controlling the amounts of C, Si, Mn in alloying, the rail lengths at the rolling and the time periods from the end of rolling to the beginning of accelerated cooling within the respective prescribed ranges.

In addition, as seen in Tables 3 and 4, in the cases of the steel rails according to the present invention in contrast to the cases of the comparative steel rails, the ductility of the rail-head portions improved as a result of controlling the numbers of the pearlite blocks having grain sizes in the range from 1 to 15 μm. Thus, it was possible to prevent the fractures such as breakage of a rail in cold regions.

TABLE 3

| Classification of rail | Symbol | Steel | Chemical composition (mass %) C | Si | Mn | Cr/Mo/V/Nb/B/Co/Cu/Ni/Ti/Mg/Ca/Al/Zr/N | Rail length at hot rolling (m) | Time from end of hot rolling to beginning of accelerated cooling (sec) | Accelerated cooling conditions of head portion Top: Cooling rate Bottom: Cooling end temperature |
|---|---|---|---|---|---|---|---|---|---|
| Invented rail | 23 | 23 | 0.65 | — | — | — | 198 | 198 | 9° C./sec<br>530° C. |
| | 24 | 24 | 0.68 | 0.25 | 0.80 | Ni: 0.15 | 189 | 185 | 5° C./sec<br>510° C. |
| | 25 | 25 | 0.75 | 0.15 | 1.31 | Cu: 0.15 | 165 | 170 | 4° C./sec<br>545° C. |
| | 26 | 26 | 0.80 | 0.30 | 0.98 | — | 175 | 185 | 7° C./sec<br>505° C. |
| | 27 | 27 | 0.85 | 0.45 | 1.00 | Mo: 0.02<br>Co: 0.21 | 150 | 180 | 4° C./sec<br>489° C. |
| | 28 | 28 | 0.87 | 0.52 | 1.15 | Mg: 0.0021<br>Ca: 0.0012 | 178 | 178 | 5° C./sec<br>475° C. |
| | 29 | 29 | 0.91 | 0.25 | 0.60 | V: 0.02<br>N: 0.0080 | 155 | 158 | 6° C./sec<br>515° C. |
| | 30 | 30 | 0.91 | 0.25 | 0.60 | V: 0.04 | 155 | 156 | 5° C./sec<br>500° C. |
| | 31 | 31 | 0.94 | 0.75 | 0.80 | Cr: 0.45 | 165 | 156 | 3° C./sec<br>520° C. |
| | 32 | 32 | 1.01 | — | — | — | 165 | 135 | 12° C./sec<br>450° C. |
| | 33 | 33 | 1.01 | 0.40 | 1.05 | Cr: 0.25 | 165 | 155 | 7° C./sec<br>450° C. |
| | 34 | 34 | 1.04 | 0.41 | 0.75 | Cr: 0.21 | 150 | 115 | 10° C./sec<br>485° C. |
| | 35 | 35 | 1.10 | 0.45 | 1.65 | Zr: 0.0015<br>Nb: 0.018 | 135 | 115 | 6° C./sec<br>485° C. |
| | 36 | 36 | 1.20 | 1.21 | 0.65 | Ti: 0.0130<br>Al: 0.0400 | 120 | 58 | 12° C./sec<br>465° C. |
| | 37 | 37 | 1.38 | 1.89 | 0.20 | Al: 0.18 | 110 | 25 | 18° C./sec<br>495° C. |
| | 38 | 38 | 1.38 | 0.15 | 0.20 | B: 0.012 | 100 | 15 | 25° C./sec<br>485° C. |

| Classification of rail | Symbol | Microstructure of head portion (5 mm in depth from head surface) | Number of pearlite blocks 1 to 15 μm in grain size (per 0.2 $mm^2$) Measurement position | Hardness of head portion (5 mm in depth from head surface) (Hv 10 kgf) | Amount of wear of head portion (g) | Tensile test result of head portion Total elongation (%) |
|---|---|---|---|---|---|---|
| Invented rail | 23 | Pearlite | 223<br>3 mm in depth from head surface | 305 | 1.45 | 22.5 |
| | 24 | Pearlite | 445<br>5 mm in depth from head surface | 335 | 1.35 | 23.5 |

TABLE 3-continued

| | | | | | |
|---|---|---|---|---|---|
| 25 | Pearlite | 231<br>4 mm in depth<br>from head surface | 358 | 1.24 | 18.6 |
| 26 | Pearlite | 285<br>8 mm in depth<br>from head surface | 395 | 1.15 | 14.0 |
| 27 | Pearlite | 351<br>6 mm in depth<br>from head surface | 405 | 1.08 | 16.5 |
| 28 | Pearlite | 405<br>3 mm in depth<br>from head surface | 415 | 0.91 | 16.2 |
| 29 | Pearlite | 325<br>1 mm in depth<br>from head surface | 405 | 0.83 | 15.0 |
| 30 | Pearlite | 242<br>1 mm in depth<br>from head surface | 385 | 0.85 | 14.8 |
| 31 | Pearlite | 268<br>3 mm in depth<br>from head surface | 389 | 0.75 | 13.0 |
| 32 | Pearlite | 225<br>2 mm in depth<br>from head surface | 398 | 0.65 | 10.8 |
| 33 | Pearlite | 305<br>2 mm in depth<br>from head surface | 448 | 0.60 | 11.8 |
| 34 | Pearlite | 285<br>3 mm in depth<br>from head surface | 432 | 0.60 | 12.0 |
| 35 | Pearlite | 376<br>3 mm in depth<br>from head surface | 462 | 0.50 | 10.5 |
| 36 | Pearlite | 345<br>2 mm in depth<br>from head surface | 488 | 0.38 | 10.2 |
| 37 | Pearlite | 407<br>3 mm in depth<br>from head surface | 489 | 0.31 | 10.2 |
| 38 | Pearlite | 305<br>3 mm in depth<br>from head surface | 465 | 0.35 | 10.0 |

Note:
Balance of chemical composition is Fe and unavoidable impurities.

TABLE 4

| | | | Chemical composition (mass %) | | | | Rail | Time from end of hot rolling to beginning | Accelerated cooling conditions of head portion Top: Cooling | Microstructure of |
|---|---|---|---|---|---|---|---|---|---|---|
| Classification of rail | Symbol | Steel | C | Si | Mn | Cr/Mo/V/Nb/B/Co/Cu/Ni/Ti/Mg/Ca/Al/Zr/N | length at hot rolling (m) | of accelerated cooling (sec) | rate Bottom: Cooling end temperature | head portion (5 mm in depth from head surface) |
| Comparative rail | 39 | 39 | 0.60 | 0.25 | 0.80 | Ni: 0.12 | 150 | 198 | 3° C./sec<br>550° C. | Pearlite + pro-eutectoid ferrite |
| | 40 | 40 | 1.45 | 1.75 | 0.20 | Al: 0.18 | 105 | 100 | 5° C./sec<br>520° C. | Peerlite + pro-eutectoid cementite |
| | 41 | 41 | 0.87 | 2.15 | 1.16 | Mg: 0.0015<br>Ca: 0.0012 | 155 | 160 | 5° C./sec<br>480° C. | Pearlite |
| | 42 | 42 | 0.75 | 0.16 | 2.25 | Cu: 0.16 | 165 | 180 | 4° C./sec<br>480° C. | Pearlite + martensite |
| | 43 | 34 | 1.04 | 0.41 | 0.75 | Cr: 0.21 | 250<br>(Excessive rail length) | 115 | 10° C./sec<br>485° C. | Pearlite + pro-eutectiod cementite |
| | 44 | 36 | 1.20 | 1.21 | 0.65 | Ti: 0.0130<br>Al: 0.0400 | 120 | 265 | 12° C./sec<br>465° C. | Pearlite + trace Pro-eutectoid cementite at rail ends |

TABLE 4-continued

| | | | | | | | | | | |
|---|---|---|---|---|---|---|---|---|---|---|
| | 45 | 35 | 1.10 | 0.45 | 1.65 | Zr: 0.0015<br>Nb: 0.018 | 110 | 115 | 0.5° C./sec<br>485° C. | Pearlite + trace pro-eutectoid cementite |
| | 46 | 30 | 0.91 | 0.25 | 0.60 | V: 0.04 | 155 | 156 | 35° C./sec<br>500° C. | Pearlite + martensite |

| | Classification of rail | Symbol | Number of pearlite blocks 1 to 15 μm in grain size (per 0.2 mm$^2$) Measurement position | Hardness of head portion (5 mm in depth from head surface) (Hv 10 kgf) | Amount of wear of head portion (g) | Tensile test result of head portion Total elongation (%) |
|---|---|---|---|---|---|---|
| | Comparative rail | 39 | 250<br>2 mm in depth from head surface | 315 | Lowest carbon content, large wear<br>1.72 | 22.0 |
| | | 40 | 205<br>3 mm in depth from head surface | 375 | 0.34 | Pro-eutectoid cementite formed → low ductility<br>8.2 |
| | | 41 | 320<br>3 mm in depth from head surface | 435 | 0.90 | Excessive Si, structure embrittled, low ductility<br>9.0 |
| | | 42 | 222<br>4 mm in depth from head surface | 528 | Martensite formed, large wear<br>2.45 | Martensite formed, low ductility<br>5.2 |
| | | 43 | 225<br>3 mm in depth from head surface | 402 | Pro-eutectoid cementite formed, large wear<br>1.85 | Pro-eutectoid martensite formed, low ductility<br>7.8 |
| | | 44 | 215<br>2 mm in depth from head surface | 478 | Pro-eutectoid cementite formed, large wear<br>1.80 | Pro-eutectoid martensite formed, low ductility<br>6.9 |
| | | 45 | 256<br>3 mm in depth from head surface | 389 | 0.98 | Trace pro-eutectoid martensite formed, low ductility<br>7.2 |
| | | 46 | 286<br>1 mm in depth from head surface | 548 | Martensite formed, large wear<br>2.25 | Martensite formed, low ductility<br>5.0 |

Note:
Balance of chemical composition is Fe and unavoidable impurities.

TABLE 5

| | | | Chemical composition (mass %) | | | | | | | |
|---|---|---|---|---|---|---|---|---|---|---|
| Classification of rail | Symbol | Steel | C | Si | Mn | Cr/Mo/V/Nb/B/Co/Cu/Ni/Ti/Mg/Ca/Al/Zr/N | Rail length at hot rolling (m) | Time from end of hot rolling to beginning of accelerated Cooling (sec) | Accelerated cooling conditions of head portion Top: Cooling rate Bottom: Cooling end temperature | Microstructure of head portion (5 mm in depth from head surface) |
| Comparative rail | 47 | 23 | 0.65 | — | — | — | 198 | 300 | 9° C./sec<br>530° C. | Pearlite |
| | 48 | 31 | 0.94 | 0.75 | 0.80 | Cr: 0.45 | 165 | 156 | 0.5° C./sec<br>520° C. | Pearlite |
| | 49 | 29 | 0.91 | 0.25 | 0.60 | V: 0.02<br>N: 0.0080 | 155 | 215 | 6° C./sec<br>515° C. | Pearlite |
| | 50 | 32 | 1.01 | — | — | — | 165 | 205 | 12° C./sec<br>450° C. | Pearlite |

TABLE 5-continued

| | | | | | | | | | |
|---|---|---|---|---|---|---|---|---|---|
| 51 | 33 | 1.01 | 0.40 | 1.05 | Cr: 0.25 | 165 | 235 | 7° C./sec 450° C. | Pearlite |
| 52 | 35 | 1.10 | 0.45 | 1.65 | Zr: 0.0015 Nb: 0.018 | 135 | 225 | 8° C./sec 485° C. | Pearlite |
| 53 | 36 | 1.20 | 1.21 | 0.65 | Ti: 0.0130 Al: 0.0400 | 120 | 221 | 12° C./sec 465° C. | Pearlite |
| 54 | 37 | 1.38 | 1.89 | 0.20 | Al: 0.18 | 110 | 201 | 18° C./sec 495° C. | Pearlite |

| Classification of rail | Symbol | Number of pearlite blocks 1 to 15 μm in grain size (per 0.2 mm$^2$) Measurement position | Hardness of head portion (5 mm in depth from head surface) (Hv 10 kgf) | Amount of wear of head portion (g) | Tensile test result of head portion Total elongation (%) |
|---|---|---|---|---|---|
| Comparative rail | 47 | 152 3 mm in depth from head surface | 302 | 1.46 | Pearlite block coarsened → low ductility 18.5 |
| | 48 | 150 3 mm in depth from head surface | 280 Softened, pearlite coarsened | 1.25 | Pearlite block coarsened → low ductility 10.5 |
| | 49 | 235 1 mm in depth from head surface | 405 | 0.83 | Fine pearlite blocks decreased → low ductility 13.5 |
| | 50 | 205 2 mm in depth from head surface | 398 | 0.66 | Fine pearlite blocks decreased → low ductility 10.0 |
| | 51 | 210 2 mm in depth from head surface | 448 | 0.60 | Fine pearlite blocks decreased → low ductility 10.6 |
| | 52 | 234 3 mm in depth from head surface | 462 | 0.51 | Fine pearlite blocks decreased → low ductility 9.8 |
| | 53 | 215 2 mm in depth from head surface | 480 | 0.39 | Fine pearlite blocks decreased → low ductility 9.5 |
| | 54 | 251 3 mm in depth from head surface | 480 | 0.34 | Fine pearlite blocks decreased → low ductility 9.2 |

Note:
Balance of chemical composition is Fe and unavoidable impurities.

Example 3

The same tests as in Examples 1 and 2 were carried out using the steel rails of Example 2 shown in Table 3 and changing the time period from the end of rolling to the beginning of accelerated cooling and the hot rolling conditions as shown in Table 6.

As is clear from Table 6, total elongation was further improved in the cases where the time periods from the end of rolling to the beginning of accelerated cooling were not longer than 200 sec., 2 or more passes of the finish hot rolling were applied, and the times between rolling passes were not longer than 10 sec.

TABLE 6

| Classification of rail | Symbol | Steel | Rail length at hot rolling (m) | Time from end of hot rolling to beginning of accelerated cooling (sec) | Hot rolling conditions: 3 passes to final % | Time between passes sec | 2 passes to final % | Time between passes sec | 1 pass to final % | Time between passes sec | Final pass % | Rolling end temperature ° C. |
|---|---|---|---|---|---|---|---|---|---|---|---|---|
| Invented rail | 55 | 23 | 198 | 198 | | | — | | | | 6 | 980 |
| | 56 | 29 | 155 | 158 | | | — | | | | 8 | 980 |
| | 57 | 29 | 155 | 158 | | | — | | | | 9 | 870 |

TABLE 6-continued

| | | | | | | | | | | | |
|---|---|---|---|---|---|---|---|---|---|---|---|
| 58 | 29 | 155 | 158 | — | | 20 | 6 | 2 | 1 | 9 | 980 |
| 59 | 31 | 165 | 156 | | | | — | | | 8 | 960 |
| 60 | 32 | 165 | 135 | | | 8 | 8 | 8 | 3 | 10 | 980 |
| 61 | 33 | 165 | 155 | | | | — | | | 7 | 950 |
| 62 | 33 | 165 | 155 | — | | 20 | 7 | 2 | 1 | 7 | 950 |
| 63 | 33 | 165 | 155 | 10 | 1 | 8 | 1 | 8 | 1 | 7 | 950 |

| Classification of rail | Symbol | Accelerated cooling conditions of head portion Top: Cooling rate Bottom: Cooling end temperature | Microstructure of head portion (5 mm in depth from head surface) | Number of pearlite blocks 1 to 15 μm in grain size (per 0.2 $mm^2$) Measurement position | Hardness of head portion (5 mm in depth from head surface) (Hv 10 kgf) | Amount of wear of head portion (g) | Tensile test result of head portion Total elongation (%) |
|---|---|---|---|---|---|---|---|
| Invented rail | 55 | 9° C./sec 530° C. | Pearlite | 253 3 mm in depth from head surface | 305 | 1.45 | 24.5 |
| | 56 | 6° C./sec 515° C. | Pearlite | 355 1 mm in depth from head surface | 385 | 0.88 | 15.1 |
| | 57 | 6° C./sec 515° C. | Pearlite | 385 1 mm in depth from head surface | 385 | 0.88 | 15.4 |
| | 58 | 6° C./sec 515° C. | Pearlite | 380 1 mm in depth from head surface | 385 | 0.88 | 15.2 |
| | 59 | 2° C./sec 520° C. | Pearlite | 298 3 mm in depth from head surface | 380 | 0.80 | 13.3 |
| | 60 | 12° C./sec 450° C. | Pearlite | 285 2 mm in depth from head surface | 398 | 0.65 | 11.3 |
| | 61 | 7° C./sec 450° C. | Pearlite | 335 2 mm in depth from head surface | 448 | 0.64 | 12.0 |
| | 62 | 7° C./sec 450° C. | Pearlite | 355 2 mm in depth from head surface | 448 | 0.64 | 12.2 |
| | 63 | 7° C./sec 450° C. | Pearlite | 385 2 mm in depth from head surface | 448 | 0.64 | 12.5 |

TABLE 7

| Classification of rail | Symbol | Steel | Rail length at hot rolling (m) | Time from end of hot rolling to beginning of accelerated cooling (sec) | Hot rolling conditions: 3 passes to final % | Time between passes sec | 2 passes to final % | Time between passes sec | 1 pass to final % | Time between passes sec | Final pass % | Rolling end temperature ° C. |
|---|---|---|---|---|---|---|---|---|---|---|---|---|
| Invented rail | 64 | 35 | 135 | 115 | | | 18 | 7 | 3 | 1 | 7 | 920 |
| | 65 | 35 | 135 | 115 | 8 | 1 | 8 | 1 | 8 | 1 | 7 | 920 |
| | 66 | 36 | 120 | 58 | | | | — | | | 10 | 900 |
| | 67 | 37 | 110 | 25 | 8 | 0.5 | 8 | 0.5 | 8 | 0.5 | 12 | 930 |
| | 68 | 29 | 155 | 158 | | | | — | | | 5 | 980 |
| | 69 | 33 | 165 | 155 | — | | 20 | 15 | 2 | 15 | 7 | 950 |
| | 70 | 33 | 165 | 155 | 10 | 2 | 8 | 3 | 8 | 20 | 5 | 950 |

TABLE 7-continued

| Classification of rail | Symbol | Accelerated cooling conditions of head portion Top: Cooling rate Bottom: Cooling end temperature | Microstructure of head portion (5 mm in depth from head surface) | Number of pearlite blocks 1 to 15 μm in grain size (per 0.2 mm$^2$) Measurement position | Hardness of head portion (5 mm in depth from head surface) (Hv 10 kgf) | Amount of wear of head portion (g) | Tensile test result of head portion Total elongation (%) |
|---|---|---|---|---|---|---|---|
| Invented rail | 64 | 8° C./sec 485° C. | Pearlite | 398 3 mm in depth from head surface | 462 | 0.50 | 10.8 |
| | 65 | 8° C./sec 485° C. | Pearlite | 435 3 mm in depth from head surface | 462 | 0.50 | 11.5 |
| | 66 | 12° C./sec 465° C. | Pearilte | 385 2 mm in depth from head surface | 488 | 0.38 | 10.8 |
| | 67 | 18° C./sec 495° C. | Pearlite | 487 3 mm in depth from head surface | 489 | 0.31 | 10.6 |
| | 68 | 6° C./sec 515° C. | Pearlite | 245 1 mm in depth from head surface | 385 | 0.88 | 13.1 (Small area reduction ratio) |
| | 69 | 7° C./sec 450° C. | Pearlite | 265 2 mm in depth from head surface | 448 | 0.64 | 11.0 (Long time between passes) |
| | 70 | 7° C./sec 450° C. | Pearlite | 235 2 mm in depth from head surface | 448 | 0.64 | 10.5 (Small area reduction ratio) (Long time between passes) |

Example 4

Table 8 shows, regarding each of the steel rails according to the present invention, chemical composition, the value of CE calculated from the equation (1) composed of the chemical composition, the production conditions of a casting before rolling, the cooling method at the heat treatment of a rail, and the microstructure and the state of pro-eutectoid cementite structure formation at a web portion.

Tables 9 and 10 shows, regarding each of the comparative steel rails, chemical composition, the value of CE calculated from the equation (1) composed of the chemical composition, the production conditions of a casting before rolling, the cooling method at the heat treatment of a rail, and the microstructure and the state of pro-eutectoid cementite structure formation at a web portion.

Note that each of the steel rails listed in Tables 8, 9 and 10 was produced under the conditions of a time period of 180 sec. from hot rolling to heat treatment at the railhead portion and an area reduction ratio of 6% at the final pass of finish hot rolling.

In each of those rails, the number of the pearlite blocks having grain sizes in the range from 1 to 15 μm at a portion 5 mm in depth from the head top portion was in the range from 200 to 500 per 0.2 mm$^2$ of observation field.

The rails listed in the tables are as follows:

Steel Rails According to the Present Invention (12 Rails), Symbols 71 to 82

The rails having the chemical composition in the aforementioned ranges, wherein the amount of formed pro-eutectoid cementite structures is reduced at the web portion of a rail, characterized in that the number of pro-eutectoid cementite network (NC) at a web portion does not exceed the value of CE calculated from the contents of the aforementioned chemical composition.

Comparative Steel Rails (11 Rails), Symbols 83 to 93

Symbols 83 to 88 (6 rails): the comparative steel rails, wherein the amounts of C, Si, Mn, P, S and Cr in alloying are outside the respective ranges according to the claims of the present invention.

Symbols 89 to 93 (5 rails): the comparative steel rails having the chemical composition in the aforementioned ranges, wherein the number of pro-eutectoid cementite network (NC) at a web portion exceeds the value of CE calculated from the contents of the aforementioned chemical composition.

Here, explanations are given regarding the drawings attached hereto. Reference numeral 5 (the region shaded with oblique lines) in FIG. 1 indicates the region in which pro-eutectoid cementite structures form along segregation bands. FIG. 2 is a schematic representation showing the method of evaluating the formation of pro-eutectoid cementite network.

As seen in Tables 8, 9 and 10, in the cases of the steel rails according to the present invention in contrast to the cases of the comparative steel rails, the number of the pro-eutectoid cementite network (the number of intersecting cementite network, NC) forming at a web portion was reduced to the value of CE or less as a result of controlling the addition amounts of C, Si, Mn, P, S and Cr within the respective prescribed ranges.

In addition, the number of the pro-eutectoid cementite network (the number of intersecting cementite network, NC) forming at a web portion was reduced to the value of CE or less also as a result of optimizing the soft reduction during casting and applying cooling to the web portion.

As stated above, the number of the pro-eutectoid cementite network (the number of intersecting cementite network, NC) forming at a web portion was reduced to the value of CE or less as a result of controlling the addition amounts of C, Si, Mn, P, S and Cr within the respective prescribed ranges and, in addition, optimizing the soft reduction during casting and applying cooling to the web portion. Thus it was possible to prevent the deterioration of toughness at the web portion of a rail.

TABLE 8

| Classification of rail | Symbol | Chemical composition (mass %) C | Si | Mn | P | S | Cr | Mo/V/Nb/B/Co/Cu/Ni/Ti/Mg/Ca/Al/Zr/N | CE *1 | Casting conditions and cooling method at rail heat treatment | Microstructure of web portion *2 | Formation of pro-eutectoid cementite structure in web portion *3 Number of pro-eutectoid cementite network (NC) |
|---|---|---|---|---|---|---|---|---|---|---|---|---|
| Invented rail | 71 | 0.86 | 0.25 | 1.02 | 0.015 | 0.010 | 0.21 | N: 0.0085 | 20 | Optimization of light thickness reduction during casting | Pearlite + trace pro-eutectoid cementite | 16 |
| | 72 | 0.90 | 0.15 | 0.65 | 0.028 | 0.015 | 0.25 | | 27 | Optimization of light thickness reduction during casting | Pearlite + trace pro-eutectoid cementite | 25 |
| | 73 | 0.93 | 0.56 | 1.75 | 0.015 | 0.011 | 0.10 | Ni: 0.20 | 25 | Optimization of light thickness reduction during casting | Pearlite + trace pro-eutectoid cementite | 20 |
| | 74 | 0.95 | 0.80 | 0.11 | 0.011 | 0.010 | 0.78 | | 26 | Optimization of light thickness reduction during casting | Pearlite + trace pro-eutectoid cementite | 21 |
| | 75 | 0.98 | 0.40 | 0.70 | 0.018 | 0.024 | 0.25 | | 26 | Optimization of light thickness reduction during casting | Pearlite + trace pro-eutectoid cementite | 22 |
| | 76 | 1.00 | 1.35 | 0.45 | 0.012 | 0.008 | 0.15 | Co: 0.15<br>Mo: 0.03 | 8 | Optimization of light thickness reduction during casting<br>Cooling of web portion | Pearlite + trace pro-eutectoid cementite | 5 |
| | 77 | 1.05 | 0.50 | 1.00 | 0.008 | 0.010 | 0.35 | Al: 0.10<br>Cu: 0.25 | 29 | Cooling of web portion | Pearlite + trace pro-eutectoid cementite | 27 |
| | 78 | 1.10 | 1.25 | 0.65 | 0.010 | 0.015 | 0.12 | Mg: 0.0015<br>Ca: 0.0015 | 15 | Optimization of light thickness reduction during casting<br>Cooling of web portion | Pearlite + trace pro-eutectoid cementite | 10 |
| | 79 | 1.13 | 0.80 | 0.95 | 0.012 | 0.019 | 0.06 | B: 0.0012<br>Ti: 0.0120 | 24 | Cooling of web portion | Pearlite + trace pro-eutectoid cementite | 18 |
| | 80 | 1.15 | 0.70 | 0.45 | 0.012 | 0.009 | 0.15 | Nb: 0.011<br>V: 0.02 | 23 | Cooling of web portion | Pearlite + trace pro-eutectoid cementite | 18 |
| | 81 | 1.19 | 1.80 | 0.55 | 0.011 | 0.012 | 0.08 | Zr: 0.0015<br>Al: 0.05 | 13 | Optimization of light thickness reduction during casting<br>Cooling of web portion | Pearlite + trace pro-eutectoid cementite | 7 |
| | 82 | 1.35 | 1.51 | 0.35 | 0.012 | 0.012 | 0.15 | | 26 | Optimization of light thickness reduction during casting<br>Cooling of web portion | Pearlite + trace pro-eutectoid cementite | 22 |

Note:

Balance of chemical composition is Fe and unavoidable impurities.

*1: CE = 60[mass % C] − 10[mass % Si] + 10[mass % Mn] + 500[mass % P] + 50[mass % S] + 30[mass % Cr] − 54

*2: Portion at the center of web centerline is observed with an optical microscope.

*3: Portion where pro-eutectoid cementite structures are exposed at the center of web centerline is observed with an optical microscope, and number of intersections of pro-eutectoid cementite network with two line segments each 300 μm in length crossing each other at right angles is counted under a magnification of 200 (see FIG. 2). Number of intersecting pro-eutectoid cementite network is defined as the total of the intersections on the two line segments.

TABLE 9

| Classification of rail | Symbol | Chemical composition (mass %) C | Si | Mn | P | S | Cr | Mo/V/Nb/B/Co/Cu/Ni/Ti/Mg/Ca/Al/Zr/ | CE *1 | Casting conditions and cooling method at rail heat treatment | Microstructure of web portion *2 | Formation of pro-eutectoid cementite structure in web portion *3 Number of pro-eutectoid cementite network (NC) |
|---|---|---|---|---|---|---|---|---|---|---|---|---|
| Comparative rail | 83 | 1.45 | 1.70 | 0.45 | 0.015 | 0.012 | 0.08 | Zr: 0.0020<br>Al: 0.04 | 31 | Optimization of light thickness reduction during casting<br>Cooling of web portion | Pearlite + trace pro-eutectoid cementite | 39<br>Excessive segregation in web portions<br>Excessive cementite formation |
| | 84 | 1.00 | 2.51 | 0.51 | 0.015 | 0.015 | 0.25 | Co: 0.25 | 2 | Optimization of light thickness reduction during casting<br>Cooling of web portion | Pearlite + trace pro-eutectoid cementite | 2 |
| | 85 | 0.93 | 0.50 | 2.85 | 0.015 | 0.020 | 0.15 | | 38 | Optimization of light thickness reduction during casting | Pearlite + trace pro-eutectoid cementite | 45<br>Excessive segregation in web portion,<br>Excessive cementite formation |
| | 86 | 0.90 | 0.25 | 0.68 | 0.035 | 0.015 | 0.25 | | 30 | Optimization of light thickness reduction during casting | Pearlite + trace pro-eutectoid cementite | 35<br>Excessive segregation in web portion,<br>Excessive cementite formation |
| | 87 | 0.98 | 0.42 | 0.65 | 0.019 | 0.032 | 0.25 | | 26 | Optimization of light thickness reduction during casting | Pearlite + trace pro-eutectoid cementite | 35<br>Excessive segregation in web portion,<br>Excessive cementite formation |
| | 88 | 0.95 | 0.75 | 0.15 | 0.012 | 0.015 | 1.25 | | 41 | Optimization of light thickness reduction during casting | Pearlite + trace pro-eutectoid cementite | 58<br>Excessive segregation in web portion,<br>Excessive cementite formation |
| | 89 | 0.98 | 0.40 | 0.70 | 0.018 | 0.024 | 0.25 | | 26 | No control of light thickness reduction during casting<br>No cooling of web portion at heat treatment | Pearlite + trace pro-eutectoid cementite | 34<br>Excessive pro-eutectoid cementite formation |
| | 90 | 1.05 | 0.50 | 1.00 | 0.008 | 0.010 | 0.35 | Al: 0.10<br>Cu: 0.25 | 29 | No control of light thickness reduction during casting<br>No cooling of web portion at heat treatment | Pearlite + trace pro-eutectoid cementite | 32<br>Excessive pro-eutectoid cementite formation |

Note:

Balance of chemical composition is Fe and unavoidable impurities.

*1: CE = 60[mass % C] − 10[mass % Si] + 10[mass % Mn] + 500[mass % P] + 50[mass % S] + 30[mass % Cr] − 54

*2: Portion at the center of web centerline is observed with an optical microscope.

*3: Portion where pro-eutectoid cementite structures are exposed at the center of web centerline is observed with an optical microscope, and number of intersections of pro-eutectoid cementite network with two line segments each 300 μm in length crossing each other at right angles is counted under a magnification of 200 (see FIG. 2). Number of intersecting pro-eutectoid cementite network is defined as the total of the intersections on the two line segments.

TABLE 10

| Classification of rail | Symbol | Chemical composition (mass %) C | Si | Mn | P | S | Cr | Mo/V/Nb/B/Co/Cu/Ni/Ti/Mg/Ca/Al/Zr | CE *1 | Casting conditions and cooling method at rail heat treatment | Microstructure of web portion *2 | Formation of pro-eutectoid cementite structure in web portion *3 Number of pro-eutectoid cementite network (NC) |
|---|---|---|---|---|---|---|---|---|---|---|---|---|
| Comparative rail | 91 | 1.10 | 1.25 | 0.65 | 0.010 | 0.015 | 0.12 | Mg: 0.0015<br>Ca: 0.0015 | 15 | No control of light thickness reduction during casting<br>No cooling of web portion at heat treatment | Pearlite + trace pro-eutectoid cemantite | 22<br>Excessive pro-eutectoid cementite formation |

TABLE 10-continued

| Classification of rail | Symbol | Chemical composition (mass %) C | Si | Mn | P | S | Cr | Mo/V/Nb/B/Co/Cu/Ni/Ti/Mg/Ca/Al/Zr | CE *1 | Casting conditions and cooling method at rail heat treatment | Microstructure of web portion *2 | Formation of pro-eutectoid cementite structure in web portion *3 Number of pro-eutectoid cementite network (NC) |
|---|---|---|---|---|---|---|---|---|---|---|---|---|
| | 92 | 1.15 | 0.70 | 0.45 | 0.012 | 0.009 | 0.15 | Nb: 0.011 v: 0.02 | 23 | No control of light thickness reduction during casting No cooling of web portion at heat treatment | Pearlite + trace pro-eutectoid cementite | 28 Excessive pro-eutectoid cementite formation |
| | 93 | 1.35 | 1.51 | 0.35 | 0.012 | 0.012 | 0.15 | | 26 | No control of light thickness reduction during casting No cooling of web portion at heat treatment | Pearlite + trace pro-eutectoid cementite | 32 Excessive pro-eutectoid cementite formation |

Note:

Balance of chemical composition is Fe and unavoidable impurities.

*1: CE = 60[mass % C] − 10[mass % Si] + 10[mass % Mn] + 500[mass % P] + 50[mass % S] + 30[mass % Cr] − 54

*2: Portion at the center of web centerline is observed with an optical microscope.

*3: portion where pro-eutectoid cementite structures are exposed at the center of web centerline is observed with an optical microscope, and number of intersections of pro-eutectoid cementite network with two line segments each 300 μm in length crossing each other at right angles is counted under a magnification of 200 (see FIG. 2). Number of intersecting pro-eutectoid cementite network is defined as the total of the intersections on the two line segments.

Example 5

Table 11 shows the chemical composition of the steel rails subjected to the tests below. Note that the balance of the chemical composition specified in the table is Fe and unavoidable impurities.

Tables 12 and 13 show, regarding each of the rails produced by the production method according to the present invention using the steels listed in Table 11, the final rolling temperature, the rolling length, the time period from the end of rolling to the beginning of accelerated cooling, the conditions of accelerated cooling at the head, web and base portions of a rail, the microstructure, the number and the measurement position of pearlite blocks having grain sizes in the range from 1 to 15 μm, the result of drop weight test, the hardness at a head portion, and the value of total elongation in the tensile test of a head portion.

Tables 14 and 15 show, regarding each of the rails produced by comparative production methods using the steels listed in Table 11, the final rolling temperature, the rolling length, the time period from the end of rolling to the beginning of accelerated cooling, the conditions of accelerated cooling at the head, web and base portions of a rail, the microstructure, the number and the measurement position of pearlite blocks having grain sizes in the range from 1 to 15 μm, the result of drop weight test, the hardness at a head portion, and the value of total elongation in the tensile test of a head portion.

The rails listed in the tables are as follows:

Heat-treated Rails According to the Present Invention (11 rails), Symbols 94 to 104

The rails produced under the production conditions in the aforementioned ranges using the steels having the chemical composition in the aforementioned ranges.

Comparative Heat-treated Rails (8 Rails), Symbols 105 to 112

The rails produced under the production conditions outside the aforementioned ranges using the steels having chemical composition in the aforementioned ranges.

Note that each of the steel rails listed in Tables 12 to 15 were produced under the condition of an area reduction ratio of 6% at the final pass of finish hot rolling.

The tests were carried out under the following conditions:

Drop Weight Test

Mass of falling weight: 907 kg

Distance between supports: 0.914 m

Dropping height: 10.6 m

Test temperature: Room temperature (20° C.)

Test specimen position: HT, tensile stress on railhead portion; BT, tensile stress on rail base portion Tensile Test of a Head Portion Test equipment: Compact universal tensile tester Test piece shape: JIS No. 4 test piece equivalent; parallel portion length, 25 mm; parallel portion diameter, 6 mm; gauge length for measurement of elongation, 21 mm Test piece machining position: 5 mm in depth from the surface of a railhead top portion in the center of the width Strain speed: 10 mm/min.

Test temperature: Room temperature (20° C.)

As seen in Tables 12 to 15, in the steel rails having high carbon contents as listed in Table 11, in the cases of the steel rails produced by the production method according to the present invention wherein accelerated cooling was applied to the head, web and base portions of a rail within a prescribed time period after the end of hot rolling, in contrast to the cases of the steel rails produced by comparative production methods, it was possible to suppress the formation of pro-eutectoid cementite structures and thus prevent the deterioration of fatigue strength and toughness.

In addition, as seen in Tables 12 to 15, it was possible to secure a good wear resistance at a railhead portion, the uniformity of the material quality of a rail in the longitudinal direction, and a good ductility at a railhead portion as a result of controlling the accelerated cooling rate at a railhead portion, optimizing a rolling length, and controlling a final rolling temperature.

As stated above, in a steel rail a having a high carbon content, it was made possible: to suppress the formation of pro-eutectoid cementite structures detrimental to the occurrence of fatigue cracks and brittle cracks by applying accelerated cooling to the head, web and base portions of the rail within a prescribed time period after the end of hot rolling in an attempt to suppress the formation of pro-eutectoid cementite structures in the head, web and base portions of the rail; and also to secure a good wear resistance at the railhead portion, the uniformity of the material quality of the rail in the longitudinal direction, and a good ductility at the railhead portion by optimally selecting an accelerated cooling rate at the railhead portion, a rail length at rolling, and a final rolling temperature.

TABLE 11

| Steel | Chemical composition (mass %) C | Si/Mn/Cr/Mo/V/Nb/B/Co/Cu/Ni/Ti/Mg/Ca/Al/Zr/N |
|---|---|---|
| 43 | 0.86 | Si: 0.35<br>Mn: 1.00 |
| 44 | 0.90 | Si: 0.25<br>Mn: 0.80<br>Mo: 0.02 |
| 45 | 0.95 | Si: 0.81<br>Mn: 0.42<br>Cr: 0.54 |

TABLE 11-continued

| Steel | Chemical composition (mass %) C | Si/Mn/Cr/Mo/V/Nb/B/Co/Cu/Ni/Ti/Mg/Ca/Al/Zr/N |
|---|---|---|
| 46 | 1.00 | |
| 47 | 1.00 | Si: 0.55 Cu: 0.35<br>Mn: 0.69<br>Cr: 0.21 |
| 48 | 1.01 | Si: 0.75 V: 0.030<br>Mn: 0.45 N: 0.010<br>Cr: 0.45 |
| 49 | 1.11 | Si: 1.35 Zr: 0.0017<br>Mn: 0.31<br>Cr: 0.34 |
| 50 | 1.19 | Si: 0.58 Al: 0.08<br>Mn: 0.58<br>Cr: 0.20 |
| 51 | 1.35 | Si: 0.45 N: 0.0080<br>Mn: 0.35<br>Cr: 0.15 |

TABLE 12

| | Symbol | Steel | Rolling end temperature of head portion *1 (° C.) | Rolling length (m) | Time from end of hot rolling to beginning of accelerated cooling (sec) | | Accelerated cooling conditions *2: Accelerated cooling rate (° C./sec) | Accelerated cooling conditions *2: Accelerated cooling end temperature (° C.) |
|---|---|---|---|---|---|---|---|---|
| Invented production method | 94 | 43 | 1000 | 200 | Head portion | 200 | 1.0 | 640 |
| | | | | | Web portion | 200 | 1.5 | 645 |
| | | | | | Base portion | 200 | 1.2 | 642 |
| | 95 | 44 | 980 | 200 | Head portion | 190 | 1.2 | 648 |
| | | | | | Web portion | 190 | 1.8 | 645 |
| | | | | | Base portion | 190 | 1.8 | 632 |
| | 96 | 45 | 960 | 150 | Head portion | 185 | 2.0 | 630 |
| | | | | | Web portion | 165 | 2.5 | 605 |
| | | | | | Base portion | 165 | 2.5 | 600 |
| | 97 | 45 | 960 | 125 | Head portion | 165 | 6.0 | 450 |
| | | | | | Web portion | 165 | 3.0 | 570 |
| | | | | | Base portion | 165 | 4.5 | 560 |
| | 98 | 46 | 950 | 150 | Head portion | 145 | 8.0 | 450 |
| | | | | | Web portion | 145 | 3.0 | 560 |
| | | | | | Base portion | 148 | 4.5 | 530 |
| | 99 | 47 | 950 | 150 | Head portion | 150 | 7.5 | 465 |
| | | | | | Web portion | 150 | 3.5 | 540 |
| | | | | | Base portion | 150 | 5.0 | 530 |

| | Symbol | Microstructure *3 | Number of pearlite blocks 1 to 15 μm in grain size (per 0.2 mm$^2$) Measurement position | Drop weight test *4 HT: Head tension BT: Base tension | Hardness of head portion *5 (Hv) | Total elongation in tensile test of head portion *6 (%) |
|---|---|---|---|---|---|---|
| Invented production method | 94 | Pearlite | 215 (2 mm in depth from head surface) | HT: No fracture<br>BT: No fracture | 330 | 14.0 |
| | | Pearlite | — | | | |
| | | Pearlite | — | | | |

TABLE 12-continued

| | | | | | | |
|---|---|---|---|---|---|---|
| | 95 | Pearlite | 220 (2 mm in depth from head surface) | HT: No fracture BT: No fracture | 320 | 13.0 |
| | | Pearlite | — | | | |
| | | Pearlite | — | | | |
| | 96 | Pearlite | 235 (2 mm in depth from head surface) | HT: No fracture BT: No fracture | 365 | 12.5 |
| | | Pearlite | — | | | |
| | | Pearlite | — | | | |
| | 97 | Pearlite | 255 (2 mm in depth from head surface) | HT: No fracture BT: No fracture | 435 | 13.4 |
| | | Pearlite | — | | | |
| | | Pearlite | — | | | |
| | 98 | Pearlite | 215 (2 mm in depth from head surface) | HT: No fracture BT: No fracture | 405 | 10.2 |
| | | Pearlite | — | | | |
| | | Pearlite | — | | | |
| | 99 | Pearlite | 226 (2 mm in depth from head surface) | HT: No fracture BT: No fracture | 440 | 10.5 |
| | | Pearlite | — | | | |
| | | Pearlite | — | | | |

*1: Rolling end temperature of head portion is surface temperature immediately after rolling.

*2: Cooling rates of head, web and base portions are average figures in the region 0 to 3 mm in depth at the positions specified in description.

*3: Microstructures of head, web and base portions are observed at a depth of 2 mm at the same positions as specified in above cooling rate measurement.

*4: Drop weight test method is specified in description.

*5: Hardness of head portion is measured at the same position of head portion as specified in above microstructure observation.

*6: Tensile test method is specified in description.

TABLE 13

| | Symbol | Steel | Rolling end temperature of head portion *1 (° C.) | Rolling length (m) | Time from end of hot rolling to beginning of accelerated cooling (sec) | | Accelerated cooling conditions *2: Accelerated cooling rate (° C./sec) | Accelerated cooling conditions *2: Accelerated cooling end temperature (° C.) |
|---|---|---|---|---|---|---|---|---|
| Invented production method | 100 | 47 | 920 | 115 | Head portion | 150 | 7.5 | 445 |
| | | | | | Web portion | 150 | 3.5 | 540 |
| | | | | | Base portion | 150 | 5.0 | 530 |
| | 101 | 48 | 900 | 150 | Head portion | 125 | 3.0 | 530 |
| | | | | | Web portion | 125 | 3.5 | 520 |
| | | | | | Base portion | 125 | 4.0 | 520 |
| | 102 | 49 | 880 | 100 | Head portion | 75 | 8.0 | 425 |
| | | | | | Web portion | 70 | 4.5 | 510 |
| | | | | | Base portion | 60 | 4.5 | 510 |
| | 103 | 50 | 870 | 110 | Head portion | 35 | 13.0 | 415 |
| | | | | | Web portion | 35 | 8.0 | 505 |
| | | | | | Base portion | 35 | 9.5 | 500 |
| | 104 | 51 | 900 | 105 | Head portion | 10 | 23.0 | 452 |
| | | | | | Web portion | 10 | 8.0 | 515 |
| | | | | | Base portion | 10 | 9.5 | 520 |

| | Symbol | Microstructure *3 | Number of pearlite blocks 1 to 15 μm in grain size (per 0.2 mm$^2$) Measurement position | Drop weight test *4 HT: Head tension BT: Base tension | Hardness of head portion *5 (Hv) | Total elongation in tensile test of head portion *6 (%) |
|---|---|---|---|---|---|---|
| Invented production method | 100 | Pearlite | 350 (2 mm in depth from head surface) | HT: No fracture BT: No fracture | 445 | 11.8 |
| | | Pearlite | — | | | |
| | | Pearlite | — | | | |

TABLE 13-continued

| | | | | | |
|---|---|---|---|---|---|
| 101 | Pearlite | 230 (2 mm in depth from head surface) | HT: No fracture BT: No fracture | 395 | 10.8 |
| | Pearlite | — | | | |
| | Pearlite | — | | | |
| 102 | Pearlite | 380 (2 mm in depth from head surface) | HT: No fracture BT: No fracture | 401 | 10.4 |
| | Pearlite | — | | | |
| | Pearlite | — | | | |
| 103 | Pearlite | 400 (2 mm in depth from head surface) | HT: No fracture BT: No fracture | 485 | 10.3 |
| | Pearlite | — | | | |
| | Pearlite | — | | | |
| 104 | Pearlite | 362 (2 mm in depth from head surface) | HT: No fracture BT: No fracture | 465 | 10.0 |
| | Pearlite | — | | | |
| | Pearlite | — | | | |

*1: Rolling end temperature of head portion is surface temperature immediately after rolling.

*2: Cooling rates of head, web and base portions are average figures in the region 0 to 3 mm in depth at the positions specified in description.

*3: Microstructures of head, web and base portions are observed at a depth of 2 mm at the same positions as specified in above cooling rate measurement.

*4: Drop weight test method is specified in description.

*5: Hardness of head portion is measured at the same position of head portion as specified in above microstructure observation.

*6: Tensile test method is specified in description.

TABLE 14

| | Symbol | Steel | Rolling end temperature of head portion *1 (° C.) | Rolling length (m) | Time from end of hot rolling to beginning of accelerated cooling (sec) | | Accelerated cooling conditions *2: Accelerated cooling rate (° C./sec) | Accelerated cooling conditions *2: Accelerated cooling end temperature (° C.) |
|---|---|---|---|---|---|---|---|---|
| Comparative production method | 105 | 44 | 980 | 200 | Head portion | 190 | 4.5 | 648 |
| | | | | | Web portion | 190 | 13.0 | 645 |
| | | | | | Base portion | 190 | 11.5 | 632 |
| | 106 | 45 | 960 | 150 | Head portion | 185 | 0.5 | 630 |
| | | | | | Web portion | 165 | 0.4 | 605 |
| | | | | | Base portion | 165 | 0.5 | 600 |
| | 107 | 45 | 960 | 125 | Head portion | 165 | 18.0 | 450 |
| | | | | | Web portion | 165 | 3.0 | 570 |
| | | | | | Base portion | 165 | 4.5 | 560 |
| | 108 | 47 | 830 | 150 | Head portion | 150 | 7.5 | 465 |
| | | | | | Web portion | 150 | 3.5 | 540 |
| | | | | | Base portion | 150 | 5.0 | 530 |

| | Symbol | Microstructure *3 | Number of pearlite blocks 1 to 15 μm in grain size (per 0.2 $mm^2$) Measurement position | Drop weight test *4 HT: Head tension BT: Base tension | Hardness of head portion *5 (Hv) | Total elongation in tensile test of head portion *6 (%) |
|---|---|---|---|---|---|---|
| Comparative production method | 105 | Pearlite | 235 (2 mm in depth from head surface) | HT: No fracture BT: Fractured (Martensite formed) | 375 | 14.0 |
| | | Martensite + pearlite | — | | | |
| | | Martensite + pearlite | — | | | |
| | 106 | Pro-eutectoid cementite + pearlite | — | HT: Fracture (Pro-eutectoid cementite formed) BT: Fractured (Pro-eutectoid cementite formed) | 315 | 12.5 |
| | | Pro-eutectiod cementite + pearlite | — | | | |
| | | Pro-eutectiod cementite + pearlite | — | | | |

TABLE 14-continued

| | | | | | |
|---|---|---|---|---|---|
| 107 | Martensite + pearlite | — | HT: Fractured (Martensite formed) | 545 | 6.4 (Martensite formed, low ductility) |
| | Pearlite | — | | | |
| | Pearlite | — | BT: No fracture | | |
| 108 | Pro-eutectoid cementite + pearlite | — | HT: Fractured (Pro-eutectoid cementite formed) | 560 | 5.5 (Martensite formed, low ductility) |
| | Pro-eutectoid cementite + pearlite | — | BT: Fractured (Pro-eutectoid cementite formed) | | |
| | Pro-eutectiod cementite + pearlite | — | | | |

*1: Rolling end temperature of head portion is surface temperature immediately after rolling.

*2: Cooling rates of head, web and base portions are average figures in the region 0 to 3 mm in depth at the positions specified in description.

*3: Microstructures of head, web and base portions are observed at a depth of 2 mm at the same positions as specified in above cooling rate measurement.

*4: Drop weight test method is specified in description.

*5: Hardness of head portion is measured at the same position of head portion as specified in above microstructure observation.

*6: Tensile test method is specified in description.

TABLE 15

| | Symbol | Steel | Rolling end temperature of head portion *1 (° C.) | Rolling length (m) | Time from end of hot rolling to beginning of accelerated cooling (sec) | | Accelerated cooling conditions *2: Accelerated cooling rate (° C./sec) | Accelerated cooling conditions *2: Accelerated cooling end temperature (° C.) |
|---|---|---|---|---|---|---|---|---|
| Comparative production method | 109 | 47 | 920 | 115 | Head portion | 150 | 7.5 | 445 |
| | | | | | Web portion | 150 | 3.5 | 685 |
| | | | | | Base portion | 150 | 5.0 | 700 |
| | 110 | 48 | 900 | 250 (Excessive rail length) | Head portion | 125 | 3.0 | 530 |
| | | | | | Web portion | 125 | 3.5 | 520 |
| | | | | | Base portion | 125 | 4.0 | 520 |
| | 111 | 49 | 1080 | 100 | Head portion | 75 | 8.0 | 425 |
| | | | | | Web portion | 70 | 4.5 | 510 |
| | | | | | Base portion | 60 | 4.5 | 510 |
| | 112 | 50 | 860 | 110 | Head portion | 350 | 13.0 | 415 |
| | | | | | Web portion | 350 | 8.0 | 505 |
| | | | | | Base portion | 350 | 9.5 | 500 |

| | Symbol | Microstructure *3 | Number of pearlite blocks 1 to 15 μm in grain size (per 0.2 mm$^2$) Measurement position | Drop weight test *4 HT: Head tension BT: Base tension | Hardness of head portion *5 (Hv) | Total elongation in tensile test of head portion *6 (%) |
|---|---|---|---|---|---|---|
| Comparative production method | 109 | Pearlite | 305 (2 mm in depth from head surface) | HT: No fracture BT: Fractured (Pro-eutectoid cementite formed) | 445 | 11.8 |
| | | Pro-eutectoid cementite + pearlite | — | | | |
| | | Pro-eutectoid cementite + pearlite | — | | | |

TABLE 15-continued

| | | | | | |
|---|---|---|---|---|---|
| 110 | Pearlite | 215 (2 mm in depth from head surface) | HT: No fracture BT: Fractured (Pro-eutectoid cementite formed) | 395 | 10.8 |
| | Pearlite | — | | | |
| | Trace pro-eutectoid cementite at rail ends + pearlite | — | | | |
| 111 | Pearlite | 120 (2 mm in depth from head surface) | HT: No fracture BT: No fracture | 401 | 7.8 (Pearlite coarsened → low ductility) |
| | Pearlite | — | | | |
| | Pearlite | — | | | |
| 112 | Pro-eutectoid cementite + pearlite | — | HT: Fractured (Pro-eutectoid cementite formed) BT: Fractured (Pro-eutectoid cementite formed) | 435 | 7.8 (Cementite formed → low ductility) |
| | Pro-eutectoid cementite + pearlite | — | | | |
| | Pro-eutectoid cementite + pearlite | — | | | |

*1: Rolling end temperature of head portion is surface temperature immediately after rolling.
*2: Cooling rates of head, web and base portions are average figures in the region 0 to 3 mm in depth at the positions specified in description.
*3: Microstructures of head, web and base portions are observed at a depth of 2 mm at the same positions as specified in above cooling rate measurement.
*4: Drop weight test method is specified in description.
*5: Hardness of head portion is measured at the same position of head portion as specified in above microstructure observation.
*6: Tensile test method is specified in description.

Example 6

Table 16 shows the chemical composition of the steel rails subjected to the tests below. Note that the balance of the chemical composition specified in the table is Fe and unavoidable impurities.

Table 17 shows the reheating conditions of the bloom (slab) (the values of CT and CM, the maximum heating temperatures of the bloom (slab) (Tmax) and the retention times during which the bloom (slab) are heated to 1,100° C. or higher (Mmax)) when the rails are produced by the production method according to the present invention using the steels listed in Table 11, and the properties during hot rolling and after the hot rolling (the surface properties of the rails thus produced during hot rolling and after the hot rolling, and the structures and the hardness of the surface layers of the head portions). The table also shows the wear test results of the rails produced by the production method according to the present invention. Table 18 shows the reheating conditions of the bloom (slab) (the values of CT and CM, the maximum heating temperatures of the bloom (slab) (Tmax) and the retention times during which the bloom (slab) are heated to 1,100° C. or higher (Mmax)) when the rails are produced by comparative production methods using the steels listed in Table 16, and the properties during hot rolling and after the rolling (the surface properties of the rails thus produced during hot rolling and after the hot rolling, and the structures and the hardness of the surface layers of the head portions). The table also shows the wear test results of the rails produced by comparative production methods.

Note that each of the steel rails listed in Tables 17 and 18 was produced under the conditions of a time period of 180 sec. from hot rolling to heat treatment at the railhead portion and an area reduction ratio of 6% at the final pass of finish hot rolling.

Figure 9:
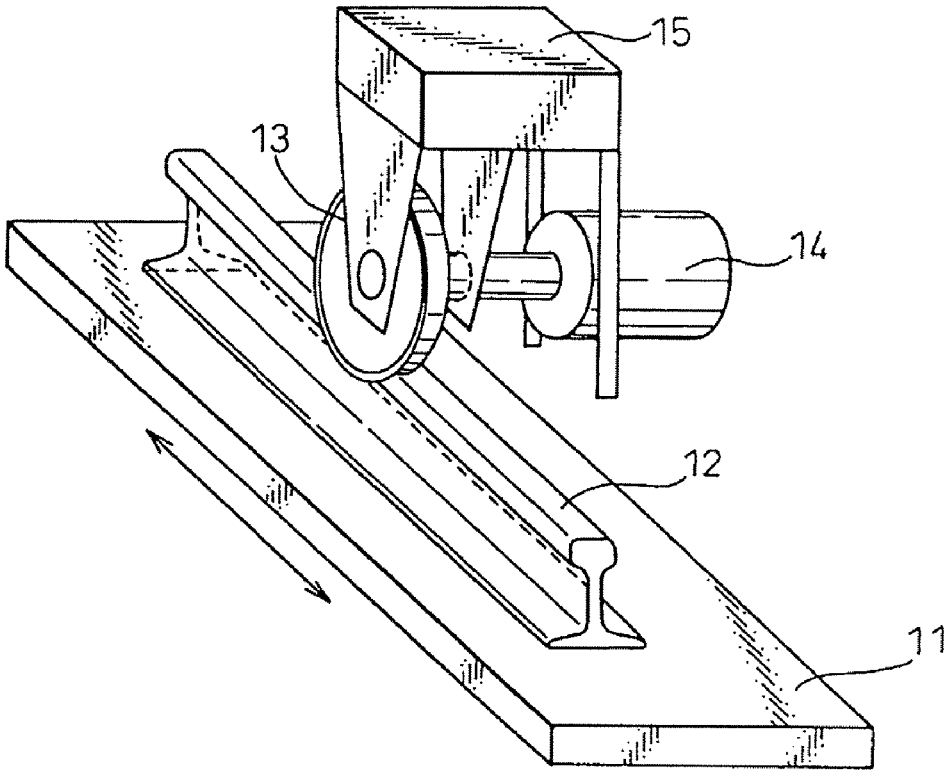
FIG. 9 is an illustration showing an outline of a rolling wear tester for a rail and a wheel.

Here, explanations are given regarding the drawings attached hereto. FIG. 9 is an illustration showing an outline of a rolling wear tester for a rail and a wheel.

In FIG. 9, reference numeral 11 indicates a slider for moving a rail, on which a rail 12 is placed. Reference numeral 15 indicates a loading apparatus for controlling the lateral movement and the load on a wheel 13 driven by a motor 14. During the test, the wheel 13 rolls on the rail 12 and moves back and forth in the longitudinal direction.

The rails listed in the tables are as follows:

Heat-treated Rails According to the Present Invention (11 Rails), Symbols 113 to 123

The bloom (slab) and rails produced by the production method in the aforementioned ranges using the steels having the chemical composition in the aforementioned ranges.

Comparative Heat-treated rails (8 Rails), Symbols 124 to 131

The bloom (slab) and rails produced by the production methods outside the aforementioned ranges using the steels having the chemical composition in the aforementioned ranges.

The tests were carried out under the following conditions:

Rolling Wear Test

Test equipment: Rolling wear tester (see FIG. 9)
Test piece shape
Rail: 136-lb. rail, 2 m in length
wheel: Type AAR (920 mm in diameter)
Test load (simulating heavy load railways)
Radial load: 147,000 N (15 tons)
Thrust load: 9,800 N (1 ton)
Repetition cycle: 10,000 cycles
Lubrication condition: Dry As seen in Tables 17 and 18, in the cases of the rails produced under the reheating conditions in the aforementioned ranges in contrast to the cases of the rails produced under comparative reheating conditions: the cracks and breaks of a bloom (slab) during rolling were prevented as a result of optimizing the maximum heating temperature of the bloom (slab) and the time period during which the bloom (slab) was heated to a certain temperature or higher in the reheating process for hot rolling the bloom (slab) having a high carbon content as listed in Table 16 into rails; and the deterioration of wear resistance was prevented as a result of suppressing the decarburization at the outer surface layer of a rail and preventing the formation of pro-eutectoid ferrite structures. Thus, it was possible to produce high-quality rails efficiently.

TABLE 16

| Steel | Chemical composition (mass %) C | Si/Mn/Cr/Mo/V/Nb/B/Co/Cu/Ni/Ti/Mg/Ca/Al/Zr/N |
|---|---|---|
| 52 | 0.86 | Si: 0.50<br>Mn: 1.05 |
| 53 | 0.90 | Si: 0.50 Mo: 0.02<br>Mn: 1.05<br>Cr: 0.25 |
| 54 | 0.90 | Si: 0.25<br>Mn: 0.65<br>Cr: 0.22 |

TABLE 16-continued

| Steel | Chemical composition (mass %) C | Si/Mn/Cr/Mo/V/Nb/B/Co/Cu/Ni/Ti/Mg/Ca/Al/Zr/N |
|---|---|---|
| 55 | 1.00 | Si: 0.41<br>Mn: 0.70<br>Cr: 0.25 |
| 56 | 1.01 | — |
| 57 | 1.01 | Si: 0.81 V: 0.03<br>Mn: 0.65 N: 0.0080<br>Cr: 0.55 |
| 58 | 1.11 | Si: 0.45 Cu: 0.25<br>Mn: 0.51<br>Cr: 0.34 |
| 59 | 1.21 | Si: 1.35 Zr: 0.0015<br>Mn: 0.15 Ca: 0.0020<br>Cr: 0.15 |
| 60 | 1.38 | Si: 0.35 Al: 0.07<br>Mn: 0.12 |

TABLE 17

| | Symbol | Steel | Value of CT *1 | Value of CM *2 | Reheating conditions of bloom (slab) for rolling into rail: Maximum heating temperature of bloom (slab) Tmax (° C.) | Retention time at 1,100° C. or higher Mmax (min) | Properties of rail during and after hot rolling: Surface condition during and after hot rolling | Structure of head surface layer *3 | Hardness of head surface layer *4 (Hv) | Wear test result *5 Wear amount (mm) |
|---|---|---|---|---|---|---|---|---|---|---|
| Invented production method | 113 | 52 | 1362 | 487 | 1325 | 415 | No bloom (slab) breakage or rail cracking | Pearlite | 324 | 1.95 |
| | 114 | 53 | 1337 | 465 | 1305 | 402 | No bloom (slab) breakage or rail cracking | Pearlite | 354 | 1.89 |
| | 115 | 54 | 1309 | 443 | 1280 | 385 | No bloom (slab) breakage or rail cracking | Pearlite | 395 | 1.65 |
| | 116 | 55 | 1280 | 420 | 1270 | 375 | No bloom (slab) breakage or rail cracking | Pearlite | 415 | 1.45 |
| | 117 | 55 | 1280 | 420 | 1250 | 345 | No bloom (slab) breakage or rail cracking | Pearlite | 424 | 1.38 |
| | 118 | 56 | 1277 | 418 | 1245 | 365 | No bloom (slab) breakage or rail cracking | Pearlite | 385 | 1.58 |
| | 119 | 57 | 1277 | 415 | 1275 | 395 | No bloom (slab) breakage or rail cracking | Pearlite | 451 | 1.21 |
| | 120 | 57 | 1277 | 415 | 1245 | 325 | No bloom (slab) breakage or rail cracking | Pearlite | 465 | 1.15 |
| | 121 | 58 | 1246 | 393 | 1240 | 350 | No bloom (slab) breakage or rail cracking | Pearlite | 435 | 1.20 |
| | 122 | 59 | 1213 | 366 | 1200 | 315 | No bloom (slab) breakage or rail cracking | Pearlite | 485 | 0.85 |
| | 123 | 60 | 1154 | 320 | 1140 | 300 | No bloom (slab) breakage or rail cracking | Pearlite | 475 | 0.75 |

*1 CT = 1500 − 140([mass % C]) − 80([mass % C])$^2$

*2 CM = 600 − 120([mass % C]) − 60([mass % C])$^2$

*3 Observation position of structure of head surface layer: 2 mm in depth from head top surface at rail width center

*4 Measurement position of hardness of head surface layer: 2 mm in depth from head top surface at rail width center

*5 Wear test method: See FIG. 9 and description. Wear amount: wear depth in height direction at rail width center after testing

TABLE 18

| | Symbol | Steel | Value of CT *1 | Value of CM *2 | Reheating conditions of bloom (slab) for rolling into rail: Maximum heating temperature of bloom (slab) Tmax (° C.) | Reheating conditions of bloom (slab) for rolling into rail: Retention time at 1,100° C. or higher Mmax (min) | Properties of rail during and after hot rolling: Surface condition during and after hot rolling | Properties of rail during and after hot rolling: Structure of head surface layer *3 | Properties of rail during and after hot rolling: Hardness of head surface layer *4 (Hv) | Wear test result *5 Wear amount (mm) |
|---|---|---|---|---|---|---|---|---|---|---|
| Comparative production method | 124 | 53 | 1337 | 465 | 1305 | 600 | No bloom (slab) breakage or rail cracking | Pearlite + pro-eutectoid ferrite (Much decarburization) | 324 | 3.05 |
| | 125 | 54 | 1309 | 443 | 1320 | 385 | Rail cracked | Pearlite | 385 | 1.75 |
| | 126 | 55 | 1280 | 420 | 1300 | 485 | Rail cracked | Pearlite + pro-eutectoid ferrite (Much decarburization) | 365 | 2.85 |
| | 127 | 55 | 1280 | 420 | 1355 | 345 | Bloom (slab) broke | Hot rolling of rail not viable | | |
| | 128 | 57 | 1277 | 415 | 1275 | 550 | No bloom (slab) breakage or rail cracking | Pearlite + pro-eutectoid ferrite (Much decarburization) | 390 | 2.64 |
| | 129 | 58 | 1246 | 393 | 1220 | 500 | No bloom (slab) breakage or rail cracking | Pearlite + pro-eutectoid ferrite (Much decarburization) | 398 | 2.45 |
| | 130 | 58 | 1213 | 366 | 1240 | 320 | Rail cracked | Pearlite | 475 | 0.91 |
| | 131 | 60 | 1154 | 320 | 1250 | 300 | Bloom (slab) broke | Hot rolling of rail not viable | | |

*1 CT = 1500 − 140([mass % C]) − 80([mass % C])$^2$
*2 CM = 600 − 120([mass % C]) − 60([mass % C])$^2$
*3 Observation position of structure of head surface layer: 2 mm in depth from head top surface at rail width center
*4 Measurement position of hardness of head surface layer: 2 mm in depth from head top surface at rail width center
*5 Wear test method: See FIG. 9 and description. Wear amount: wear depth in height direction at rail width center after testing

Example 7

Table 19 shows the chemical composition of the steel rails subjected to the tests below. Note that the balance of the chemical composition specified in the table is Fe and unavoidable impurities.

Tables 20 and 21 show, regarding each of the rails produced by the heat treatment method according to the present invention using the steels listed in Table 19, the rolling length, the time period from the end of rolling to the beginning of the heat treatment of a base toe portion, the conditions of the accelerated cooling at the head, web and base portions of a rail, the microstructure, the result of a drop-weight test, and the hardness at a head portion.

Tables 22 and 23 show, regarding each of the rails produced by the comparative heat treatment methods using the steels listed in Table 19, the rolling length, the time period from the end of rolling to the beginning of the heat treatment of a base toe portion, the conditions of the accelerated cooling at the head, web and base portions of a rail, the microstructure, the result of a drop-weight test, and the hardness at a head portion.

The rails listed in the tables are as follows:

Heat-treated Rails According to the Present Invention (11 rails), Symbols 132 to 142

The rails produced under the heat treatment conditions in the aforementioned ranges using the steels having the chemical composition in the aforementioned ranges.

Comparative Heat-treated Rails (9 Rails), Symbols 143 to 151

The rails produced under the heat treatment conditions outside the aforementioned ranges using the steels having the chemical composition in the aforementioned ranges.

Note that each of the steel rails listed in Tables 20 and 21 was produced under the conditions of a time period of 180 sec. from hot rolling to heat treatment at the railhead portion and an area reduction ratio of 6% at the final pass of finish hot rolling.

In each of those rails, the number of the pearlite blocks having grain sizes in the range from 1 to 15 μm at a portion 5 mm in depth from the head top portion was in the range from 200 to 500 per 0.2 mm$^2$ of observation field.

The tests were carried out under the following conditions:

Drop-weight Test

Mass of falling weight: 907 kg

Distance between supports: 0.914 m

Dropping height: 10.6 m

Test temperature: Room temperature (20° C.)

Test specimen position: HT, tensile stress on railhead portion; BT, tensile stress on rail base portion As seen in Tables 20 and 21, and 22 and 23, in the steel rails having high carbon contents as listed in Table 19, in the cases of the steel rails produced by the heat treatment method according to the present invention wherein preliminary heat treatment was applied to the base toe portion of a rail within the prescribed time period after the end of hot rolling and thereafter accelerated cooling was applied to the head, web and base portions, in contrast to the cases of the rails produced by the comparative production methods, the formation of pro-eutectoid cementite structures was suppressed and thus the deterioration of fatigue strength and toughness was prevented.

In addition, as shown in Tables 20 and 21, and 22 and 23, it was made possible to secure a good wear resistance at the railhead portions as a result of controlling the accelerated cooling rates at the railhead portions.

As stated above, in the steel rails having high carbon contents, it was made possible: to suppress the formation of pro-eutectoid cementite structures detrimental to the occurrence of fatigue cracks and brittle cracks as a result of applying accelerated cooling or heating to the base toe portions of a rail within the prescribed time period after the end of hot rolling and thereafter applying accelerated cooling to the head, web and base portions of the rail; and also to secure a good wear resistance at a railhead portion as a result of optimizing the accelerated cooling rate at the railhead portion.

TABLE 19

| Steel | Chemical composition (mass %) C | Si/Mn/Cr/Mo/V/Nb/B/Co/Cu/Ni/Ti/Mg/Ca/Al/Zr/N |
|---|---|---|
| 61 | 0.86 | Si: 0.50<br>Mn: 0.80 |
| 62 | 0.90 | Si: 0.35 Mo: 0.03<br>Mn: 0.80 |
| 63 | 0.95 | Si: 0.80<br>Mn: 0.50<br>Cr: 0.45 |
| 64 | 1.00 | |
| 65 | 1.00 | Si: 0.55<br>Mn: 0.70<br>Cr: 0.25 |

TABLE 19-continued

| Steel | Chemical composition (mass %) C | Si/Mn/Cr/Mo/V/Nb/B/Co/Cu/Ni/Ti/Mg/Ca/Al/Zr/N |
|---|---|---|
| 66 | 1.01 | Si: 0.80 V: 0.020<br>Mn: 0.45 N: 0.010<br>Cr: 0.40 |
| 67 | 1.11 | Si: 1.45 Zr: 0.0020<br>Mn: 0.35 V: 0.050<br>Cr: 0.41 |
| 68 | 1.19 | Si: 0.45 Al: 0.07<br>Mn: 0.65<br>Cr: 0.15 |
| 69 | 1.35 | Si: 0.45 Cu: 0.15<br>Mn: 0.45 |

TABLE 20

| | Symbol | Steel | Rolling length (m) | Time up to the start of heat treatment of base toe portion (sec) | Preliminary heat treatment conditions and microstructure of base toe portion *1 |
|---|---|---|---|---|---|
| Invented heat treatment method | 132 | 61 | 198 | 58 | Accelerated cooling rate: 5° C./sec.<br>Accelerated cooling end temperature: 645° C.<br>Microstructure: pearlite |
| | 133 | 62 | 180 | 52 | Accelerated cooling rate: 6° C./sec.<br>Accelerated cooling end temperature: 635° C.<br>Microstructure: pearlite |
| | 134 | 63 | 185 | 48 | Accelerated cooling rate: 7° C./sec.<br>Accelerated cooling end temperature: 625° C.<br>Microstructure: pearlite |
| | 135 | 63 | 158 | 45 | Heating by 56° C.<br>Microstructure: pearlite |
| | 136 | 64 | 168 | 40 | Accelerated cooling rate: 10° C./sec.<br>Accelerated cooling end temperature: 615° C.<br>Microstructure: pearlite |
| | 137 | 65 | 178 | 40 | Heating by 78° C.<br>Microstructure: pearlite |

| | Symbol | Portion | Accelerated cooling conditions *2: Accelerated cooling rate (° C./sec) | Accelerated cooling conditions *2: Accelerated cooling end temperature (° C.) | Microstructure *3 | Drop-weight test *4 HT: Head tension BT: Base tension | Hardness of head portion *5 (Hv) |
|---|---|---|---|---|---|---|---|
| Invented heat treatment method | 132 | Head portion | 1.2 | 640 | Pearlite | HT: No fracture<br>BT: No fracture | 329 |
| | | Web portion | 1.5 | 642 | Pearlite | | |
| | | Base portion | 1.6 | 635 | Pearlite | | |
| | 133 | Head portion | 1.4 | 645 | Pearlite | HT: No fracture<br>BT: No fracture | 329 |
| | | Web portion | 1.8 | 640 | Pearlite | | |
| | | Base portion | 1.8 | 630 | Pearlite | | |
| | 134 | Head portion | 2.4 | 625 | Pearlite | HT: No fracture<br>BT: No fracture | 385 |
| | | Web portion | 2.6 | 615 | Pearlite | | |
| | | Base portion | 2.0 | 615 | Pearlite | | |

TABLE 20-continued

| | | | | | | |
|---|---|---|---|---|---|---|
| 135 | Head portion | 6.5 | 450 | Pearlite | HT: No fracture<br>BT: No fracture | 455 |
| | Web portion | 3.5 | 580 | Pearlite | | |
| | Base portion | 4.0 | 550 | Pearlite | | |
| 136 | Head portion | 6.0 | 485 | Pearlite | HT: No fracture<br>BT: No fracture | 420 |
| | Web portion | 3.0 | 530 | Pearlite | | |
| | Base portion | 5.5 | 535 | Pearlite | | |
| 137 | Head portion | 3.0 | 485 | Pearlite | HT: No fracture<br>BT: No fracture | 350 |
| | Web portion | 3.0 | 530 | Pearlite | | |
| | Base portion | 5.5 | 535 | Pearlite | | |

*1: Cooling rate of base toe portion is average figure in the region 0 to 3 mm in depth at the position specified in description.

*2: Cooling rates of head, web and base portions are average figures in the region 0 to 3 mm in depth at the positions specified in description.

*3: Microstructures of base toe, head, web and base portions are observed at a depth of 2 mm at the same positions as specified in above cooling rate measurement.

*4: Drop-weight test method is specified in description.

*5: Hardness of head portion is measured at same position of head portion as specified in above microstructure observation.

TABLE 21

| | Symbol | Steel | Rolling length (m) | Time up to the start of heat treatment of base toe portion (sec) | Preliminary heat treatment conditions and microstructure of base toe portion *1 |
|---|---|---|---|---|---|
| Invented heat treatment method | 138 | 65 | 160 | 40 | Heating by 85° C.<br>Microstructure: pearlite |
| | 139 | 66 | 155 | 35 | Accelerated cooling rate: 12° C./sec.<br>Accelerated cooling end temperature: 545° C.<br>Microstructure: pearlite |
| | 140 | 67 | 145 | 25 | Heating by 95° C.<br>Microstructure: pearlite |
| | 141 | 68 | 125 | 10 | Accelerated cooling rate: 17° C./sec.<br>Accelerated cooling end temperature: 545° C.<br>Microstructure: pearlite |
| | 142 | 69 | 105 | 10 | Accelerated cooling rate: 20° C./sec.<br>Accelerated cooling end temperature: 525° C.<br>Microstructure: pearlite |

| | | | Accelerated cooling conditions *2 | | | | |
|---|---|---|---|---|---|---|---|
| | Symbol | Portion | Accelerated cooling rate (° C./sec) | Accelerated cooling end temperature (° C.) | Microstructure *3 | Drop-weight test *4<br>HT: Head tension<br>BT: Base tension | Hardness of head portion *5 (Hv) |
| Invented heat treatment method | 138 | Head portion | 7.0 | 440 | Pearlite | HT: No fracture<br>BT: No fracture | 435 |
| | | Web portion | 3.5 | 545 | Pearlite | | |
| | | Base portion | 5.5 | 525 | Pearlite | | |
| | 139 | Head portion | 3.5 | 530 | Pearlite | HT: No fracture<br>BT: No fracture | 385 |
| | | Web portion | 3.5 | 520 | Pearlite | | |
| | | Base portion | 4.5 | 520 | Pearlite | | |
| | 140 | Head portion | 8.5 | 445 | Pearlite | HT: No fracture<br>BT: No fracture | 425 |
| | | Web portion | 4.0 | 530 | Pearlite | | |
| | | Base portion | 4.0 | 525 | Pearlite | | |

TABLE 21-continued

| | | | | | | |
|---|---|---|---|---|---|---|
| 141 | Head portion | 12.0 | 425 | Pearlite | HT: No fracture BT: No fracture | 475 |
| | Web portion | 7.0 | 515 | Pearlite | | |
| | Base portion | 9.0 | 505 | Pearlite | | |
| 142 | Head portion | 20.0 | 430 | Pearlite | HT: No fracture BT: No fracture | 495 |
| | Web portion | 7.0 | 505 | Pearlite | | |
| | Base portion | 9.0 | 510 | Pearlite | | |

*1: Cooling rate of base toe portion is average figure in the region 0 to 3 mm in depth at the position specified in description.

*2: Cooling rates of head, web and base portions are average figures in the region 0 to 3 mm in depth at the positions specified in description.

*3: Microstructures of base toe, head, web and base portions are observed at a depth of 2 mm at the same positions as specified in above cooling rate measurement.

*4: Drop-weight test method is specified in description.

*5: Hardness of head portion is measured at same position of head portion as specified in above microstructure observation.

TABLE 22

| | Symbol | Steel | Rolling length (m) | Time up to the start of heat treatment of base toe portion (sec) | Preliminary heat treatment conditions and microstructure of base toe portion *1 |
|---|---|---|---|---|---|
| Comparative heat treatment method | 143 | 62 | 180 | 52 | Accelerated cooling rate: 5° C./sec. Accelerated cooling end temperature: 700° C. Microstructure: pro-eutectoid cementite + pearlite |
| | 144 | 63 | 185 | 48 | Accelerated cooling rate: 25° C./sec. Accelerated cooling end temperature: 625° C. Microstructure: martensite + pearlite |
| | 145 | 63 | 158 | 45 | Heating by 56° C. Microstructure: martensite + pearlite |
| | 146 | 65 | 178 | 40 | Heating by 15° C. Microstructure: pro-eutectoid cementite + pearlite |
| | 147 | 65 | 160 | 40 | Heating by 85° C. Microstructure: pearlite |

| | Symbol | Portion | Accelerated cooling conditions *2: Accelerated cooling rate (° C./sec) | Accelerated cooling conditions *2: Accelerated cooling end temperature (° C.) | Microstructure *3 | Drop-weight test *4 HT: Head tension BT: Base tension | Hardness of head portion *5 (Hv) |
|---|---|---|---|---|---|---|---|
| Comparative heat treatment method | 143 | Head portion | 1.4 | 645 | Pearlite | HT: No fracture BT: Fractured (Pro-eutectoid cementite formed) | 329 |
| | | Web portion | 1.8 | 640 | Pearlite | | |
| | | Base portion | 1.8 | 630 | Pearlite | | |
| | 144 | Head portion | 2.4 | 625 | Pearlite | HT: No fracture BT: Fractured (Martensite formed) | 375 |
| | | Web portion | 2.6 | 615 | Pearlite | | |
| | | Base portion | 2.0 | 615 | Pearlite | | |
| | 145 | Head portion | 6.5 | 450 | Pearlite | HT: No fracture BT: Fractured (Martensite formed) | 445 |
| | | Web portion | 12.5 | 580 | Martensite + pearlite | | |
| | | Base portion | 13.0 | 550 | Martensite + pearlite | | |
| | 146 | Head portion | 17.0 | 485 | Martensite + pearlite | HT: Fractured (Martensite formed) BT: Fractured (Pro-eutectoid cementite formed) | 514 |
| | | Web portion | 3.0 | 530 | Pearlite | | |
| | | Base portion | 5.5 | 535 | Pearlite | | |

TABLE 22-continued

| | | | | | | |
|---|---|---|---|---|---|---|
| 147 | Head portion | 0.5 | 550 | Pro-eutectoid cementite + pearlite | HT: Fractured (Pro-eutectoid cementite formed) BT: Fractured (Pro-eutectoid cementite formed) | 425 |
| | Web portion | 0.5 | 545 | Pro-eutectoid cementite + pearlite | | |
| | Base portion | 0.5 | 525 | Pro-eutectoid cementite + pearlite | | |

*1: Cooling rate of base toe portion is average figure in the region 0 to 3 mm in depth at the position specified in description.

*2: Cooling rates of head, web and base portions are average figures in the region 0 to 3 mm in depth at the positions specified in description.

*3: Microstructures of base toe, head, web and base portions are observed at a depth of 2 mm at the same positions as specified in above cooling rate measurement.

*4: Drop-weight test method is specified in description.

*5: Hardness of head portion is measured at same position of head portion as specified in above microstructure observation.

TABLE 23

| | Symbol | Steel | Rolling length (m) | Time up to the start of heat treatment of base toe portion (sec) | Preliminary heat treatment conditions and microstructure of base toe portion *1 |
|---|---|---|---|---|---|
| Comparative heat treatment method | 148 | 66 | 155 | 35 | Accelerated cooling rate: 1° C./sec. Accelerated cooling end temperature: 545° C. Microstructure: pro-eutectoid cementite + pearlite |
| | 149 | 66 | 245 (Excessive rail length) | 35 | Accelerated cooling rate: 12° C./sec. Accelerated cooling end temperature: 545° C. Microstructure: pro-eutectoid cementite + pearlite |
| | 150 | 67 | 145 | 25 | Heating by 150° C. Microstructure: coarse pearlite |
| | 151 | 69 | 155 | 80 | Accelerated cooling rate: 20° C./sec. Accelerated cooling end temperature: 525° C. Microstructure: pro-eutectoid cementite |

| | | | Accelerated cooling conditions *2 | | | | |
|---|---|---|---|---|---|---|---|
| | Symbol | Portion | Accelerated cooling rate (° C./sec) | Accelerated cooling end temperature (° C.) | Microstructure *3 | Drop-weight test *4 HT: Head tension BT: Base tension | Hardness of head portion *5 (Hv) |
| Comparative heat treatment method | 148 | Head portion | 3.5 | 530 | Pearlite | HT: No fracture BT: Fractured (Pro-eutectoid cementite formed) | 385 |
| | | Web portion | 3.5 | 520 | Pearlite | | |
| | | Base portion | 4.5 | 520 | Pearlite | | |
| | 149 | Head portion | 6.5 | 530 | Pearlite | HT: No fracture BT: Fractured (Trace pro-eutectoid cementite formed) | 425 |
| | | Web portion | 3.5 | 520 | Pearlite | | |
| | | Base portion | 5.5 | 520 | Pearlite | | |
| | 150 | Head portion | 8.5 | 445 | Pearlite | HT: No fracture BT: Fractured (Pearlite coarsened) | 425 |
| | | Web portion | 4.0 | 530 | Pearlite | | |
| | | Base portion | 4.0 | 525 | Pearlite | | |

TABLE 23-continued

| | | | | | | |
|---|---|---|---|---|---|---|
| 151 | Head portion | 20.0 | 430 | Pearlite | HT: No fracture BT: Fractured (Pro-eutectoid cementite formed) | 495 |
| | Web portion | 7.0 | 505 | Pearlite | | |
| | Base portion | 9.0 | 510 | Pearlite | | |

*1: Cooling rate of base toe portion is average figure in the region 0 to 3 mm in depth at the position specified in description.
*2: Cooling rates of head, web and base portions are average figures in the region 0 to 3 mm in depth at the positions specified in description.
*3: Microstructures of base toe, head, web and base portions are observed at a depth of 2 mm at the same positions as specified in above cooling rate measurement.
*4: Drop-weight test method is specified in description.
*5: Hardness of head portion is measured at same position of head portion as specified in above microstructure observation.

Example 8

Table 24 shows the chemical composition of the steel rails subjected to the tests below. Note that the balance of the chemical composition specified in the table is Fe and unavoidable impurities. Tables 25 and 26 show, regarding each of the rails produced by the heat treatment method according to the present invention using the steels listed in Table 24, the rolling length, the time period from the end of rolling to the beginning of the heat treatment of a web portion, the heat treatment conditions and the microstructure of a web portion, the accelerated cooling conditions and the microstructures of the head and base portions of a rail, the number of intersecting pro-eutectoid cementite network (N) in a web portion, and the hardness at a head portion.

Tables 27, 28 and 29 show, regarding each of the rails produced by comparative heat treatment methods using the steels listed in Table 24, the rolling length, the time period from the end of rolling to the beginning of the heat treatment of a web portion, the heat treatment conditions and the microstructure of a web portion, the accelerated cooling conditions and the microstructures of the head and base portions of a rail, the number of intersecting pro-eutectoid cementite network (N) in a web portion, and the hardness at a head portion.

The rails listed in the tables are as follows:

Heat-treated Rails According to the Present Invention (11 rails), Symbols 152 to 162

The rails produced under the heat treatment conditions in the aforementioned ranges using the steels having the chemical composition in the aforementioned ranges.

Comparative Heat-treated Rails (11 Rails), Symbols 163 to 173

The rails produced under the heat treatment conditions outside the aforementioned ranges using the steels having the chemical composition in the aforementioned ranges.

Note that each of the steel rails listed in Tables 25 and 26, and 27, 28 and 29 were produced under the conditions of a time period of 180 sec. from hot rolling to heat treatment at the railhead portion and an area reduction ratio of 6% at the final pass of finish hot rolling.

In each of those rails, the number of the pearlite blocks having grain sizes in the range from 1 to 15 μm at a portion 5 mm in depth from the head top portion was in the range from 200 to 500 per 0.2 $mm^2$ of observation field.

Here, explanations are given regarding the number of intersecting pro-eutectoid cementite network (N) mentioned in this example and the method for exposing pro-eutectoid cementite structures for the measurement thereof.

Firstly, the method for exposing pro-eutectoid cementite structures is explained. First, a cross-sectional surface of the web portion of a rail is polished with diamond abrasive. Then, the polished surface is immersed in a solution of picric acid and caustic soda and pro-eutectoid cementite structures are exposed. Some adjustments may be required of the exposing conditions in accordance with the condition of a polished surface, but, basically, desirable exposing conditions are: an immersion solution temperature is 80° C.; and an immersion time is approximately 120 min.

Secondly, the method for measuring the number of intersecting pro-eutectoid cementite network (N) is explained.

An arbitrary point where pro-eutectoid cementite structures are exposed on a sectional surface of the web portion of a rail is observed with an optical microscope. The number of intersections of pro-eutectoid cementite network with two line segments each 300 μm in length crossing each other at right angles is counted under a magnification of 200. FIG. 2 schematically shows the measurement method.

The number of the intersecting pro-eutectoid cementite network is defined as the total of the intersections on the two line segments each 300 μm in length crossing each other at right angles. Note that, in consideration of uneven distribution of pro-eutectoid cementite structures, it is desirable to carry out the counting at least at 5 observation fields and use the average of the counts as the representative figure of the specimen.

The results are shown in Tables 25 and 26, and 28 and 29. In the high carbon steel rails having the chemical composition listed in Table 24, in the cases of the steel rails produced by the heat treatment method according to the present invention wherein the heat treatment in the aforementioned ranges was applied to the web portion of a rail within the prescribed time period after the end of hot rolling and additionally the accelerated cooling in the aforementioned ranges was applied to the head and base portions of the rail, in contrast to the cases of the rails produced by comparative heat treatment methods, the numbers of intersecting pro-eutectoid cementite network (N) were significantly reduced.

In addition, in the cases of the steel rails produced by the heat treatment method according to the present invention wherein the accelerated cooling in the aforementioned ranges was applied, in contrast to the rails produced by the comparative heat treatment methods, it was possible to prevent the formation of martensite structures and coarse pearlite structures, which caused the deterioration of the toughness and the fatigue strength at the web portion of a rail, as a result of adequately controlling the cooling rates during the heat treatment.

In addition, as shown in Tables 25 and 26, and 28 and 29, a good wear resistance was secured at the railhead portions, as evidenced by the rails produced by the heat treatment method according to the present invention (Symbols 155 and 158 to 162), as a result of controlling the accelerated cooling rates at the railhead portions.

As stated above, in the steel rails having high carbon contents, it was made possible: to suppress the formation of pro-eutectoid cementite structures, which acted as the origins of brittle fracture and deteriorated fatigue strength and toughness, as a result of applying accelerated cooling or heating to the web portion of a rail within the prescribed time period after the end of hot rolling and also applying accelerated cooling to the head and base portions of the rail and, after heating of the web portion too; and, further, to secure a good wear resistance at a railhead portion as a result of optimizing the accelerated cooling rate at the railhead portion.

TABLE 24

| Steel | Chemical composition (mass %) C | Si/Mn/Cr/Mo/V/Nb/B/Co/Cu/Ni/Ti/Mg/Ca/Al/Zr/N |
|---|---|---|
| 70 | 0.86 | Si: 0.25<br>Mn: 0.80 |
| 71 | 0.90 | Si: 0.25 Cu: 0.25<br>Mn: 0.80<br>Cr: 0.20 |
| 72 | 0.95 | Si: 0.80 Mo: 0.03<br>Mn: 0.50<br>Cr: 0.25 |

TABLE 24-continued

| Steel | Chemical composition (mass %) C | Si/Mn/Cr/Mo/V/Nb/B/Co/Cu/Ni/Ti/Mg/Ca/Al/Zr/N |
|---|---|---|
| 73 | 1.00 | |
| 74 | 1.00 | Si: 0.55<br>Mn: 0.65<br>Cr: 0.25 |
| 75 | 1.01 | Si: 0.80 V: 0.02<br>Mn: 0.45 N: 0.0080<br>Cr: 0.40 |
| 76 | 1.11 | Si: 1.45 Zr: 0.0015<br>Mn: 0.25<br>Cr: 0.35 |
| 77 | 1.19 | Si: 0.85 Al: 0.08<br>Mn: 0.15 |
| 78 | 1.34 | Si: 0.85<br>Mn: 0.15 |

TABLE 25

| | Symbol | Steel | Rolling length (m) | Time up to the start of heat treatment of web portion (sec) | Heat treatment conditions and microstructure of web portion *1 | |
|---|---|---|---|---|---|---|
| Invented heat treatment method | 152 | 70 | 200 | 98 | Accelerated cooling | Cooling rate: 2.0° C./sec.<br>Cooling end temperature: 635° C.<br>Microstructure: pearlite |
| | 153 | 71 | 198 | 90 | Accelerated cooling | Cooling rate: 2.5° C./sec.<br>Cooling end temperature: 645° C.<br>Microstructure: pearlite |
| | 154 | 72 | 185 | 88 | Accelerated cooling | Cooling rate: 3.8° C./sec.<br>Cooling end temperature: 630° C.<br>Microstructure: pearlite |
| | 155 | 72 | 185 | 82 | Heating 25° C. | Cooling rate: 1.5° C./sec.<br>Cooling end temperature: 642° C.<br>Microstructure: pearlite |
| | 156 | 73 | 180 | 80 | Heating 46° C. | Cooling rate: 3.5° C./sec.<br>Cooling end temperature: 620° C.<br>Microstructure: pearlite |

| | Symbol | Portion | Accelerated cooling conditions and microstructure of head and base portions *2*3: Accelerated cooling rate (° C./sec) | Accelerated cooling and temperature (° C.) | Microstructure | Formation of pro-eutectoid cementite structure in web portion *4: | Number of intersecting pro-eutectoid cementite network (N) | Hardness of head portion *5 (Hv) |
|---|---|---|---|---|---|---|---|---|
| Invented heat treatment method | 152 | Head portion | 1.4 | 640 | Pearlite | Segregated portion | 1 | 305 |
| | | Base portion | 1.3 | 640 | Pearlite | Surface layer | 0 | |
| | 153 | Head portion | 1.5 | 645 | Pearlite | Segregated portion | 2 | 315 |
| | | Base portion | 1.6 | 640 | Pearlite | Surface layer | 0 | |

TABLE 25-continued

| | | | | | | | |
|---|---|---|---|---|---|---|---|
| 154 | Head portion | 2.9 | 632 | Pearlite | Segregated portion | 5 | 332 |
| | Base portion | 2.8 | 625 | Pearlite | Surface layer | 0 | |
| 155 | Head portion | 4.9 | 475 | Pearlite | Segregated portion | 4 | 405 |
| | Base portion | 4.5 | 635 | Pearlite | Surface layer | 1 | |
| 156 | Head portion | 3.2 | 605 | Pearlite | Segregated portion | 6 | 360 |
| | Base portion | 2.8 | 620 | Pearlite | Surface layer | 0 | |

*1: Heating temperature, accelerated cooling rate, and accelerated cooling end temperature of web portion are average figures in the region 0 to 3 mm in depth at the positions specified in description.

*2: Accelerated cooling rates of head and base portions are average figures in the region 0 to 3 mm in depth at the positions specified in description.

*3: Microstructure of head, web and base portions are observed at a depth of 2 mm at the same positions as specified in above cooling rate measurement.

*4: See description and FIG. 2 for methods of exposing pro-eutectoid cementite structures and measuring the number of intersecting pro-eutectoid cementite network (N). N at segregated portion of web is measured at width center of rail centerline on cross-sectional surface of web portion. N at surface layer of web portion is measured at a depth of 2 mm at the same position as specified in above microstructure observation.

*5: Hardness of head portion is measured at the same position of head portion as specified in above microstructure observation.

TABLE 26

| | Symbol | Steel | Rolling length (m) | Time up to the start of heat treatment of web portion (sec) | Heat treatment conditions and microstructure of web portion *1 | |
|---|---|---|---|---|---|---|
| Invented heat treatment method | 157 | 74 | 170 | 75 | Heating 56° C. | Cooling rate: 2.8° C./sec. Cooling end temperature: 615° C. Microstructure: pearlite |
| | 158 | 74 | 170 | 52 | Heating 74 | Cooling rate: 4.0° C./sec. Cooling end temperature: 585° C. Microstructure: pearlite |
| | 159 | 75 | 160 | 65 | Accelerated cooling | Cooling rate: 6.5° C./sec. Cooling end temperature: 545° C. Microstructure: pearlite |
| | 160 | 76 | 145 | 25 | Heating 98° C. | Cooling rate: 9.0° C./sec. Cooling end temperature: 525° C. Microstructure: pearlite |
| | 161 | 77 | 120 | 18 | Accelerated cooling | Cooling rate: 16.0° C./sec. Cooling end temperature: 515° C. Microstructure: pearlite |
| | 162 | 78 | 105 | 10 | Accelerated cooling | Cooling rate: 20.0° C./sec. Cooling end temperature: 535° C. Microstructure: pearlite |

TABLE 26-continued

| | Symbol | Portion | Accelerated cooling conditions and microstructure of head and base portions *2*3 | | | Formation of pro-eutectoid cementite structure in web portion *4 | | Hardness of head portion *5 (Hv) |
|---|---|---|---|---|---|---|---|---|
| | | | Accelerated cooling rate (° C./sec) | Accelerated cooling and temperature (° C.) | Microstructure | Number of intersecting pro-eutectoid cementite network (N) | | |
| Invented heat treatment method | 157 | Head portion | 2.8 | 595 | Pearlite | Segregated portion | 8 | 374 |
| | | Base portion | 2.4 | 610 | Pearlite | Surface layer | 0 | |
| | 158 | Head portion | 7.0 | 480 | Pearlite | Segregated portion | 6 | 442 |
| | | Base portion | 4.5 | 545 | Pearlite | Surface layer | 0 | |
| | 159 | Head portion | 5.5 | 530 | Pearlite | Segregated portion | 7 | 378 |
| | | Base portion | 4.6 | 520 | Pearlite | Surface layer | 0 | |
| | 160 | Head portion | 11.0 | 445 | Pearlite | Segregated portion | 9 | 485 |
| | | Base portion | 6.0 | 535 | Pearlite | Surface layer | 1 | |
| | 161 | Head portion | 15.0 | 425 | Pearlite | Segregated portion | 8 | 455 |
| | | Base portion | 7.0 | 505 | Pearlite | Surface layer | 1 | |
| | 162 | Head portion | 18.0 | 435 | Pearlite | Segregated portion | 9 | 476 |
| | | Base portion | 10.0 | 521 | Pearlite | Surface layer | 1 | |

*1: Heating temperature, accelerated cooling rate, and accelerated cooling end temperature of web portion are average figures in the region 0 to 3 mm in depth at the positions specified in description.

*2: Accelerated cooling rates of head and base portions are average figures in the region 0 to 3 mm in depth at the positions specified in description.

*3: Microstructure of head, web and base portions are observed at a depth of 2 mm at the same positions as specified in above cooling rate measurement.

*4: See description and FIG. 2 for methods of exposing pro-eutectoid cementite structures and measuring the number of intersecting pro-eutectoid cementite network (N). N at segregated portion of web is measured at width center of rail centerline on cross-sectional surface of web portion. N at surface layer of web portion is measured at a depth of 2 mm at the same position as specified in above microstructure observation.

*5: Hardness of head portion is measured at the same position of head portion as specified in above microstructure observation.

TABLE 27

| | Symbol | Steel | Rolling length (m) | Time up to the start of heat treatment of web portion (sec) | Heat treatment conditions and microstructure of web portion *1 | |
|---|---|---|---|---|---|---|
| Comparative heat treatment method | 163 | 71 | 198 | 90 | Accelerated cooling | Cooling rate: 2.0° C./sec. Cooling end temperature: 720° C. Microstructure: pro-eutectoid cementite + pearlite |
| | 164 | 72 | 185 | 88 | Accelerated cooling | Cooling rate: 24.0° C./sec. Cooling end temperature: 630° C. Microstructure: martensite + pearlite |
| | 165 | 72 | 185 | 82 | Heating 25° C. | Cooling rate: 13.0° C./sec. Cooling end temperature: 565° C. Microstructure: martensite + pearlite |

TABLE 27-continued

| | | | | | | |
|---|---|---|---|---|---|---|
| | 166 | 74 | 170 | 75 | Heating 56° C. | Cooling rate: 0.5° C./sec. Cooling end temperature: 610° C. Microstructure: pro-eutectoid cementite + pearlite |

| | | | Accelerated cooling conditions and microstructure of head and base portions *2*3 | | | Formation of pro-eutectoid cementite structure in web portion *4 | | |
|---|---|---|---|---|---|---|---|---|
| | Symbol | Portion | Accelerated cooling rate (° C./sec) | Accelerated cooling end temperature (° C.) | Microstructure | Number of intersecting pro-eutectoid cementite network (N) | | Hardness of head portion *5 (Hv) |
| Comparative heat treatment method | 163 | Head portion | 1.4 | 640 | Pearlite | Segregated portion | 21 | 320 |
| | | Base portion | 1.5 | 645 | Pearlite | Surface layer | 8 | |
| | 164 | Head portion | 2.7 | 630 | Pearlite | Segregated portion | 3 | 335 |
| | | Base portion | 2.5 | 620 | Pearlite | Surface layer | 0 | |
| | 165 | Head portion | 4.7 | 470 | Pearlite | Segregated portion | 2 | 402 |
| | | Base portion | 4.6 | 630 | Pearlite | Surface layer | 0 | |
| | 166 | Head portion | 0.7 | 590 | Pro-eutectoid cementite + pearlite | Segregated portion | 29 | 334 |
| | | Base portion | 0.8 | 620 | Pro-eutectoid cementite + pearlite | Surface layer | 8 | |

*1: Heating temperature, accelerated cooling rate, and accelerated cooling end temperature of web portion are average figures in the region 0 to 3 mm in depth at the positions specified in description.

*2: Accelerated cooling rates of head and base portions are average figures in the region 0 to 3 mm in depth at the positions specified in description.

*3: Microstructure of head, web and base portions are observed at a depth of 2 mm at the same positions as specified in above cooling rate measurement.

*4: See description and FIG. 2 for methods of exposing pro-eutectoid cementite structures and measuring the number of intersecting pro-eutectoid cementite network (N). N at segregated portion of web is measured at width center of rail centerline on cross-sectional surface of web portion. N at surface layer of web portion is measured at a depth of 2 mm at the same position as specified in above microstructure observation.

*5: Hardness of head portion is measured at the same position of head portion as specified in above microstructure observation.

TABLE 28

| | Symbol | Steel | Rolling length (m) | Time up to the start of heat treatment of web portion (sec) | Heat treatment conditions and microstructure of web portion *1 | |
|---|---|---|---|---|---|---|
| Comparative heat treatement method | 167 | 74 | 170 | 52 | Heating 12° C. | Cooling rate: 4.2° C./sec. Cooling end temperature: 585° C. Microstructure: pro-eutectoid cementite + pearlite |
| | 168 | 74 | 170 | — | Heating 54° C. | Natural cooling in air Microstructure: pro-eutectoid cementite + pearlite |
| | 169 | 75 | 160 | 65 | Accelerated cooling | Cooling rate: 1.0° C./sec. Cooling end temperature: 550° C. Microstructure: pro-eutectoid cementite + pearlite |

TABLE 28-continued

| | | | | | | |
|---|---|---|---|---|---|---|
| | 170 | 75 | 235 (Excessive rail length) | 35 | Accelerated cooling | Cooling rate: 3.5° C./sec. Cooling end temperature: 540° C. Microstructure: trace pro-eutectoid cementite at rail ends + pearlite |

| | | | Accelerated cooling conditions and microstructure of head and base portions *2*3 | | | Formation of pro-eutectoid cementite structure in web portion *4 | | |
|---|---|---|---|---|---|---|---|---|
| | Symbol | Portion | Accelerated cooling rate (° C./sec) | Accelerated cooling end temperature (° C.) | Microstructure | Number of intersecting pro-eutectoid cementite network (N) | | Hardness of head portion *5 (Hv) |
| Comparative heat treatement method | 167 | Head portion | 7.2 | 485 | Pearlite | Segregated portion | 35 | 442 |
| | | Base portion | 4.0 | 550 | Pearlite | Surface layer | 10 | |
| | 168 | Head portion | 7.2 | 485 | Pearlite | Segregated portion | 39 | 442 |
| | | Base portion | Natural cooling in air | | Pro-eutectoid cementite + pearlite | Surface layer | 20 | |
| | 169 | Head portion | 5.0 | 535 | Pearlite | Segregated portion | 34 | 378 |
| | | Base portion | 4.5 | 525 | Pearlite | Surface layer | 11 | |
| | 170 | Head portion | 5.0 | 535 | Pearlite | Segregated portion | 25 | 388 |
| | | Base portion | 4.5 | 525 | Pearlite | Surface layer | 4 | |

*1: Heating temperature, accelerated cooling rate, and accelerated cooling end temperature of web portion are average figures in the region 0 to 3 mm in depth at the positions specified in description.

*2: Accelerated cooling rates of head and base portions are average figures in the region 0 to 3 mm in depth at the positions specified in description.

*3: Microstructure of head, web and base portions are observed at a depth of 2 mm at the same positions as specified in above cooling rate measurement.

*4: See description and FIG. 2 for methods of exposing pro-eutectoid cementite structures and measuring the number of intersecting pro-eutectoid cementite network (N). N at segregated portion of web is measured at width center of rail centerline on cross-sectional surface of web portion. N at surface layer of web portion is measured at a depth of 2 mm at the same position as specified in above microstructure observation.

*5: Hardness of head portion is measured at the same position of head portion as specified in above microstructure observation.

TABLE 29

| | Symbol | Steel | Rolling length (m) | Time up to the start of heat treatment of web portion (sec) | Heat treatment conditions and microstructure of web portion *1 | |
|---|---|---|---|---|---|---|
| Comparative heat tratement method | 171 | 76 | 145 | 25 | Heating 165° C. | Cooling rate: 9.0° C./sec. Cooling end temperature: 525° C. Microstructure: coarse pearlite |
| | 172 | 77 | 120 | 125 | Accelerated cooling | Cooling rate: 16.0° C./sec. Cooling end temperature: 515° C. Microstructure: pro-eutectoid cementite + pearlite |
| | 173 | 78 | 105 | — | Accelerated cooling | Natural cooling in air Microstructure: pro-eutectoid cementite + pearlite |

TABLE 29-continued

| | Symbol | Portion | Accelerated cooling conditions and microstructure of head and base portions *2*3 | | | Formation of pro-eutectoid cementite structure in web portion *4 | | Hardness of head portion *5 (Hv) |
|---|---|---|---|---|---|---|---|---|
| | | | Accelerated cooling rate (° C./sec) | Accelerated cooling end temperature (° C.) | Microstructure | Number of intersecting pro-eutectoid cementite network (N) | | |
| Comparative heat tratement method | 171 | Head portion | 12.5 | 445 | Pearlite | Segregated portion | 9 | 485 |
| | | Base portion | 5.0 | 535 | Pearlite | Surface layer | 1 | |
| | 172 | Head portion | 18.0 | 455 | Pearlite | Segregated portion | 38 | 465 |
| | | Base portion | 6.0 | 505 | Pearlite | Surface layer | 14 | |
| | 173 | Head portion | Natural cooling in air | | Pro-eutectoid cementite + pearlite | Segregated portion | 40 | 345 |
| | | Base portion | Natural cooling in air | | Pro-eutectoid cementite + pearlite | Surface layer | 24 | |

*1: Heating temperature, accelerated cooling rate, and accelerated cooling end temperature of web portion are average figures in the region 0 to 3 mm in depth at the positions specified in description.
*2: Accelerated cooling rates of head and base portions are average figures in the region 0 to 3 mm in depth at the positions specified in description.
*3: Microstructure of head, web and base portions are observed at a depth of 2 mm at the same positions as specified in above cooling rate measurement.
*4: See description and FIG. 2 for methods of exposing pro-eutectoid cementite structures and measuring the number of intersecting pro-eutectoid cementite network (N). N at segregated portion of web is measured at width center of rail centerline on cross-sectional surface of web portion. N at surface layer of web portion is measured at a depth of 2 mm at the same position as specified in above microstructure observation.
*5: Hardness of head portion is measured at the same position of head portion as specified in above microstructure observation.

Example 9

Table 30 shows the chemical composition of the steel rails subjected to the tests below. Note that the balance of the chemical composition specified in the table is Fe and unavoidable impurities.

Tables 31 and 32 show the values of CCR of the steels listed in Table 30, and, regarding each of the rails produced through the heat treatment according to the present invention using the steels listed in Table 30, the rolling length, the time period up to the beginning of heat treatment, the heat treatment conditions (cooling rates and the values of TCR) at the inside and the surface of a railhead portion, and the microstructure of a railhead portion.

Tables 33 and 34 show the values of CCR of the steels listed in Table 30, and, regarding each of the rails produced through the comparative heat treatment using the steels listed in Table 30, the rolling length, the time period up to the beginning of heat treatment, the heat treatment conditions (cooling rates and the values of TCR) at the inside and the surface of a railhead portion, and the microstructure of a railhead portion.

Here, explanations are given regarding the drawings attached hereto. FIG. 1 is an illustration showing the denominations of different portions of a rail.

In FIG. 10, the reference numeral 1 indicates the head top portion, the reference numeral 2 the head side portions at the right and left sides of the rail, the reference numeral 3 the lower chin portions at the right and left sides of the rail, and the reference numeral 4 the head inner portion, which is located in the vicinity of the position at a depth of 30 mm from the surface of the head top portion in the center of the width of the rail.

The rails listed in the tables are as follows:

Heat-treated Rails According to the Present Invention (11 Rails), Symbols 174 to 184

The rails produced by applying heat treatment to the railhead portions under the conditions in the aforementioned ranges using the steels having the chemical composition in the aforementioned ranges.

Comparative Heat-treated Rails (10 Rails), Symbols 185 to 194

The rails produced by applying heat treatment to the railhead portions under the conditions outside the aforementioned ranges using the steels having the chemical composition in the aforementioned ranges.

Note that any of the steel rails listed in Tables 31 and 32, and 33 and 34 were produced under the conditions of a time period of 180 sec. from hot rolling to heat treatment at the railhead portion and an area reduction ratio of 6% at the final pass of finish hot rolling.

In each of those rails, the number of the pearlite blocks having grain sizes in the range from 1 to 15 μm at a portion 5 mm in depth from the head top portion was within the range from 200 to 500 per 0.2 $mm^2$ of observation field.

As seen in Tables 31 and 32, and 33 and 34, in the steel rails having high carbon contents as listed in Table 30, in the cases of the steel rails produced by the heat treatment method according to the present invention wherein the cooling rate at a head inner portion (ICR) was controlled so as to be not lower than the value of CCR calculated from the chemical composition of a steel rail, in contrast to the cases of the rails produced by the comparative heat treatment methods, the formation of pro-eutectoid cementite structures at a head inner portion was prevented and resistance to internal fatigue damage was improved.

In addition, as seen also in Tables 31 and 32, and 33 and 34, it was made possible to prevent the pro-eutectoid cementite structures detrimental to the occurrence of fatigue damage from forming at a head inner portion and, at the same time, to prevent the bainite and martensite structures detrimental to wear resistance from forming in the surface layer of a railhead portion as a result of controlling the value of TCR calculated from the cooling rates at the different positions on the surface of the railhead portion within the range defined by the value of CCR with intent to prevent the formation of pro-eutectoid cementite structures at a railhead inner portion, or secure the cooling rate at a head inner portion (ICR), and stabilize the pearlite structures in the surface layer of a railhead portion.

As described above, in the steel rails having high carbon contents, it was made possible to prevent pro-eutectoid cementite structures detrimental to the occurrence of fatigue damage from forming at a railhead inner portion and, at the same time, obtain pearlite structures highly resistant to wear in the surface layer of a railhead portion as a result of controlling the cooling rate at the railhead inner portion (ICR) within the prescribed range and the cooling rates at the different positions on the surface of the railhead portion within the prescribed range.

TABLE 30

| | Chemical composition (mass %) | | | | |
|---|---|---|---|---|---|
| Steel | C | Si | Mn | Cr | Mo/V/Nb/B/Co/Cu Ni/Ti/Mg/Ca/Al/Zr |
| 79 | 0.86 | 0.25 | 1.15 | 0.12 | |
| 80 | 0.90 | 0.25 | 1.21 | 0.05 | Mo: 0.02 |
| 81 | 0.95 | 0.51 | 0.78 | 0.22 | |
| 82 | 1.00 | 0.42 | 0.68 | 0.25 | |
| 83 | 1.01 | 0.75 | 0.35 | 0.75 | Ti: 0.0150<br>B: 0.0008 |
| 84 | 1.11 | 0.11 | 0.31 | 0.31 | Zr: 0.0017<br>Ca: 0.0021 |
| 85 | 1.19 | 1.25 | 0.15 | 0.15 | V: 0.02<br>Al: 0.08 |
| 86 | 1.35 | 1.05 | 0.25 | 0.25 | |

TABLE 31

| | Symbol | Steel | Value of CCR *1 | 2 CCR | 4 CCR | Rolling length (m) | Time up to the start of heat treatment of head portion (sec) | Heat treatment conditions of head inner portion Cooling rate *2 (value of ICR) (° C./sec) |
|---|---|---|---|---|---|---|---|---|
| Invented heat treatment method | 174 | 79 | 0.04 | 0.08 | 0.16 | 198 | 198 | 0.21 |
| | 175 | 80 | 0.39 | 0.78 | 1.56 | 185 | 178 | 0.41 |
| | 176 | 81 | 0.81 | 1.62 | 3.24 | 185 | 165 | 0.91 |
| | 177 | 81 | 0.81 | 1.62 | 3.24 | 175 | 150 | 1.05 |
| | 178 | 82 | 1.24 | 2.48 | 4.96 | 160 | 135 | 1.45 |
| | 179 | 82 | 1.24 | 2.48 | 4.96 | 160 | 120 | 1.74 |

| | | Heat treatment conditions of head surface | | | | | |
|---|---|---|---|---|---|---|---|
| | Symbol | Cooling rate at head top portion *3 T (° C./sec) | Cooling rate at head side portion *3 S (° C./sec) | Cooling rate at lower chin portion *3 A (° C./sec) | Value of TCR *4 | Microstructure *5 | |
| Invented heat treatment method | 174 | 0.5 | 0.5 | 0.1 | 0.13 | Head top portion | Pearlite |
| | | | | | | Head inner portion | Pearlite |
| | 175 | 3.0 | 3.0 | 1.0 | 0.95 | Head top portion | Pearlite |
| | | | | | | Head inner portion | Pearlite |
| | 176 | 4.0 | 3.0 | 3.0 | 2.00 | Head top portion | Pearlite |
| | | | | | | Head inner portion | Pearlite |
| | 177 | 6.0 | 4.0 | 4.0 | 2.70 | Head top portion | Pearlite |
| | | | | | | Head inner portion | Pearlite |
| | 178 | 5.0 | 6.0 | 5.0 | 3.35 | Head top portion | Pearlite |
| | | | | | | Head inner portion | Pearlite |
| | 179 | 5.0 | 5.0 | 6.0 | 3.75 | Head top portion | Pearlite |
| | | | | | | Head inner portion | Pearlite |

*1 CCR (° C./sec.) = 0.6 + 10 × ([% C] − 0.9) − 5 × ([% C] − 0.9) × [% Si] − 0.17[% Mn] − 0.13[% Cr]

*2 Cooling rate (° C./sec.) at head inner portion: cooling rate at a depth of 30 mm from head top surface in temperature range from 750° C. to 650° C.

*3 Cooling rates at head surface (head top portion, head side portion and lower chin portion): cooling rate in the region from surface to 5 mm in depth in temperature range from 750° C. to 500° C. Cooling rates at head side portion and lower chin portion are average figures of right and left sides of rail.

*4 TCR = 0.05 × T (cooling rate at head top portion, ° C./sec.) + 0.10 × S (cooling rate at head side portion, ° C./sec.) + 0.50 × J (cooling rate at lower chin portion, ° C./sec.)

*5 Microstructures are observed at a depth of 2 mm (head top portion) and at a depth of 30 mm (head inner portion) from head top surface.

TABLE 32

| | Symbol | Steel | Value of CCR *1 | 2 CCR | 4 CCR | Rolling length (m) | Time up to the start of heat treatment of head portion (sec) | Heat treatment conditions of head inner portion Cooling rate *2 (value of ICR) (° C./sec) |
|---|---|---|---|---|---|---|---|---|
| Invented heat treatment method | 180 | 83 | 1.13 | 2.26 | 4.52 | 155 | 110 | 1.25 |
| | 181 | 83 | 1.13 | 2.26 | 4.52 | 145 | 80 | 1.50 |
| | 182 | 84 | 2.49 | 4.98 | 9.97 | 130 | 65 | 3.54 |
| | 183 | 85 | 1.64 | 3.28 | 6.56 | 105 | 35 | 2.25 |
| | 184 | 86 | 2.66 | 5.32 | 10.64 | 120 | 15 | 2.25 |

| | | Heat treatment conditions of head surface | | | | | |
|---|---|---|---|---|---|---|---|
| | Symbol | Cooling rate at head top portion *3 T (° C./sec) | Cooling rate at head side portion *3 S (° C./sec) | Cooling rate at lower chin portion *3 A (° C./sec) | Value of TCR *4 | Microstructure *5 | |
| Invented heat treatment method | 180 | 6.0 | 2.0 | 5.0 | 3.00 | Head top portion | Pearlite |
| | | | | | | Head inner portion | Pearlite |
| | 181 | 8.0 | 4.0 | 5.0 | 3.30 | Head top portion | Pearlite |
| | | | | | | Head inner portion | Pearlite |
| | 182 | 6.0 | 8.0 | 12.0 | 7.10 | Head top portion | Pearlite |
| | | | | | | Head inner portion | Pearlite |
| | 183 | 4.0 | 6.0 | 8.0 | 4.80 | Head top portion | Pearlite |
| | | | | | | Head inner portion | Pearlite |
| | 184 | 12.0 | 8.0 | 14.0 | 8.40 | Head top portion | Pearlite |
| | | | | | | Head inner portion | Pearlite |

*1 CCR (° C./sec.) = 0.6 + 10 × ([% C] − 0.9) − 5 × ([% C] − 0.9) × [% Si] − 0.17[% Mn] − 0.13[% Cr]

*2 Cooling rate (° C./sec.) at head inner portion: cooling rate at a depth of 30 mm from head top surface in temperature range from 750° C. to 650° C.

*3 Cooling rates at head surface (head top portion, head side portion and lower chin portion): cooling rate in the region from surface to 5 mm in depth in temperature range from 750° C. to 500° C. Cooling rates at head side portion and lower chin portion are average figures of right and left sides of rail.

*4 TCR = 0.05 × T (cooling rate at head top portion, ° C./sec.) + 0.10 × S (cooling rate at head side portion, ° C./sec.) + 0.50 × J (cooling rate at lower chin portion, ° C./sec.)

*5 Microstructures are observed at a depth of 2 mm (head top portion) and at a depth of 30 mm (head inner portion) from head top surface.

TABLE 33

| | Symbol | Steel | Value of CCR *1 | 2 CCR | 4 CCR | Rolling length (m) | Time up to the start of heat treatment of head portion (sec) | Heat treatment conditions of head inner portion Cooling rate *2 (value of ICR) (° C./sec) |
|---|---|---|---|---|---|---|---|---|
| Comparative heat treatment method | 185 | 80 | 0.39 | 0.78 | 1.56 | 198 | 198 | 0.30 (Insufficient cooling) |
| | 186 | 80 | 0.39 | 0.78 | 1.56 | 185 | 178 | 1.25 |
| | 187 | 81 | 0.81 | 1.62 | 3.24 | 185 | 165 | 0.55 (Insufficient cooling) |
| | 188 | 81 | 0.81 | 1.62 | 3.24 | 175 | 150 | 1.75 |
| | 189 | 82 | 1.24 | 2.48 | 4.96 | 160 | 135 | 1.05 (Insufficient cooling) |
| | 190 | 82 | 1.24 | 2.48 | 4.96 | 160 | 120 | 2.35 |

| | | Heat treatment conditions of head surface | | | | | |
|---|---|---|---|---|---|---|---|
| | Symbol | Cooling rate at head top portion *3 T (° C./sec) | Cooling rate at head side portion *3 S (° C./sec) | Cooling rate at lower chin portion *3 A (° C./sec) | Value of TCR *4 | Microstructure *5 | |
| Comparative heat treatment method | 185 | 2.0 | 1.0 | 1.0 | 0.70 (Insufficient cooling) | Head top portion | Pearlite |
| | | | | | | Head inner portion | Pearlite + pro-eutectoid cementite |
| | 186 | 6.0 | 5.0 | 4.0 | 2.80 (Over-cooling) | Head top portion | Pearlite + bainite + martensite |
| | | | | | | Head inner portion | Pearlite |
| | 187 | 4.0 | 1.0 | 2.0 | 1.30 (Insufficient cooling) | Head top portion | Pearlite |
| | | | | | | Head inner portion | Pearlite + pro-eutectoid cementite |
| | 188 | 5.0 | 5.0 | 6.0 | 3.75 (Over-cooling) | Head top portion | Pearlite |
| | | | | | | Head inner portion | Pearlite + bainite + martensite |
| | 189 | 4.0 | 4.0 | 3.0 | 2.10 (Insufficient cooling) | Head top portion | Pearlite |
| | 190 | 10.0 | 10.0 | 7.0 | 5.00 (Over-cooling) | Head inner portion | Pearlite + pro-eutectoid cementite |

*1 CCR (° C./sec.) = 0.6 + 10 × ([% C] − 0.9) − 5 × ([% C] − 0.9) × [% Si] − 0.17[% Mn] − 0.13[% Cr]

*2 Cooling rate (° C./sec.) at head inner portion: cooling rate at a depth of 30 mm from head top surface in temperature range from 750° C. to 650° C.

*3 Cooling rates at head surface (head top portion, head side portion and lower chin portion): cooling rate in the region from surface to 5 mm in depth in temperature range from 750° C. to 500° C. Cooling rates at head side portion and lower chin portion are average figures of right and left sides of rail.

*4 TCR = 0.05 × T (cooling rate at head top portion, ° C./sec.) + 0.10 × S (cooling rate at head side portion, ° C./sec.) + 0.50 × J (cooling rate at lower chin portion, ° C./sec.)

*5 Microstructures are observed at a depth of 2 mm (head top portion) and at a depth of 30 mm (head inner portion) from head top surface.

TABLE 34

| | Symbol | Steel | Value of CCR *1 | 2 CCR | 4 CCR | Rolling length (m) | Time up to the start of heat treatment of head portion (sec) | Heat treatment conditions of head inner portion Cooling rate *2 (value of ICR) (° C./sec) |
|---|---|---|---|---|---|---|---|---|
| Comparative heat treatment method | 191 | 82 | 1.24 | 2.48 | 4.96 | 160 | 250 (Time too long, cementite formed) | 2.20 |
| | 192 | 83 | 1.13 | 2.26 | 4.52 | 145 | 80 | 0.95 (Insufficient cooling) |
| | 193 | 84 | 2.49 | 4.98 | 9.97 | 130 | 65 | 1.00 (Insufficient cooling) |
| | 194 | 86 | 2.66 | 5.32 | 10.64 | 245 (Excessive rail length, rail ends overcooled) | 15 | 2.25 |

| | | Heat treatment conditions of head surface | | | | | |
|---|---|---|---|---|---|---|---|
| | Symbol | Cooling rate at head top portion*3 T (° C./sec) | Cooling rate at head side portion *3 S (° C./sec) | Cooling rate at lower chin portion *3 A (° C./sec) | Value of TCR *4 | Microstructure *5 | |
| Comparative heat treatment method | 191 | 4.0 | 5.0 | 6.0 | 3.70 | Head top portion | Pearlite |
| | | | | | | Head inner portion | Pearlite + trace pro-eutectoid cementite |
| | 192 | 6.0 | 2.0 | 3.0 | 2.00 (Insufficient cooling) | Head top portion | Pearlite |
| | | | | | | Head inner portion | Pearlite + pro-eutectoid cementite |
| | 193 | 4.0 | 4.0 | 3.0 | 2.10 (Insufficient cooling) | Head top portion | Pearlite |
| | | | | | | Head inner portion | Pearlite + pro-eutectoid cementite |
| | 194 | 12.0 | 8.0 | 14.0 | 8.40 | Head top portion | Pearlite |
| | | | | | | Head inner portion | Pearlite + trace pro-eutectoid cementite |

*1 CCR (° C./sec.) = 0.6 + 10 × ([% C] − 0.9) − 5 × ([% C] − 0.9) × [% Si] − 0.17[% Mn] − 0.13[% Cr]

*2 Cooling rate (° C./sec.) at head inner portion: cooling rate at a depth of 30 mm from head top surface in temperature range from 750° C. to 650° C.

*3 Cooling rates at head surface (head top portion, head side portion and lower chin portion): cooling rate in the region from surface to 5 mm in depth in temperature range from 750° C. to 500° C. Cooling rates at head side portion and lower chin portion are average figures of right and left sides of rail.

*4 TCR = 0.05 × T (cooling rate at head top portion, ° C./sec.) + 0.10 × S (cooling rate at head side portion, ° C./sec.) + 0.50 × J (cooling rate at lower chin portion, ° C./sec.)

*5 Microstructures are observed at a depth of 2 mm (head top portion) and at a depth of 30 mm (head inner portion) from head top surface.

INDUSTRIAL APPLICABILITY

The present invention makes it possible to provide: a pearlitic steel rail wherein the wear resistance required of the head portion of a rail for a heavy load railway is improved, rail breakage is inhibited by controlling the number of fine pearlite block grains at the railhead portion and thus improving ductility and, at the same time, toughness of the web and base portions of the rail is prevented from deteriorating by reducing the amount of pro-eutectoid cementite structures forming at the web and base portions; and a method for efficiently producing a high-quality pearlitic steel rail by optimizing the heating conditions of a bloom (slab) for the rail and, by so doing, preventing the generation of cracks and breaks during hot rolling, and suppressing decarburization at the outer surface of the bloom (slab).

The invention claimed is:

1. A method of heat treatment for a pearlitic steel rail containing 65 to 1.40 mass % C and excellent in wear resistance and ductility, comprising:

applying finish hot rolling so that the temperature of the rail surface is in the range from 850° C. to 1,000° C. and the sectional area reduction ratio at the final pass is 6% or more;

applying accelerated cooling to the web portion of said steel rail at a cooling rate in the range from 2 to 20° C./sec. and to the head and base portions of said steel rail at a cooling rate in the range from 1 to 10° C./sec, from the austenite temperature range to a temperature not higher than 650° C., within 100 sec. after the finish hot rolling;

controlling the number of the pearlite blocks having grain sizes in the range from 1 to 15 μm so as to be 200 or more per 0.2 $mm^2$ of observation field at least in a part of the region down to a depth of 10 mm from the surface of the corners and top of the head portion; and reducing the amount of pro-eutectoid cementite structures forming in the web portion of the rail so that the number of the pro-eutectoid cementite network intersecting two line segments each 300 μm in length crossing each other at right angles (the number of intersecting pro-eutectoid cementite network, NC) at the center of the centerline in the web portion of the rail satisfies the expression NC≦CE, wherein CE is defined by the following equation:

$$CE=60([\text{mass \% C}])+10([\text{mass \% Si}])+10([\text{mass \% Mn}])+500([\text{mass \% P}])+50([\text{mass \% S}])+30([\text{mass \% Cr}])+50,$$

and wherein the method is further characterized in that, at the finish rolling in the hot rolling of said steel rail, continuous finish rolling is applied so that two or more rolling passes are applied at a sectional area reduction ratio of 1 to 30% per pass and the time period between the passes is 10 sec. or less.

2. The method of claim 1, wherein the pearlitic steel rail excellent in wear resistance and ductility is produced by hot rolling of a steel rail containing, in mass, 0.65 to 1.40% C, 0.05 to 2.00% Si, and 0.05 to 2.00% Mn.

3. The method of claim 1, wherein the pearlitic steel rail excellent in wear resistance and ductility is produced by the hot rolling of a steel rail containing, in mass, 0.65 to 1.40% C, 0.05 to 2.00% Si, 0.05to 2.00% Mn, and 0.05 to 2.00% Cr.

4. A method of heat treatment for a pearlitic steel rail containing 0.65 to 1.40 mass % C and excellent in wear resistance and ductility, comprising:

applying finish hot rolling so that the temperature of the rail surface is in the range from 850° C. to 1,000° C. and the sectional area reduction ratio at the final pass is 6% or more;

applying accelerated cooling to the web portion of said steel rail at a cooling rate in the range from 2 to 20° C./sec. and to the head and base portions of said steel rail at a cooling rate in the range from 1 to 10° C./sec. from the austenite temperature range to a temperature not higher than 650° C., within 100 sec. after the finish hot rolling;

controlling the number of the pearlite blocks having grain sizes in the range from 1 to 15 μm so as to be 200 or more per 0.2 $mm^2$ of observation field at least in a part of the region down to a depth of 10 mm from the surface of the corners and top of the head portion; and reducing the amount of pro-eutectoid cementite structures forming in the web portion of the rail so that the number of the pro-eutectoid cementite network intersecting two line segments each 300 μm in length crossing each other at right angles (the number of intersecting pro-eutectoid cementite network, NC) at the center of the centerline in the web portion of the rail satisfies the expression NC<CE, wherein CE is defined by the following equation:

$$CE=60([\text{mass \% C}])+10([\text{mass \% Si}])+10([\text{mass \% Mn}])+500([\text{mass \% P}])+50([\text{mass \% S}])+30([\text{mass \% Cr}])+50.$$

5. The method of claim 4, wherein the pearlitic steel rail excellent in wear resistance and ductility is produced by hot rolling of a steel rail containing, in mass, 0.65 to 1.40% C, 0.05 to 2.00% Si, and 0.05 to 2.00% Mn.

6. The method of claim 4, wherein the pearlitic steel rail excellent in wear resistance and ductility is produced by the hot rolling of a steel rail containing, in mass, 0.65 to 1.40% C, 0.05 to 2.00% Si, 0.05 to 2.00% Mn, and 0.05 to 2.00% Cr.

7. A pearlitic steel rail excellent in wear resistance and ductility having pearlite structures containing, in mass, 0.65 to 1.40% C, 0.05 to 2.00% Si, and 0.05 to 2.00% Mn and the balance being Fe and unavoidable impurities, the number of the pearlite blocks having grain sizes in the range from 1 to 15 μm is 200 or more per 0.2 $mm^2$ of observation field at least in a part of the region down to a depth of 10 mm from the surface of the corners and top of the head portion, the pearlitic steel rail being prepared by a method comprising:

finishing a continuous hot rolling the steel rail so that the temperature of the rail surface being in the range from 850° C. to 1000° C. and the sectional area reduction ratio at two or more passes being 1 to 30% per pass and the time period between the passes being 10 seconds or less and the sectional area reduction at the final pass being 6% or more;

applying accelerated cooling to the web portion of said steel rail at a cooling rate in the range from 2 to 20° C./sec. and to the head and base portions of said steel rail at a cooling rate in the range from 1 to 10° C./sec. from the austenite temperature range to a temperature not higher than 650° C., within 100 sec. after the hot rolling; and reducing the amount of pro-eutectoid cementite structures forming in the web portion of the rail so that the number of the pro-eutectoid cementite network intersecting two line segments each 300 μm in length crossing each other at right angles (the number of intersecting pro-eutectoid cementite network, NC) at the center of the centerline in the web portion of the rail satisfies the expression NC≦CE, wherein CE is defined by the following equation:

$$CE=60([\text{mass \% C}])+10([\text{mass \% Si}])+10([\text{mass \% Mn}])+500([\text{mass \% P}])+50([\text{mass \% S}])+30([\text{mass \% Cr}])+50.$$

8. The pearlitic steel rail excellent in wear resistance and ductility according to claim 7, wherein the steel rail having pearlite structures further containing, in mass, one or more of 0.05 to 2.00% Cr, 0.01 to 0.50% Mo, 0.005 to 0.50% V, 0.002 to 0.050% Nb, 0.001 to 0.0050% B, 0.10 to 2.00% Co, 0.05 to 1.00% Cu, 0.05 to 1.00% Ni, 0.0040 to 0.0200% N, 0.0050 to 0.0500% Ti, 0.0005 to 0.0200% Mg, 0.0005 to 0.0150% Ca, 0.0080 to 1.00% Al, and 0.0001 to 0.2000% Zr.

9. The pearlitic steel rail excellent in wear resistance and ductility according to claim 7, wherein the steel rail having pearlite structures further containing, in mass, 0.05 to 2.00% Cr.

10. The pearlitic steel rail excellent in wear resistance and ductility according to claim 9, characterized in that the C content of the steel rail is over 0.85 to 1.40%.

11. The pearlitic steel rail excellent in wear resistance and ductility according to claim 7, characterized in that the length of the rail after hot rolling is 100 to 200 m.

12. The pearlitic steel rail excellent in wear resistance and ductility according to claim 7 characterized in that the hardness in the region down to a depth of at least 20 mm from the surface of the corners and top of the head portion is in the range from 300 to 500 Hv.

13. The pearlitic steel rail excellent in wear resistance and ductility according to claim 7, characterized by further containing, in mass, 0.01 to 0.50% Mo.

14. The pearlitic steel rail excellent in wear resistance and ductility according to claim 7, characterized by further containing, in mass, one or more of 0.005 to 0.50% V, 0.002 to 0.050% Nb, 0.0001 to 0.0050% B, 0.10 to 2.00% Co, 0.05 to 1.00% Cu, 0.05to 1.00% Ni, and 0.0040 to 0.0200% N.

15. The pearlitic steel rail excellent in wear resistance and ductility according to claim 7, characterized by further containing, in mass, one or more of 0.0050 to 0.0500% Ti, 0.0005 to 0.0200% Mg, 0.0005 to 0.0150% Ca, 0.0080 to 1.00% Al, and 0.0001 to 0.2000% Zr.

* * * * *